US008011847B2

(12) United States Patent
Tani

(10) Patent No.: US 8,011,847 B2
(45) Date of Patent: Sep. 6, 2011

(54) EXTRUDING CONTAINER OF APPLYING FILLER

(75) Inventor: Yoshikazu Tani, Tokyo (JP)

(73) Assignee: Tokiwa Corporation, Nakatsugawa-Shi, Gifu (JP)

( * ) Notice: Subject to any disclaimer, the term of this patent is extended or adjusted under 35 U.S.C. 154(b) by 16 days.

(21) Appl. No.: 12/585,127

(22) Filed: Sep. 4, 2009

(65) Prior Publication Data

US 2009/0324322 A1 Dec. 31, 2009

Related U.S. Application Data

(62) Division of application No. 10/551,444, filed as application No. PCT/JP2005/013519 on Jul. 15, 2005, now Pat. No. 7,677,828.

(30) Foreign Application Priority Data

Nov. 10, 2004 (JP) ..... 2004-326946

(51) Int. Cl.
*B05C 11/00* (2006.01)

(52) U.S. Cl. ..... 401/266

(58) Field of Classification Search ..... 401/266, 401/172, 177, 179, 182
See application file for complete search history.

(56) References Cited

U.S. PATENT DOCUMENTS

| | | | | |
|---|---|---|---|---|
| 2,309,861 | A * | 2/1943 | Mureau | 401/174 |
| 6,793,431 | B1 * | 9/2004 | Tsai | 401/172 |
| 7,201,526 | B2 * | 4/2007 | Tani | 401/266 |

FOREIGN PATENT DOCUMENTS

| | | |
|---|---|---|
| JP | 61-151609 | 9/1986 |
| JP | 2000-262324 | 9/2000 |
| JP | 2004-000441 | 1/2004 |
| JP | 2004-089687 | 3/2004 |

* cited by examiner

*Primary Examiner* — Huyen Le
(74) *Attorney, Agent, or Firm* — Bacon & Thomas, PLLC

(57) ABSTRACT

To enhance customer satisfaction in use of an extruding container of an applying filler, a leading tube having a discharge port (101*c*) is formed as a filling member (101), and the filling member (101) having a filling region (101*x*) filled with an applying filler (L) is inserted and attached to a leading end side of a main body side assembly (140) formed by installing a movable body (106), an engagement portion (104*c*, 106*b*) for moving the movable body (106) and a rotation preventing portion (102*d*, 106*e*), whereby the applying filler (L) can be sufficiently filled in the region (101*x*) between the inner side of the discharge port (101*c*) of the filling member (101) and the movable body (106) of the main body side assembly (140), and the applying filler (L) can be rapidly discharged at a first applying time by a user.

4 Claims, 44 Drawing Sheets

EXTRUDING CONTAINER OF APPLYING FILLER

This application is a Divisional of application Ser. No. 10/551,444 filed on Sep. 29, 2005, the entire disclosure of which is herein incorporated by reference.

TECHNICAL FIELD

The present invention relates to an extruding container of an applying filler for extruding the applying filler so as to apply.

BACKGROUND ART

In conventional, as a movable body feeding apparatus provided for use by extruding an applying filler, for example, a liquid filler installed in a container, there has been known a movable body feeding apparatus which is provided with a main body tube in which a filling region where an applying filler is filled is provided in an inner portion, and an operating tube provided in a rear end portion of the main body tube so as to be relatively rotatable, and is structured such that when the main body tube and the operating tube are relatively rotated, the main body tube and a movable body received within the operating tube move forward, and the applying filler is extruded to a leading end side on the basis of a forward movement of a piston provided in a leading end of the movable body, whereby it is possible to apply the applying filler to a portion to be applied through an opening of a discharge cover attached to the leading end of the main body tube (for example, refer to Japanese Unexamined Patent Publication No. 2004-89687

DISCLOSURE OF THE INVENTION

Problem to be Solved by the Invention

In the apparatus mentioned above, the apparatus is obtained by first assembling the movable body having the piston with the operating tube, next assembling the main body tube with the operating tube having the movable body, next setting the assembly to a standing state, introducing and filling the applying filler to a filling region formed between an open end of the comparatively long main body tube and the piston from the open end side of the main body tube, and finally coating with the discharge cover.

However, in the apparatus mentioned above, since a space in which the applying filler is not filled is made in an inner side of the leading end of the coated discharge cover, and the applying filler is hard to come out due to the space at a first applying time by a user after buying, an improvement is desired.

The present invention is made for achieving the problem mentioned above, and an object of the present invention is to provide an extruding container of an applying filler, in which an applying filler is rapidly discharged at a first applying time by a user, so that customer satisfaction is increased.

Means for Solving the Problem

In accordance with the present invention, there is provided an applying filler extruding container discharging an applying filler filled in a filling region within a container through a discharge port provided in a leading end of the container on the basis of forward movement of a movable body arranged within the container, comprising:

a leading tube formed in a tubular shape and having the discharge port at a leading end; and a main body side assembly made by installing the movable body, an engagement portion of a male thread and a female thread for moving the movable body and a rotation preventing portion of the movable body in a main body side tube portion formed in a tubular shape, wherein an inner portion of the leading tube is formed as the filling region so as to be formed as a filling member in which the applying filler is filled, and the filling member in which the applying filler is filled is inserted to the leading end side of the main body side assembly so as to be attached to the main body side assembly.

In accordance with the applying filler extruding container, since the structure is made such that the leading tube having the discharge port is formed as the filling member, and the filling member in which the applying filler is filled by setting the inner side of the filling member as the filling region is inserted and attached to the leading end side of the main body side assembly formed by installing the movable body, the engagement portion for moving the movable body and the rotation preventing portion, it is possible to sufficiently fill the applying filler in the region between the inner side of the discharge port of the filling member and the movable body of the main body side assembly, and the applying filler can be rapidly discharged at the first applying time by the user.

In this case, as a particular structure effectively achieving the operation mentioned above, the main body side assembly is provided with a main body tube having a female thread engaging with a male thread provided in an outer surface of the movable body, an operating tube coupled to a rear end side of the main body tube so as to be rotatable and immobile in an axial direction, and a shaft body portion extended from a bottom portion of the operating tube and having a non-circular cross sectional shape, in the middle of the inner surface in an axial direction, the movable body is formed in a tubular shape, is outside inserted to the shaft body portion and is engaged with the non-circular shape of the shaft body portion so as to be non-rotatable and movable in the axial direction, an engagement portion between the movable body and the shaft body portion is formed as a rotation preventing portion, a locking portion provided in an outer surface in a rear half side of the filling member is coupled to a locking portion provided in an inner surface in a leading end side of the main body tube so as to be non-rotatable and immobile in the axial direction, and the movable body is moved on the basis of a relative rotation of the operating tube and the main body tube or the filling member.

In accordance with the structure mentioned above, since the structure is made such that the locking portion in the outer surface of the filling member and the locking portion in the inner surface of the main body tube are directly locked via no other member, it is possible to make the applying filler extruding container thin.

Further, as the other particular structure effectively achieving the operation mentioned above, the main body side assembly is provided with a main body tube, a thread tube received in the main body tube so as to be rotatable and immobile in an axial direction and having in an inner surface a female thread engaging with a male thread provided in an outer surface of the movable body, and a shaft body portion extended from a bottom portion of the main body tube and having a non-circular cross sectional shape, the movable body is formed in a tubular shape, is outside inserted to the shaft body portion and is engaged with the non-circular shape of the shaft body portion so as to be non-rotatable and movable in the axial direction, an engagement portion between the movable body and the shaft body portion is formed as a rotation preventing portion, a locking portion provided in an inner surface in a rear end side of the filling member is coupled to a locking portion provided in an outer surface of the thread tube so as to be non-rotatable and immobile in the axial direction, and the movable body is moved on the basis of a relative rotation of the main body tube and the filling member.

In accordance with the structure mentioned above, since the structure is made such that a cap covering the filling member is not directly locked to the filling member so as to be rotatable, the movable body is not fed out even if the cap and the main body tube are relatively rotated at a non-use time when the cap is put on the filling member, the applying filler does not leak out from the discharge port of the filling member.

Further, the structure may be made such that the main body side assembly has a predetermined built-in engagement portion, and a built-in rotating amount regulating member having a concavo-convex portion arranged so as to face to the predetermined engagement portion in an axial direction and energized toward the predetermined engagement portion by an elastic portion, and the concavo-concave portion of the rotating amount regulating member and the predetermined engagement portion are engaged by click in accordance with a fixed amount relative rotation in forward and reverse directions between the filling member and the member coupling the filling member so as to be rotatable and immobile in the axial direction. In accordance with this structure, a forward moving degree and a returning degree of the movable body is detected by the user in accordance with a click feeling on the basis of the click engagement. Further, a predetermined space is formed in an inner side of the discharge port of the filling member by returning the movable body to a certain degree while the user detects the returning degree of the movable body in accordance with the click feeling after applying. Accordingly, even if the applying filler filled in the filling region and the air mixed into the applying filler are expanded on the basis of temperature variation and variation of atmospheric pressure, it is possible to prevent the applying filler from leaking out from the discharge port on the basis of the predetermined space provided in the inner side of the discharge port.

Further, the structure may be made such that the concavo-convex portion and the engagement portion constitute a ratchet mechanism allowing one-way rotation, and allow only forward movement of the movable body.

In this case, if a rotating force for moving backward more is applied to the movable body existing in a maximum retreated position, there is a risk that the shaft body portion engaging with the movable body is wrenched off in a bottom surface of the operating tube or the main tube. Accordingly, it is preferable that a plurality of concave portions depressed to the leading end side or a plurality of convex portions protruding to the rear side are provided in a rear end surface of the movable body along a peripheral direction, and a plurality of convex portions moving forward to the concave portions of the movable body at the maximum retreated time of the movable body so as to be engaged in the rotating direction, or a plurality of concave portions to which the convex portions of the movable body move forward so as to be engaged in the rotating direction are provided in the bottom surface of the operating tube or the main body tube and a peripheral edge of the shaft body portion.

In the case of employing the structure mentioned above, since the rotating force applied to the shaft body portion at the maximum retreated time of the movable body so as to retreat the movable body more is applied to a plurality of convex portions provided in the bottom surface of the operating tube or the main body tube and in the peripheral edge of the shaft body portion via a plurality of concave portions provided in the rear end surface of the movable body, or a plurality of concave portions provided in the bottom surface of the operating tube or the main body tube and in the peripheral edge of the shaft body portion via a plurality of convex portions provided in the rear end surface of the movable body so as to be dispersed, it is possible to prevent the shaft body portion from being wrenched off.

EFFECT OF THE INVENTION

As mentioned above, in accordance with the applying filler extruding container on the basis of the present invention, since the applying filler is rapidly discharged at the first applying time by the user, it is possible to provide the applying filler extruding container in which a customer satisfaction is improved.

BEST MODE FOR CARRYING OUT THE INVENTION

Figure 1:
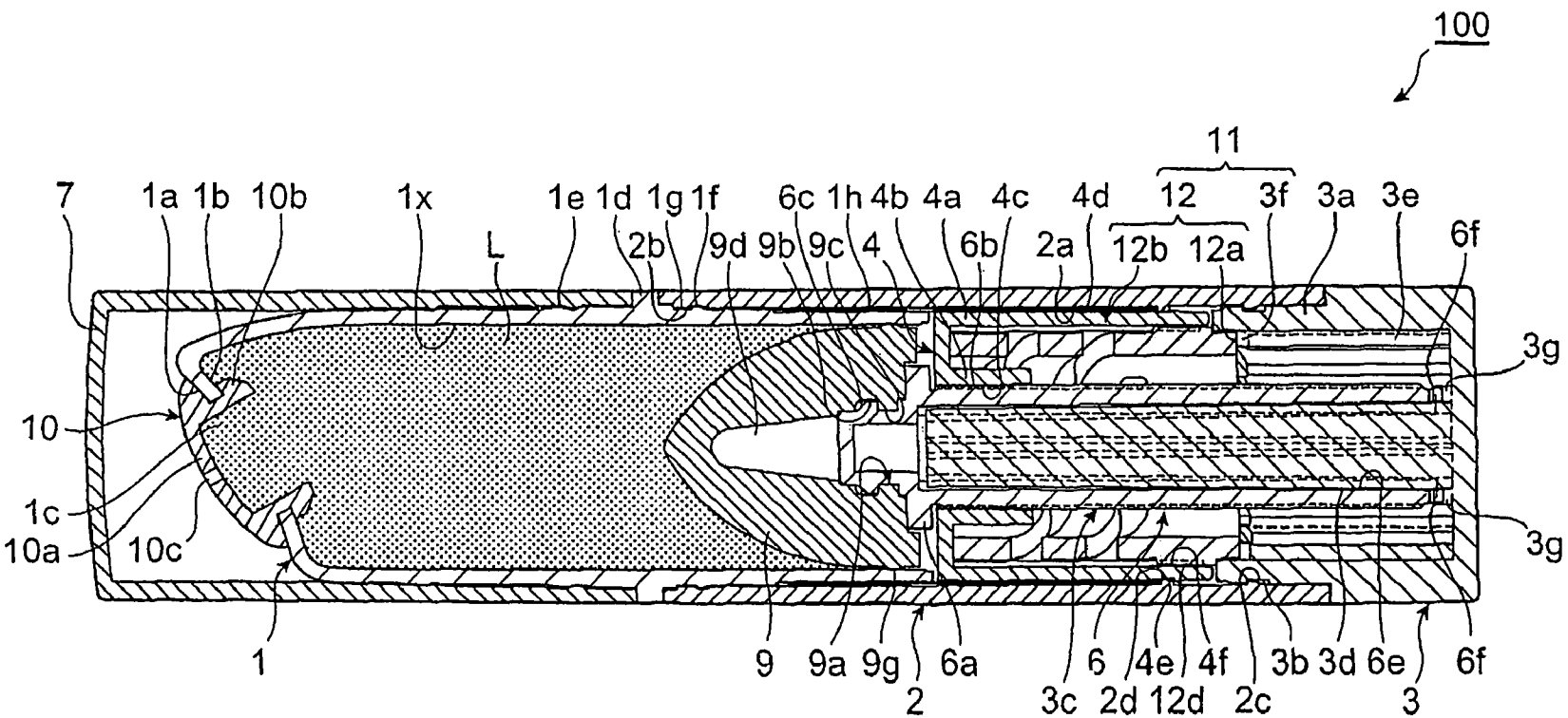
FIG. 1 is a longitudinal sectional view showing an applying filler extruding container in accordance with a first embodiment of the present invention.

A description will be given of a preferable embodiment of an applying filler extruding container in accordance with the present invention with reference to FIGS. 1 to 44. In this case, each of the drawings, the same reference numerals are attached to the same elements and an overlapping description will be omitted.

FIGS. 1 to 28 show a first embodiment in accordance with the present invention, and FIGS. 29 to 44 show a second embodiment in accordance with the present invention, respectively. The applying filler extruding container in accordance with the present embodiment can appropriately extrude the applying filler on the basis of an operation of a user as well as receiving the applying filler.

In this case, a lip gloss is employed as a particularly preferable example of the applying filler, however, the applying filler is not limited to this, but can be a liquid, a kneaded semisolid including a jelly and a paste, and a solid and the like, such as a lip color, an eye color, an eye liner, an essence, a cleaning solvent, a nail enamel, a nail care liquid solution, a nail enamel remover, a mascara, an anti-aging, a hair color, a hair cosmetic, an oral care, a massage oil, a keratotic plugging reducer, a foundation, a concealer, a skin cream, an ink for a writing instrument including a marking pen, a liquid medicine, a slurry and the like. It is particularly preferable for achieving the present invention to employ the applying filler having a high viscosity.

Figure 2:
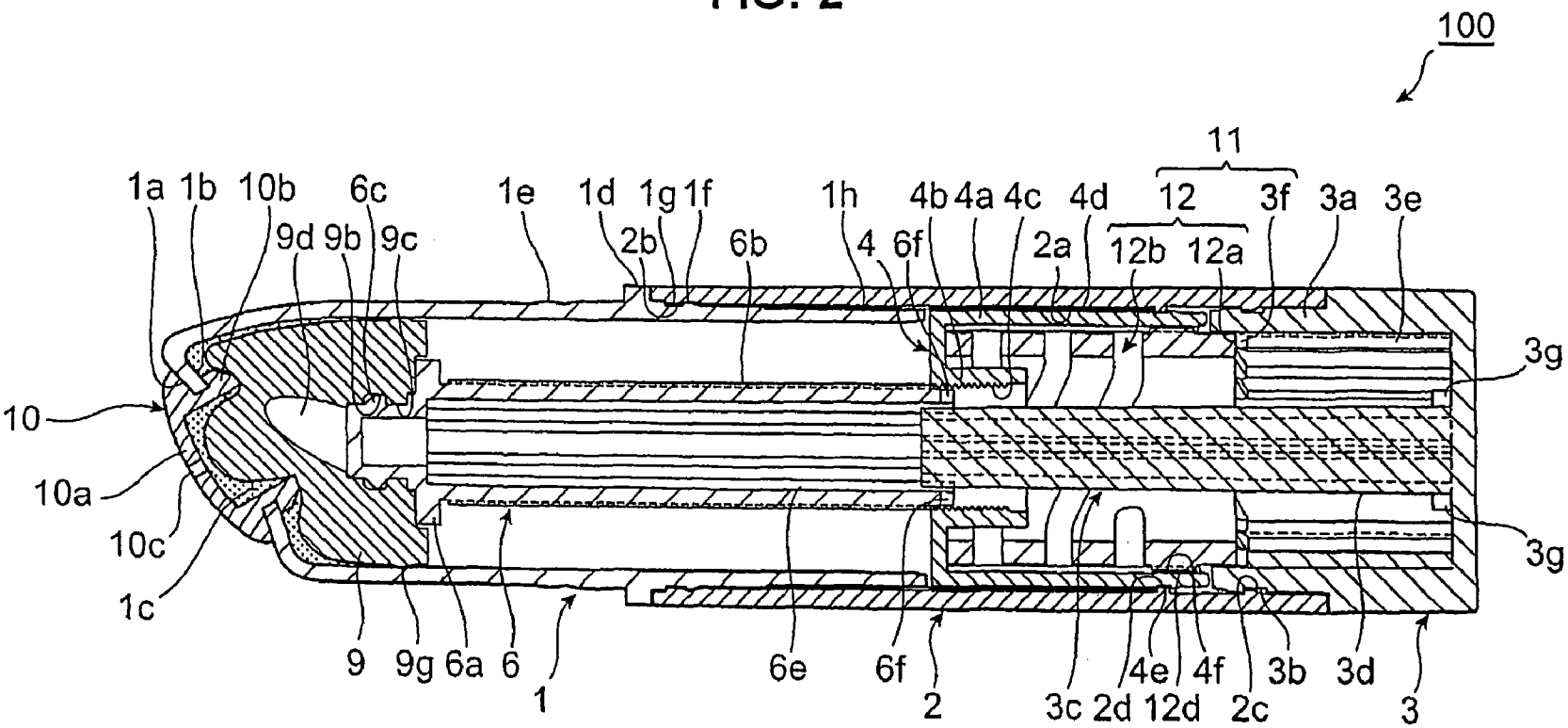
FIG. 2 is a longitudinal sectional view showing a state that a cap of the applying filler extruding container in accordance with the first embodiment of the present invention is taken off, and that a movable body is at a maximum forward moving time.

As shown in FIGS. 1 and 2, an applying filler extruding container 100 is provided with a filling member 1 corresponding to a leading tube having in an inner portion a filling region 1*x* in which an applying filler L is filled, a main body tube (a main body side tube body) 2 coupling the filling member 1 so as to be non-rotatable and immobile in an axial direction in a state in which a rear half portion of the filling member 1 is inserted into a front half portion thereof, an operating tube (a main body side tube body) 3 coupled to a rear end portion of the main body tube 2 so as to be relatively rotatable and immobile in the axial direction, and an applying body 10 constituting a leading end portion of the filling member 1 and provided for applying the applying filler L, as an outer structure. Further, an inner side of the container is generally provided with a movable body 6 having an elastic body 9 in a leading end portion and moving forward and backward in the axial direction by relatively rotating the main body tube 2 or the filling member 1 and the operating tube 3, a thread tube 4 serving as an engagement mechanism (an engagement portion) which can move the movable body 6 on the basis of the relative rotation, and a click mechanism 11 giving a click feeling in synchronous with the relative rotation in forward and reverse directions.

Figure 3:
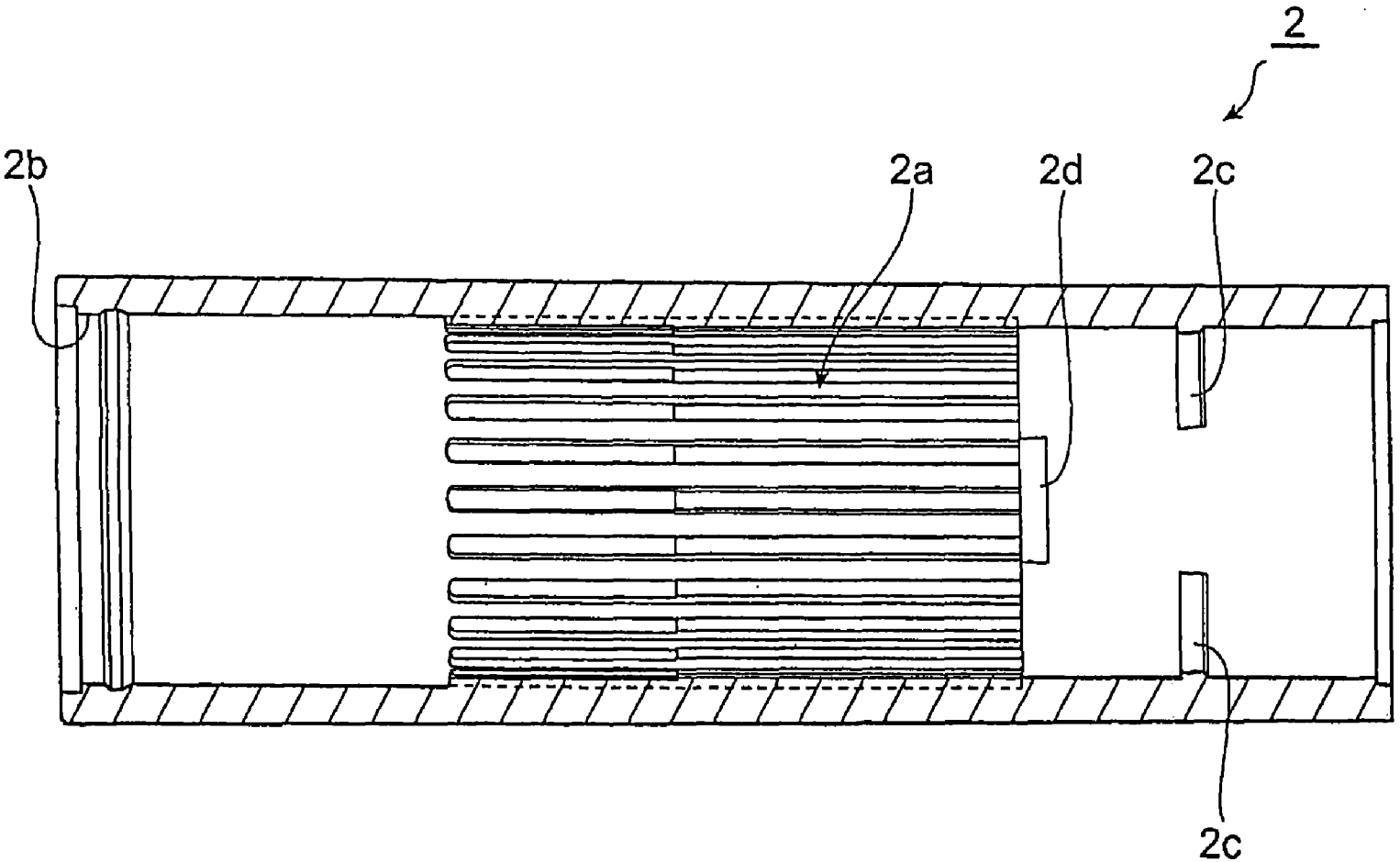
FIG. 3 is a longitudinal sectional view showing a main body tube in FIGS. 1 and 2.
Figure 4:
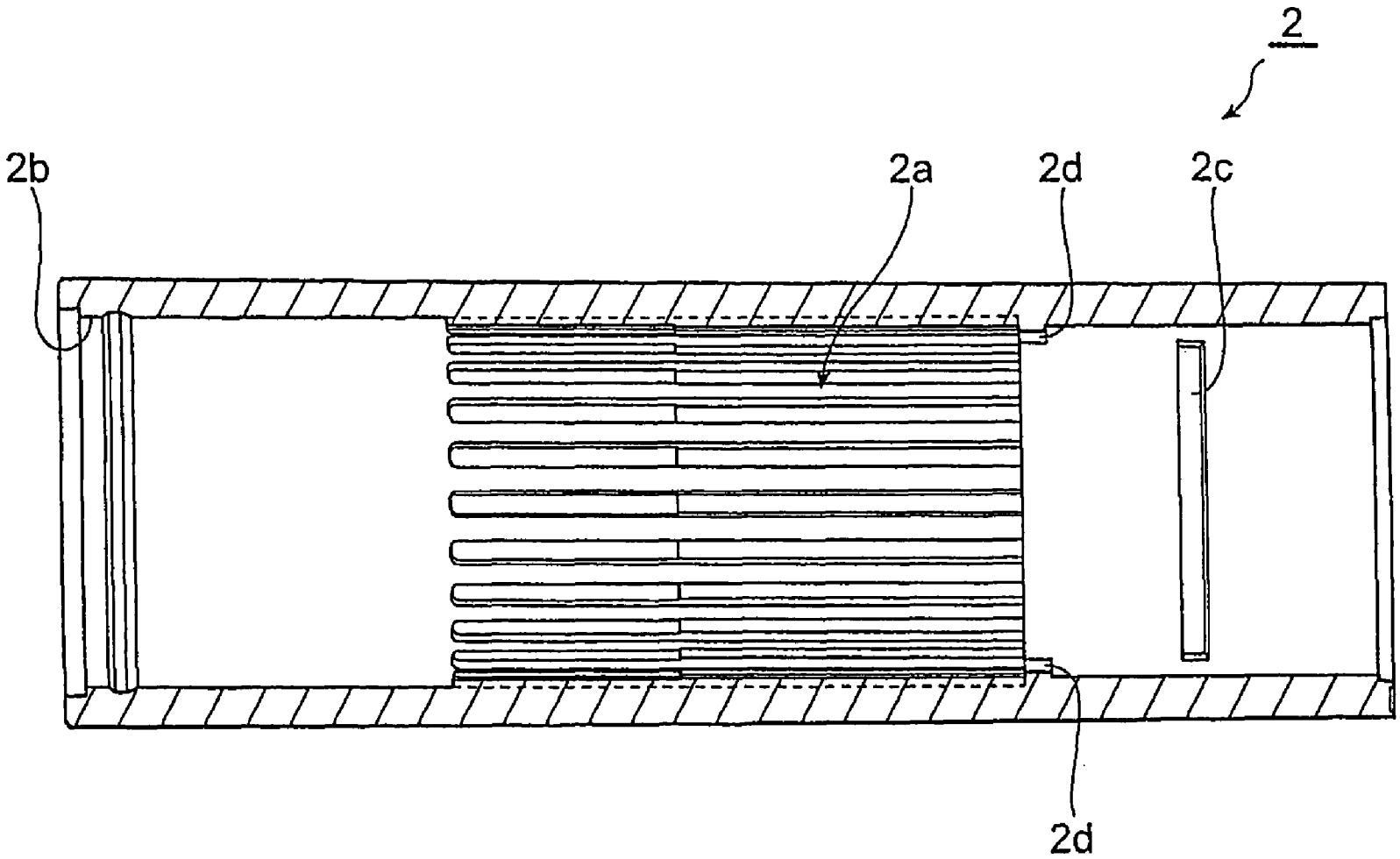
FIG. 4 is an orthogonal longitudinal sectional view of the main body tube shown in FIG. 3.

As shown in FIGS. 3 and 4, the main body tube 2 is structured in a cylindrical shape, and has a knurling 2*a*, which is provided with a lot of concavities and convexities in parallel in a peripheral direction and in which the concavities and convexities extend at a predetermined length in an axial direction, in an inner peripheral surface of a center portion in an axial direction thereof. The knurling 2*a* is provided such that a front half portion thereof engages the filling member 1 in a rotating direction, and a rear half portion engages the thread tube 4 in the rotating direction. Further, an annular protruding portion 2*b* for engaging the filling member 1 in an axial direction is provided in an inner peripheral surface of a leading end portion of the main body tube 2. Further, two protruding portions 2*c* extending in a circular arc shape along a peripheral direction are formed in an inner peripheral surface in a rear portion side of the main body tube 2, and two protruding portions 2*d* extending in a circular arc shape along a peripheral direction are formed at a front side position from the circular arc shaped protruding portion 2*c*. The circular arc shaped protruding portion 2*c* is provided for engaging the operating tube 3 in the axial direction, and the circular arc shaped protruding portion 2*d* is provided for engaging the thread tube 4 in the axial direction. The circular arc shaped protruding portion 2*c* and the circular arc shaped protruding portion 2*d* are provided at positions which do not overlap in the axial direction.

Figure 5:
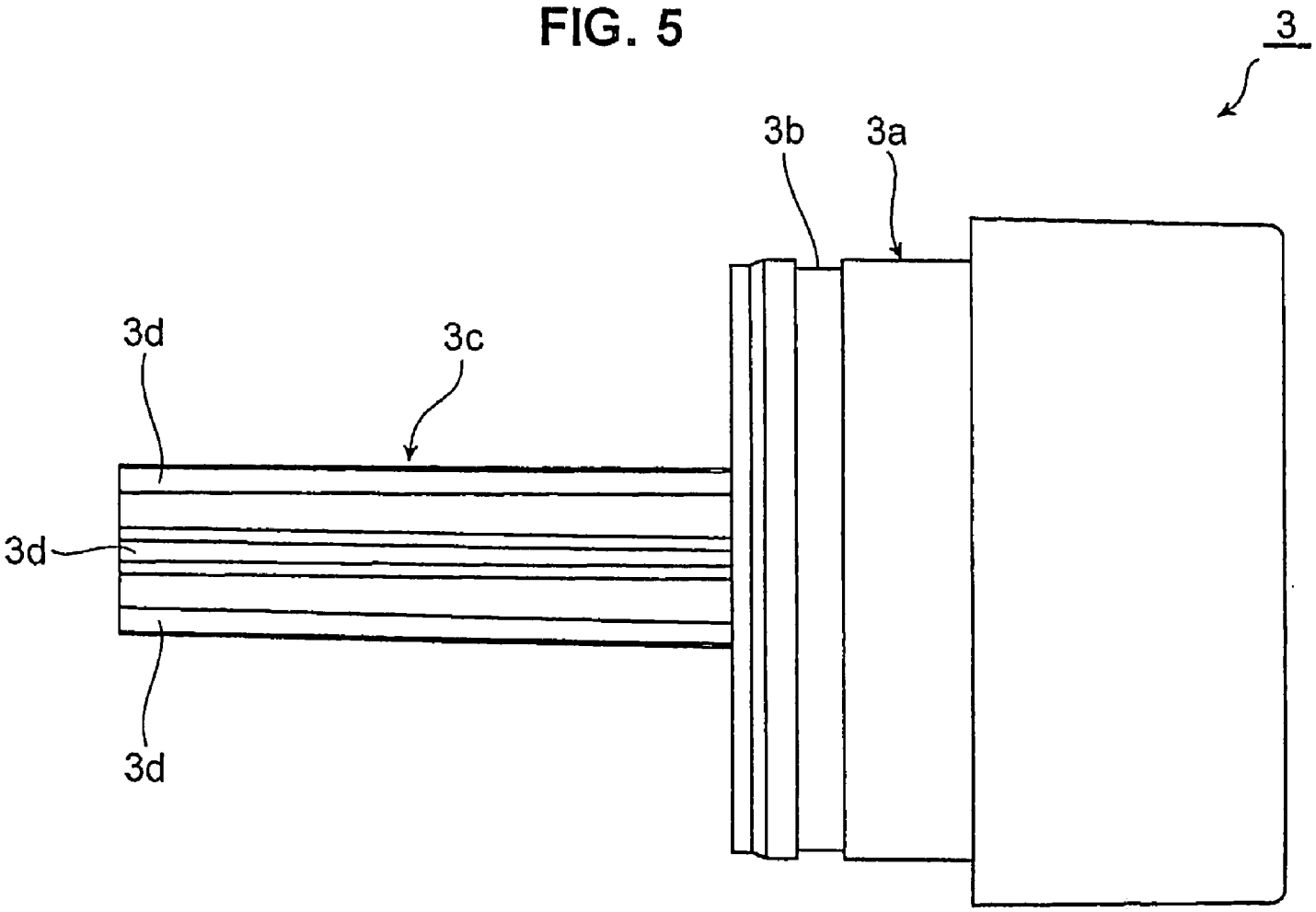
FIG. 5 is a side view showing an operating tube in FIGS. 1 and 2.
Figure 6:
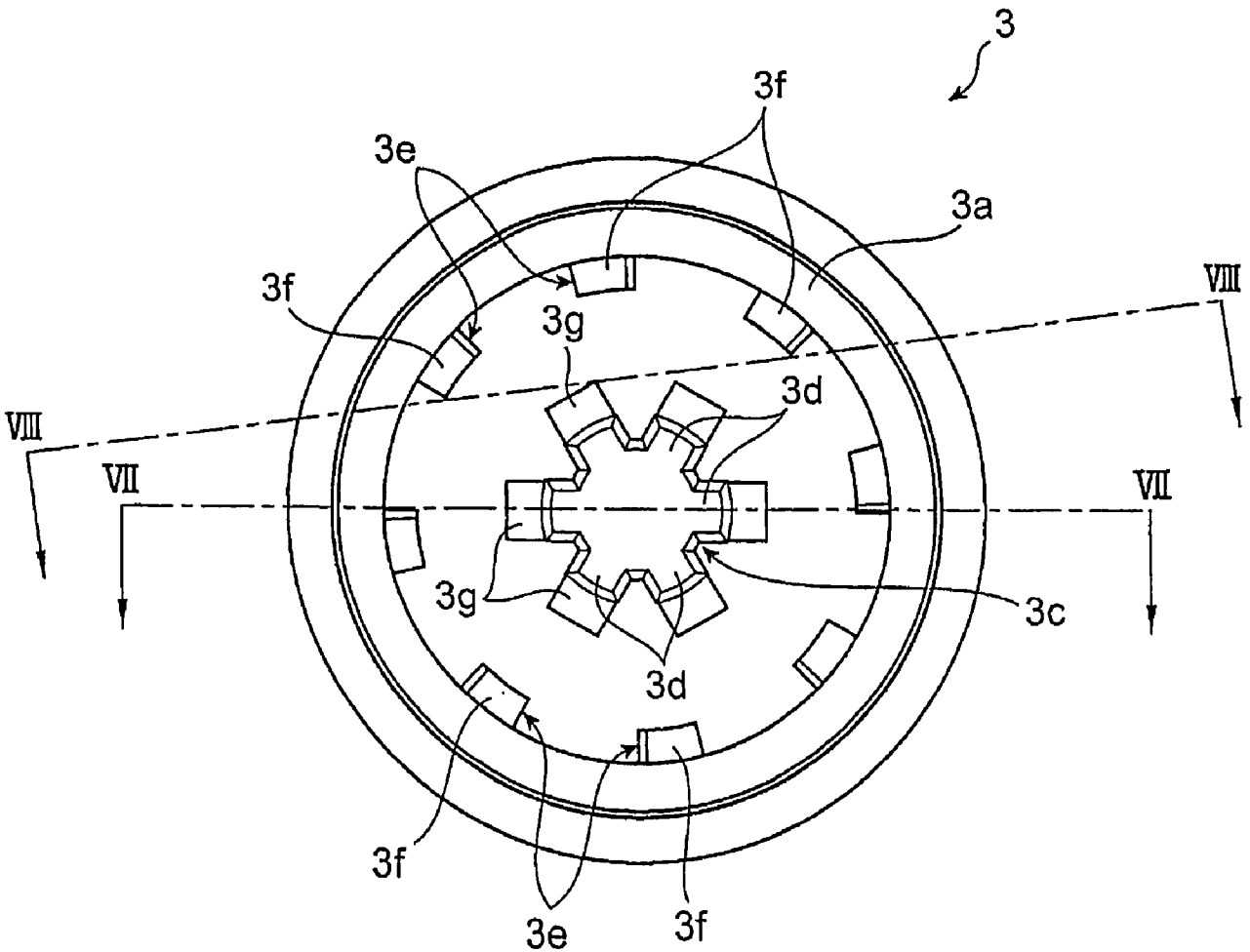
FIG. 6 is a left side view of the operating tube shown in FIG. 5.
Figure 7:
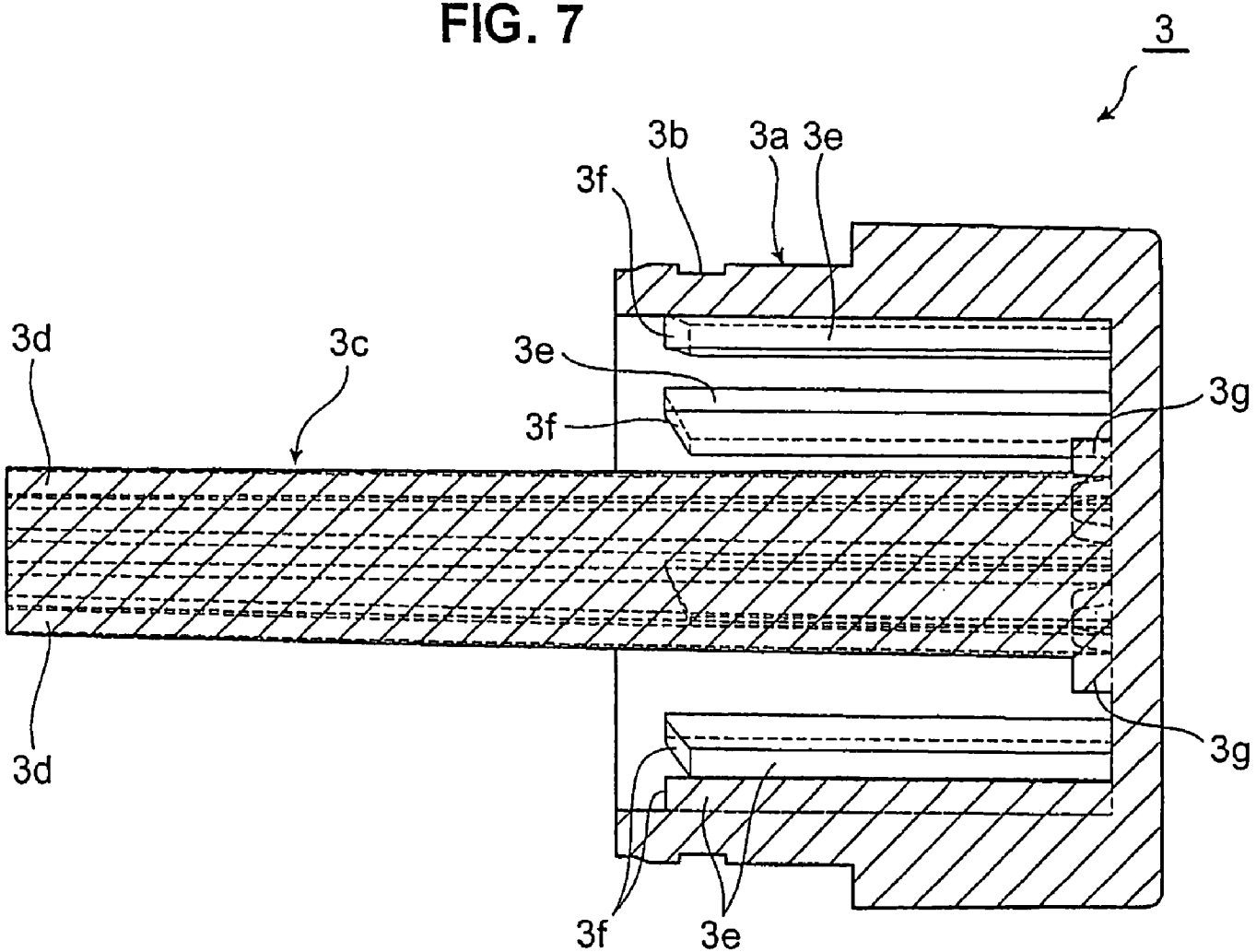
FIG. 7 is a view as seen in an arrow direction at a line VII-VII in FIG. 6.
Figure 8:
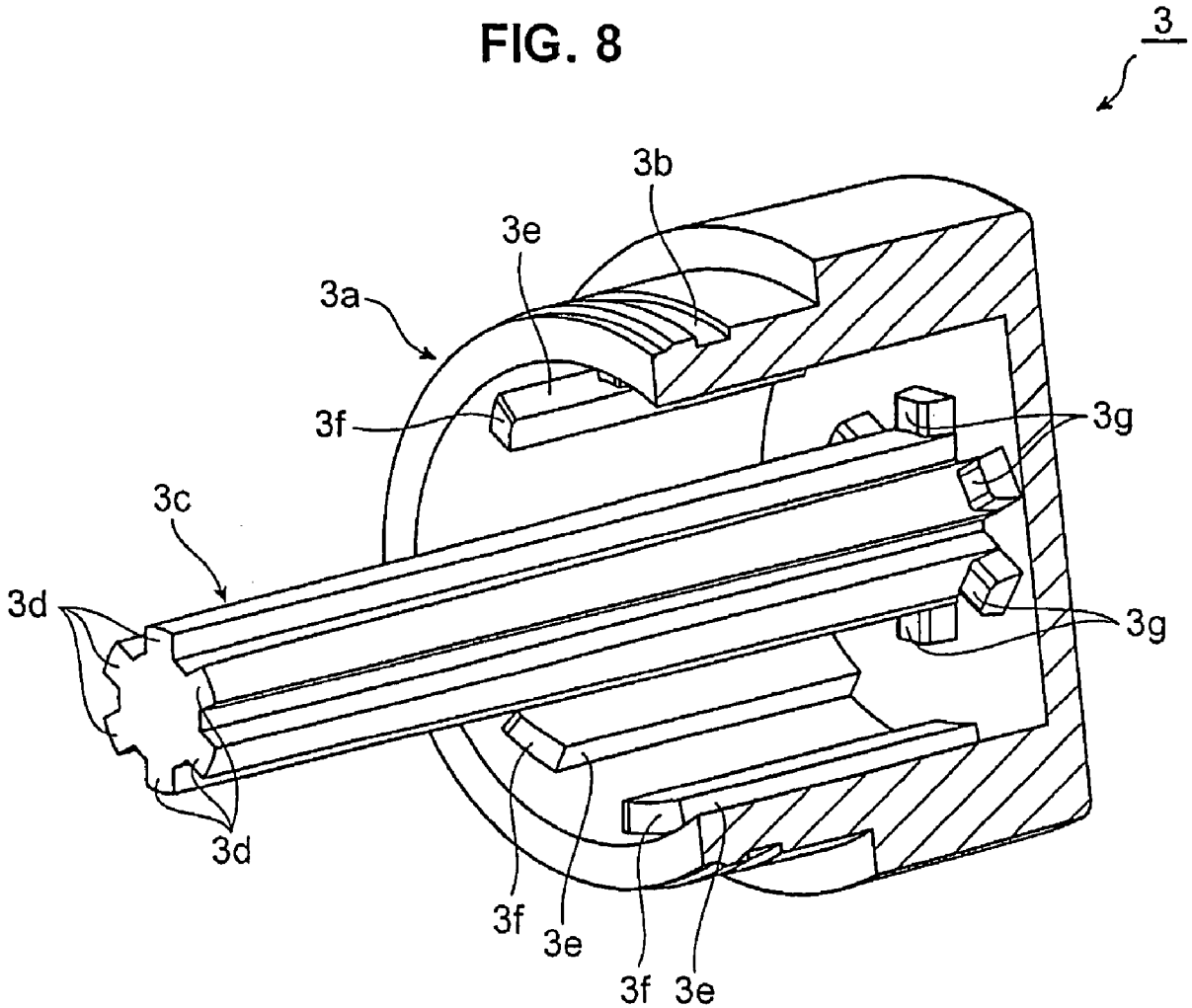
FIG. 8 is a perspective view along a line VIII-VIII in FIG. 6.

The operating tube 3 is structured in a closed-end cylindrical shape as shown in FIGS. 5 to 8, is provided with a leading end tube portion 3*a* having a small outer diameter in a leading end side, and is provided with an annular groove portion 3*b* for engaging with the circular arc shaped protruding portion 2*c* of the main body tube 2 in the axial direction, as shown in FIGS. 5, 7 and 8, in an outer peripheral surface of the leading end tube portion 3*a*.

A shaft body (a shaft body portion) 3*c* is provided in a rising manner in a center of a bottom portion in the operating tube 3 so as to extend toward a leading end side, as shown in FIGS. 5 to 8. The shaft body 3*c* is formed in a non-circular shape in cross section provided with protrusions 3*d* arranged so as to protrude in a radial direction at six equal positions along a peripheral direction on an outer peripheral surface of a columnar body and extending in an axial direction, and the protrusions 3*d* are formed as a rotation prevention constituting one side of rotation preventing mechanisms (rotation preventing portions) of the movable body 6.

Further, as shown in FIGS. 6 to 8, the operating tube 3 is provided with protrusions 3*e* extending toward a leading end side from a bottom portion at eight equal positions along the peripheral direction, in an inner peripheral surface thereof. In the protrusion 3*e*, a leading end portion 3*f* is formed as a predetermined engagement portion constituting a click mechanism 11. Further, in the present embodiment, a leading end surface of the leading end portion 3*f* of the protrusion 3*e* is formed as an inclined surface inclined in one direction.

Further, a peripheral edge of the shaft body 3*c* in a bottom surface of the operating tube 3 is provided with a protruding portion 3*g* protruding short to the leading end side and formed for engaging with the movable body 6 in a rotating direction at the maximum retreated time of the movable body 6. The protruding portion 3*g* structures one side of shaft body wrench-off preventing mechanisms for preventing the shaft body 3*c* from being wrenched off at a time when an excessive rotating force is applied to the shaft body 3*c*, and is provided so as to be connected to a rear end portion of each of the protrusions 3*d* of the shaft body 3*c*.

The operating tube 3 is inside inserted to the main body tube 2 from the leading end tube portion 3*a* as shown in FIGS. 1 and 2, a step surface between the leading end tube portion 3*a* and a closed-end portion in a rear side thereof is brought into contact with a rear end surface of the main body tube 2, and the annular groove portion 3*b* engages with the circular arc shaped protruding portion 2*c* of the main body tube 2, thereby the operating tube 3 being attached to the main body 2 so as to be rotatable and immobile in the axial direction.

Figure 13:
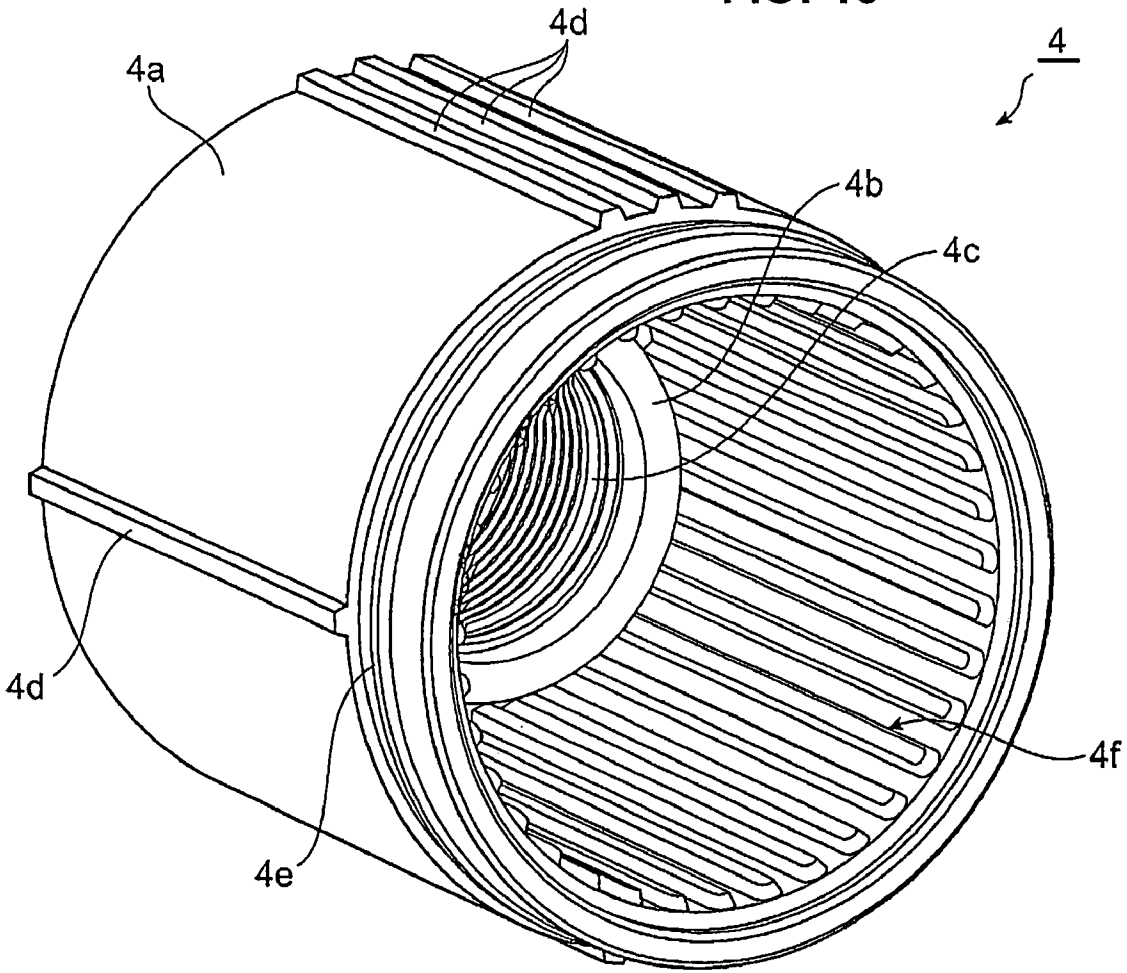
FIG. 13 is a perspective view showing a thread tube in FIGS. 1 and 2.
Figure 14:
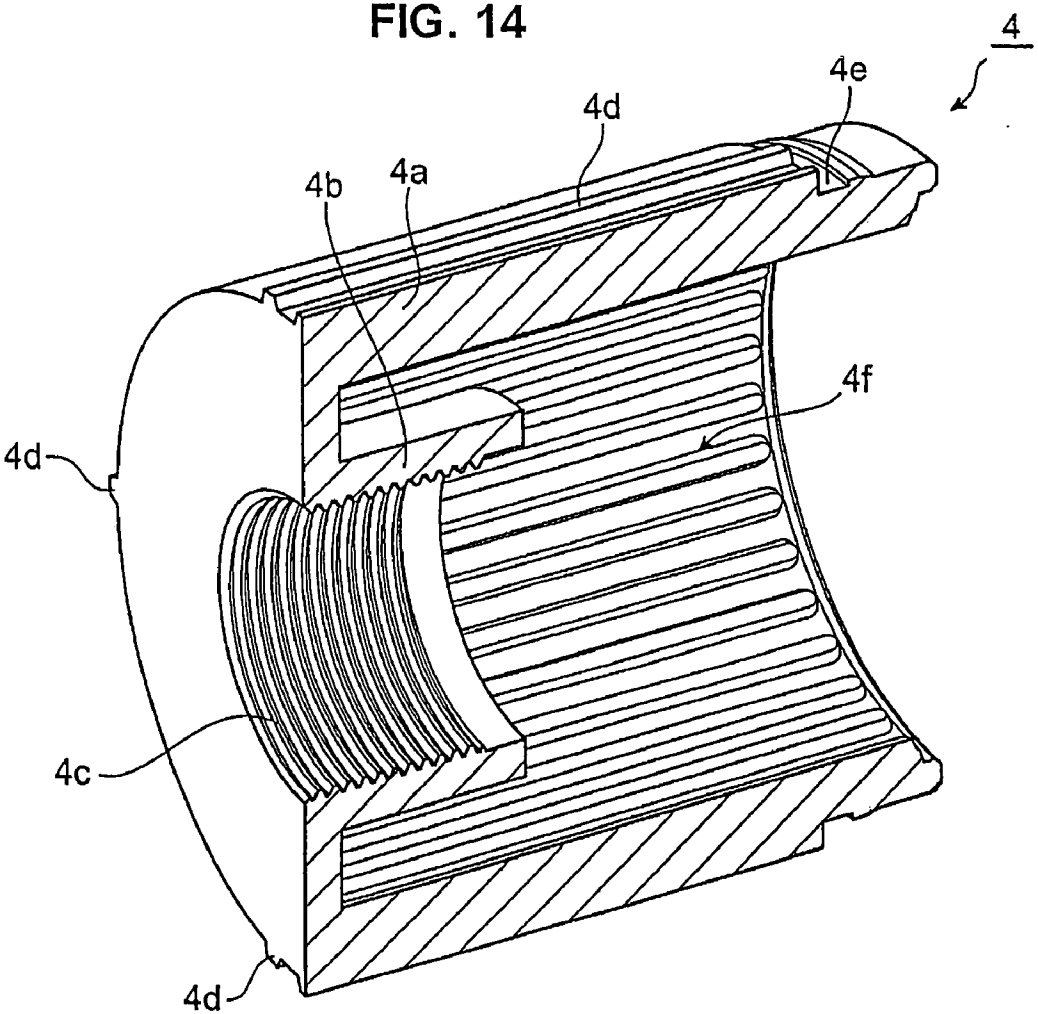
FIG. 14 is a longitudinal sectional perspective view of the thread tube shown in FIG. 13.

The thread tube 4 is formed in such a shape that an inside cylindrical tubular body 4*b* is connected to a leading end side of an outer cylindrical tubular body 4*a*, as shown in FIGS. 13 and 14, and is provided with a female thread 4*c* structuring one side of engagement mechanisms (engagement portions) in an inner peripheral surface of the inside tubular body 4*b*. A protrusion 4*d* for engaging with the knurling 2*a* of the main body tube 2 in the rotating direction is formed from a leading end to a rear end portion at a plurality of positions in the peripheral direction, on an outer peripheral surface of the outer tubular body 4*a* structuring the thread tube 4, and an annular groove portion 4*e* for engaging with the circular arc shaped protruding portion 2*d* of the main body tube 2 in the axial direction is formed at a position close to the rear end surface. Further, an inner peripheral surface of the outer tubular body 4*a* is provided with a knurling 4*f* in which a lot of concavities and convexities are provided in parallel and the concavities and convexities extend in an axial direction. The knurling 4*f* is provided for engaging a click spring member 12 constituting the click mechanism 11 in a rotating direction.

The thread tube 4 is inside inserted to the main body tube 2 from a rear end portion thereof as shown in FIGS. 1 and 2, the annular groove portion 4*e* is engaged with the circular arc shaped protruding portion 2*d* of the main body tube 2, and the protrusion 4*d* is engaged with the knurling 2*a* of the main body tub 2, thereby the thread tube 4 being attached to the main body tube 2 so as to be no-rotatable and immobile in the axial direction.

Figure 15:
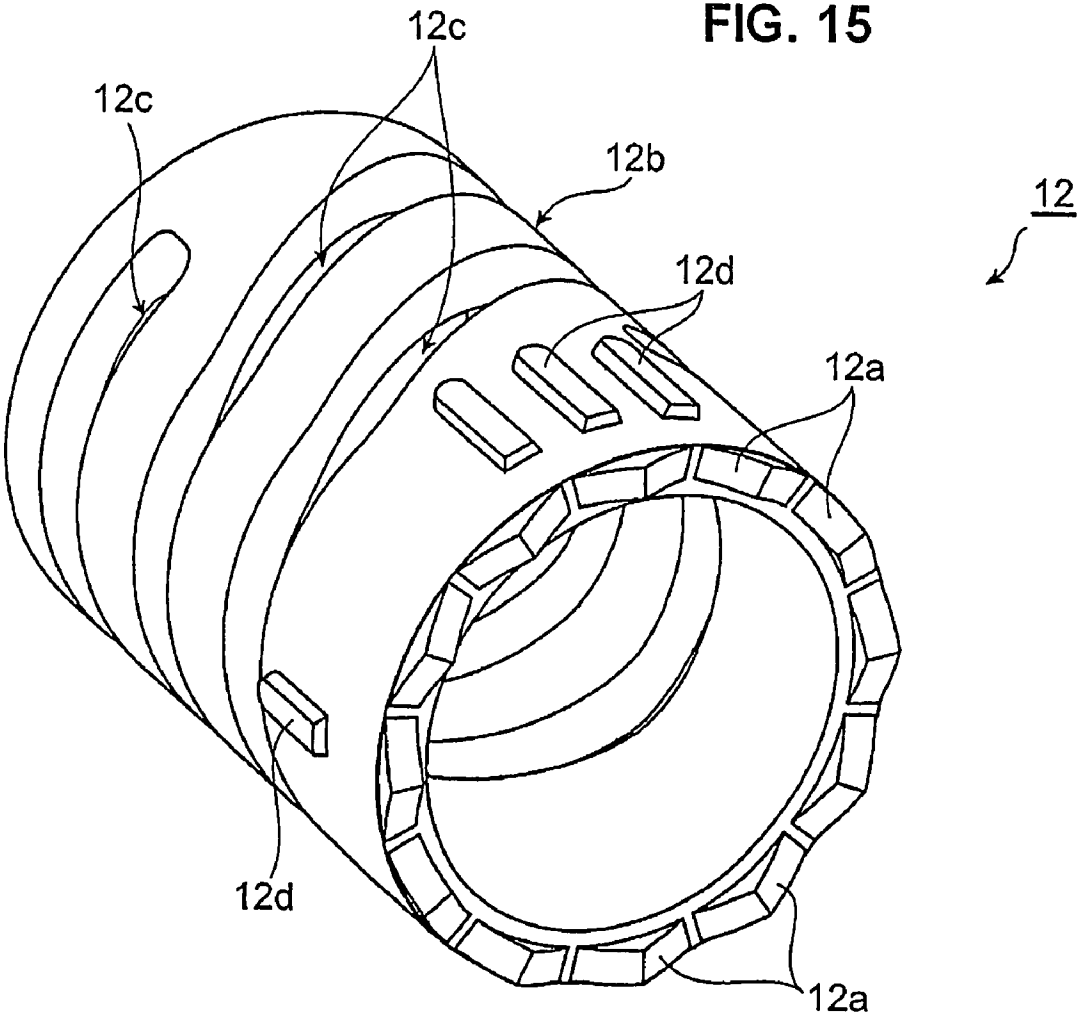
FIG. 15 is a perspective view of a click spring member in FIGS. 1 and 2 as seen from the rear.
Figure 16:
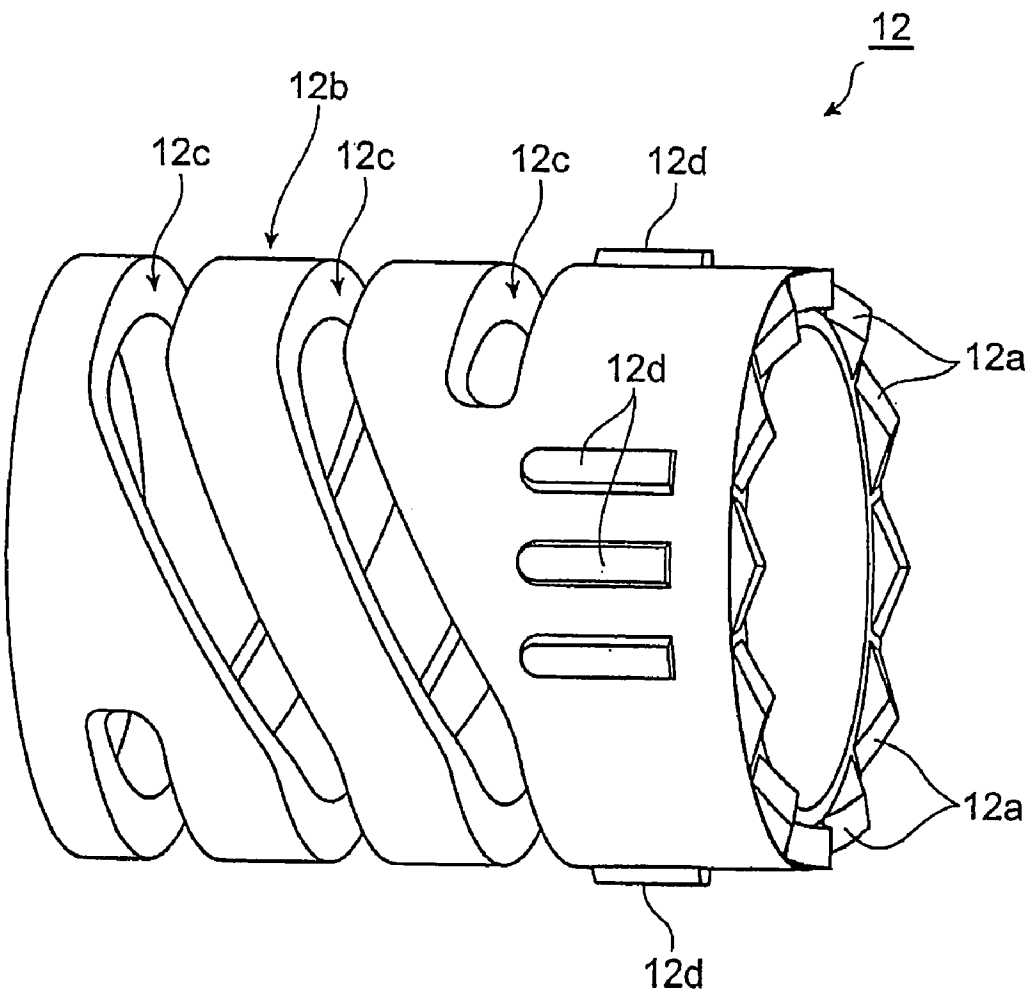
FIG. 16 is a perspective view of the click spring member shown in FIG. 15 as seen from the side.

The click spring member 12 constitutes a rotating amount regulating member, and is formed as an injection molded product by a resin. The click spring member 12 is structured approximately in a cylindrical shape as shown in FIGS. 15 and 16, and is integrally formed in a rear end surface thereof so as to have click teeth 12*a* in which concavo-convex portions engaging with the leading end portions 3*f* of the protrusions 3*e* of the operating tube 3 are provided along a peripheral direction, and have a compression spring portion 12*b* serving as an elastic portion connecting to a rear end portion having the click teeth 12*a*. The click tooth 12*a* is structured in a chevron shape having an ascending incline and a descending incline along the peripheral direction. Further, the compression spring portion 12*b* is provided with an approximately spiral slit 12*c* in a peripheral wall thereof, and energizes the pressed click teeth 12*a* against the pressing force by the slit 12*c*. Further, a plurality of protrusions 12*d* for engaging with the knurling 4*f* of the thread tube 4 in the rotating direction are provided in an outer peripheral surface of a rear end portion of the click spring member 12 along the peripheral direction.

In the click spring member 12, as shown in FIGS. 1 and 2, the leading end portion is received in the thread tube 4 so as to be positioned between the outer tubular body 4*a* and the inner tubular body 4*b* of the thread tube 4, and the protrusions 12*d* are engaged with the knurlings 4*f* of the thread tube 4, whereby the click spring member 12 is set non-rotatable with respect to the thread tube 4. In this state, the click spring member 12 is arranged so as to be pinched between a back face of the leading end portion connecting the outer and inner tubular bodies 4*a* and 4*b* of the thread tube 4 and the leading end portions 3*f* of the protrusions 3*e* of the operating tube 3. Further, the click teeth 12*a* of the click spring member 12 are energized to a rear side by the compression spring portion 12*b*, and is set in a click engagement state with respect to the leading end portions 3*f* of the protrusions 3*e* of the operating tube 3.

In this case, the shapes of the click tooth 12*a* of the click spring member 12 and the leading end portion 3*f* of the protrusion 3*e* of the operating tube 3 engaged by click therewith are not limited to those mentioned above, but may employ other shapes as far as the click engagement is achieved by the relative rotation in the forward and reverse directions.

Figure 9:
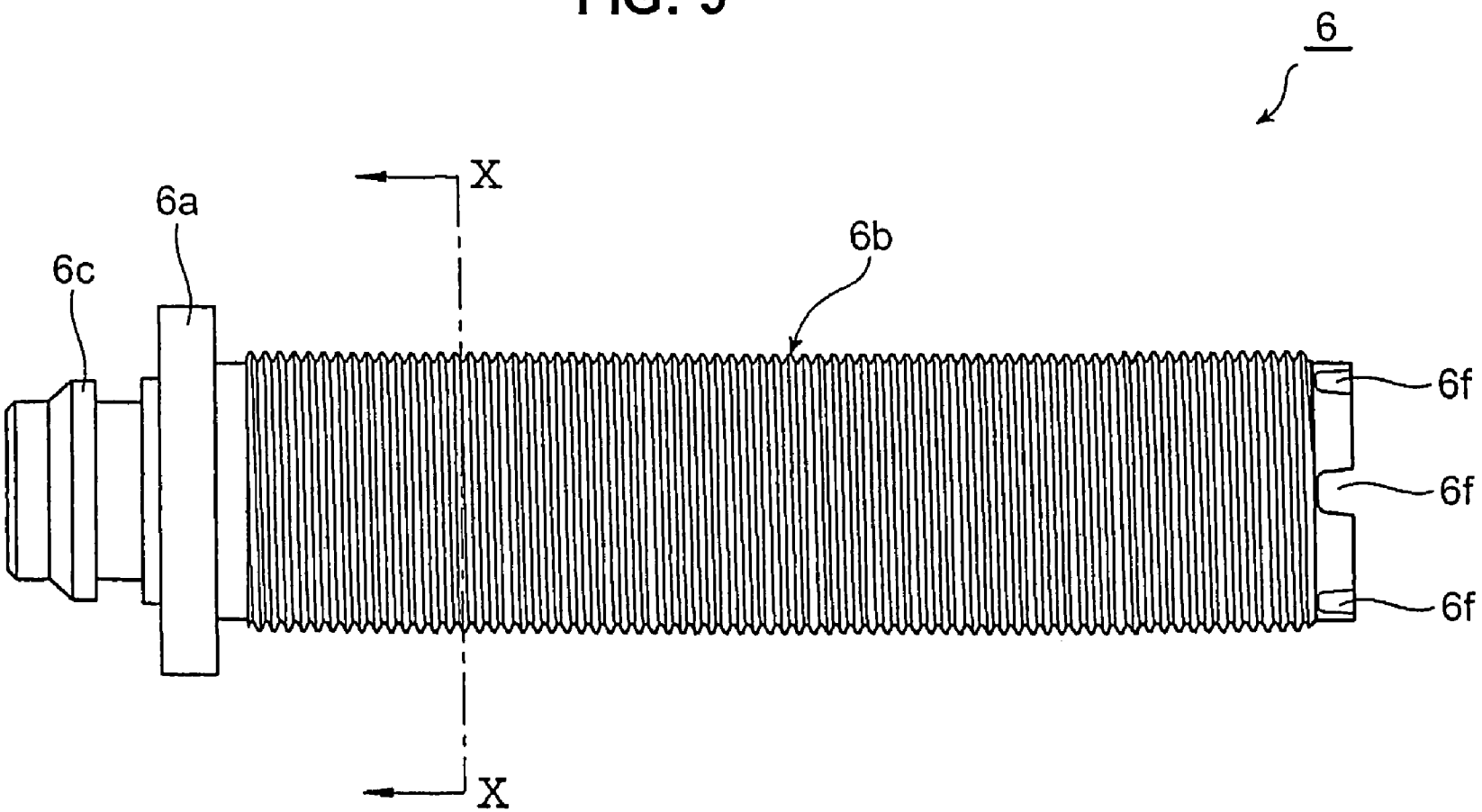
FIG. 9 is a side view showing the movable body in FIGS. 1 and 2.
Figure 10:
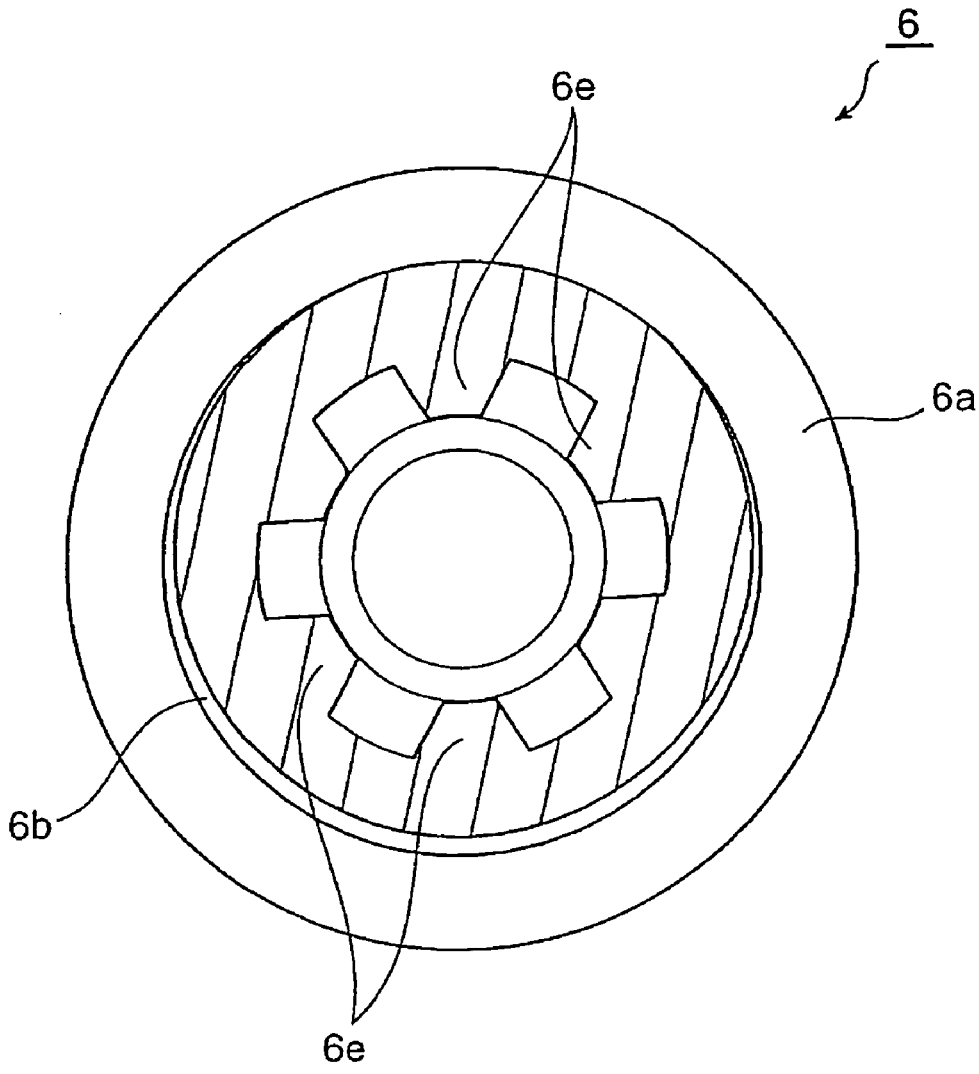
FIG. 10 is a view as seen in an arrow direction at a line X-X in FIG. 9.
Figure 11:
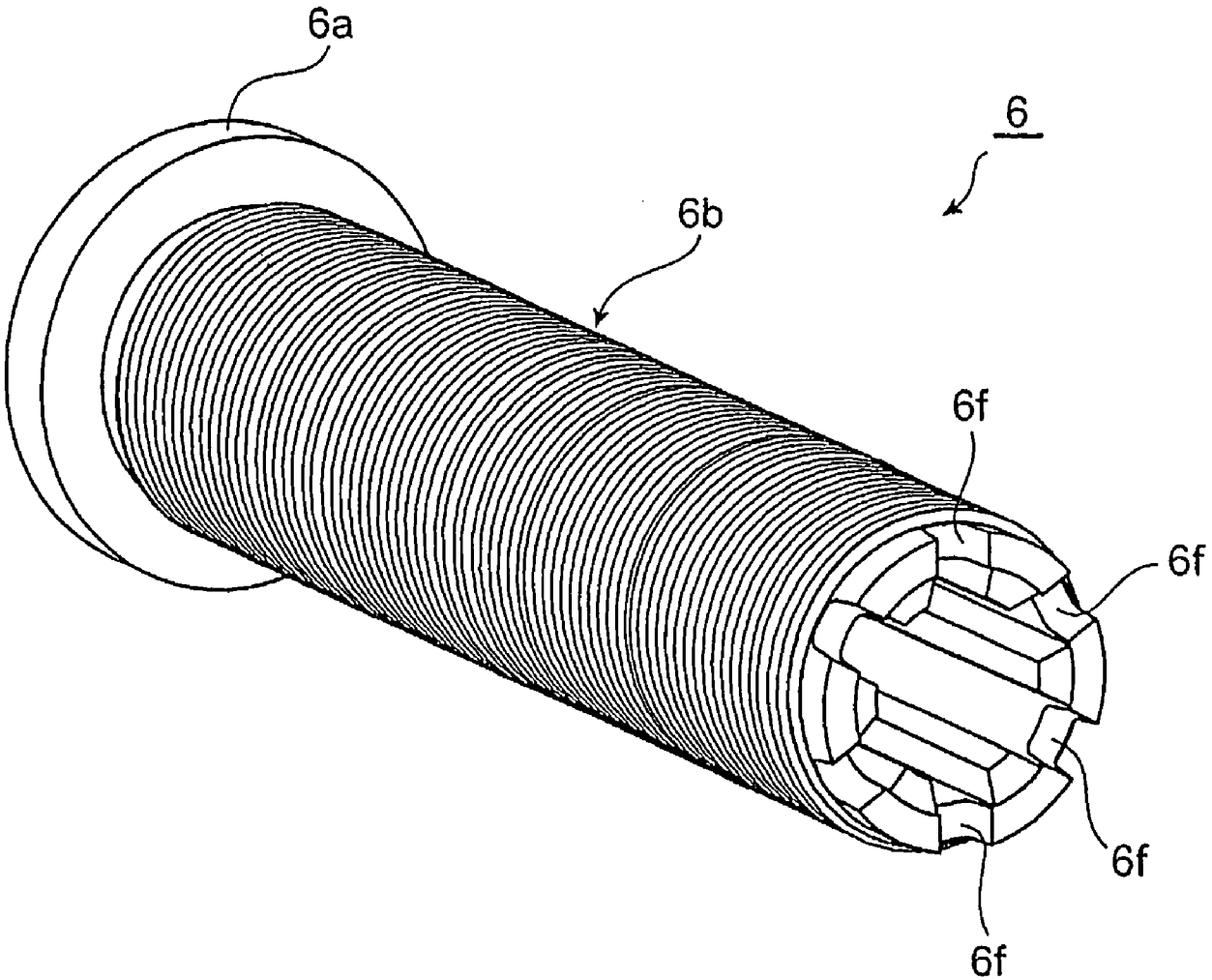
FIG. 11 is a perspective view of the movable body shown in FIG. 9
Figure 12:
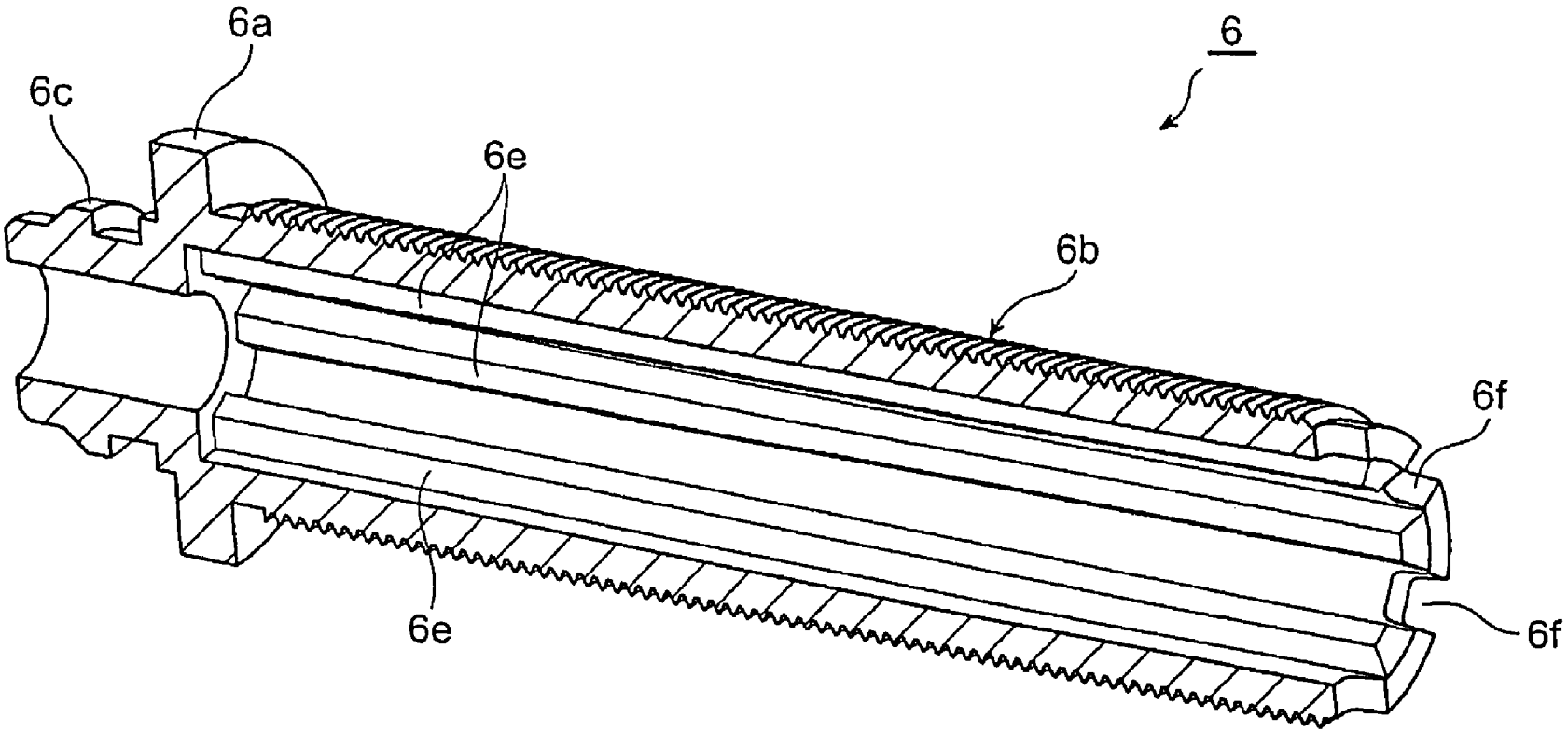
FIG. 12 is a longitudinal sectional perspective view of the movable body shown in FIG. 11.

The movable body 6 is structured in the cylindrical shape having a collar portion 6*a* in a leading end side, as shown in FIGS. 9 to 12, and is provided with a male thread 6*b* constituting the other side of the engagement mechanisms (the engagement portions) in an outer peripheral surface extending to a rear end portion from a rear side of the collar portion 6*a*. Further, an annular protruding portion 6*c* for engaging the elastic body 9 in an axial direction is formed in an outer peripheral surface of a front side of the collar portion 6*a* of the movable body 6, as shown in FIGS. 9 and 12. Further, as shown in FIG. 12, an inner peripheral surface reaching a rear end from the periphery of the collar portion 6*a* of the movable body 6 is provided with protrusions 6*e* arranged so as to protrude to an inner side in a radial direction and extending in the axial direction, at six equal positions along the peripheral direction, as shown in FIGS. 10 and 12, and the protrusions 6*e* are formed as the rotation prevention constituting the other side of the rotation preventing mechanism (the rotation preventing portion) of the movable body 6. Further, a rear end surface of the movable body 6 is provided with grooves 6*f* serving as a concave portion concaved short to the leading end side and communicating the inner and outer sides of the movable body 6, at six equal positions along the peripheral direction, as shown in FIGS. 11 and 12. The grooves 6*f* constitute the other side of the shaft body wrench-off preventing mechanisms, and move forward to the protruding portion 3*g* of the operating tube 3 and engages in the rotating direction at the maximum retreated time of the movable body 6.

The movable body 6 is outside inserted to the shaft body 3*c* of the operating tube 3 from the rear end portion thereof and is inside inserted to the tubular body 4*b* in the inner side of the thread tube 4, as shown in FIGS. 1 and 2. In a state in which the male thread 6*b* is engaged with the female thread 4*c* of the thread tube 4, the protrusion 6*e* is engaged with a portion between the protrusions 3*d* and 3*d* of the shaft body 3*c* and is attached to the operating tube 3 so as to be non-rotatable and movable in the axial direction.

The elastic body 9 is formed by a soft elastic material which tends to be elastically deformed, for example, a silicone rubber or the like. In addition to the silicone rubber, it is possible to select a thermosetting raw material in accordance with compression molding such as a nitrile rubber (NBR), an ethylene propylene rubber (EPR), a butyl rubber (IIR) and the like, and a thermoplastic raw material in accordance with an injection molding such as a polyurethane-based elastomer (TPU), a polyolefin-based elastomer (TPO), a polyester-based elastomer (TPEE) and the like.

The elastic body 9 is formed in a bell shape tapered toward a leading end, as shown in FIG. 1, is provided with a stepped concave portion 9*a* extending at a predetermined length toward a leading end side from the rear end surface, and has an annular groove portion 9*b* and an annular protruding portion 9*c* for engaging with the annular protruding portion 6*c* of the movable body 6 in the axial direction, in a rear portion side of the concave portion 9*a*. Further, the elastic body 9 is provided in an outer peripheral surface of a rear end portion with an annular protruding portion 9*g* closely attached to the inner peripheral surface of the filling member 1 for securing water tightness.

The elastic body 9 is outside inserted to the movable body 6 from a rear portion side thereof, the rear end surface is brought into contact with the leading end surface of the collar portion 6*a* of the movable body 6, and the annular groove portion 9*b* and the annular protruding portion 9*c* are engaged with the annular protruding portion 6*c* of the movable body 6, whereby the elastic body 9 is attached to the movable body 6 so as to be rotatable and immobile in the axial direction. In this state, a space 9*d* for promoting elastic deformation of the elastic body 9 is defined in a front half side within the elastic body 9, by the leading end portion of the movable body 6 moving forward into the concave portion 9*a*. Dimensions, an arrangement and the like of the elastic body 9 are set such that the elastic body 9 reaches the rear end portion of the applying body 10 in the leading end of the filling member 1 in the case that the movable body 6 moves forward to the maximum.

Figure 18:
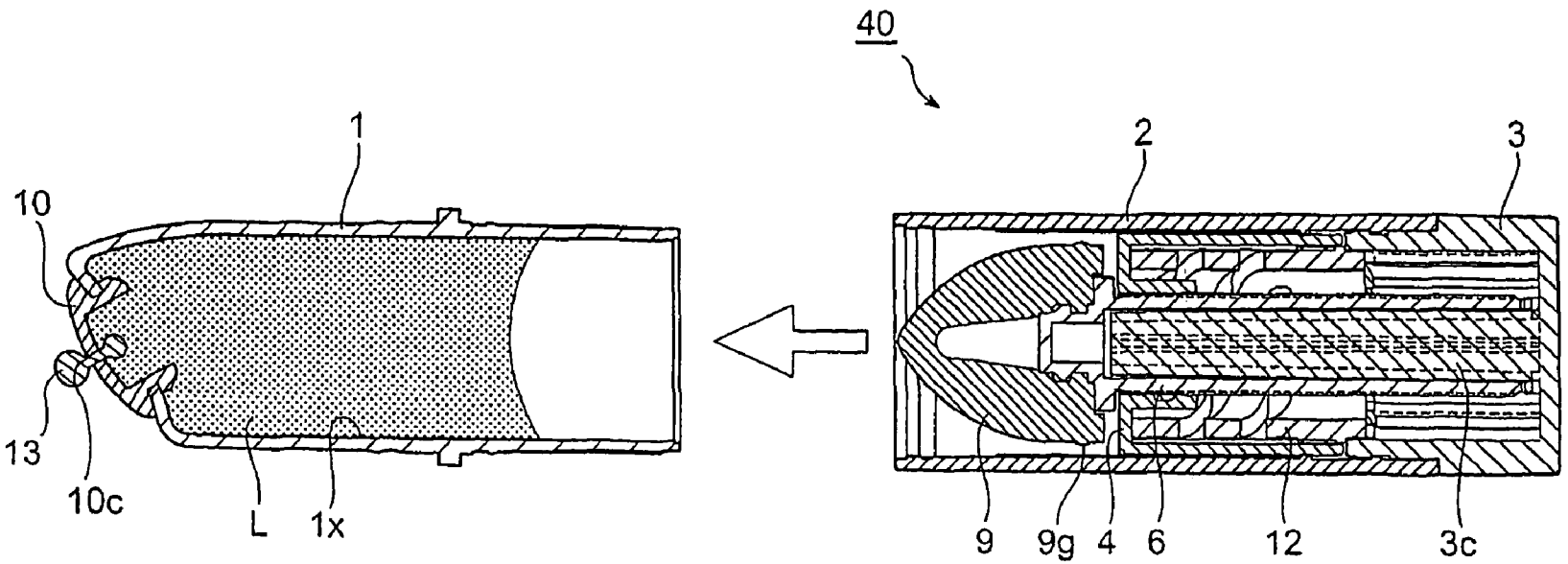
FIG. 18 is an exploded perspective view showing an assembling procedure of the applying filler extruding container shown in FIG. 1.

Further, the engagement mechanism is constituted by the male thread 6*b* of the movable body 6 and the female thread 4*c* of the thread tube 4, the rotation preventing mechanism is constituted by the protrusions 6*e* of the movable body 6 and the protrusions 3*d* of the shaft body 3*c*, the click mechanism 11 is constituted by the click teeth 12*a* and the compression spring portion 12*b* of the click spring member 12, and the leading end portions 3*f* of the protrusions 3*e* of the operating tube 3, and the extruding mechanism of the applying filler L constituted by them, the movable body 6 and the elastic body 9 are installed in the main body side tube body comprising the main body tube 2 and the operating tube 3, whereby the main body side assembly 40 is structured (refer to FIG. 18).

The filling member 1 is provided for filling the applying filler L in the inner filling region 1*x*, and is provided for discharging the applying filler L from the leading end portion in accordance with the operation by a user. It is preferable that the material of the filling member 1 is constituted by an injection molded plastic such as a polyethylene terephthalate (PET), a polypropylene (PP) or the like, and it is preferable that the material is constituted by a transparent material for checking out a color tone and a filling condition of the applying filler L.

Figure 17:
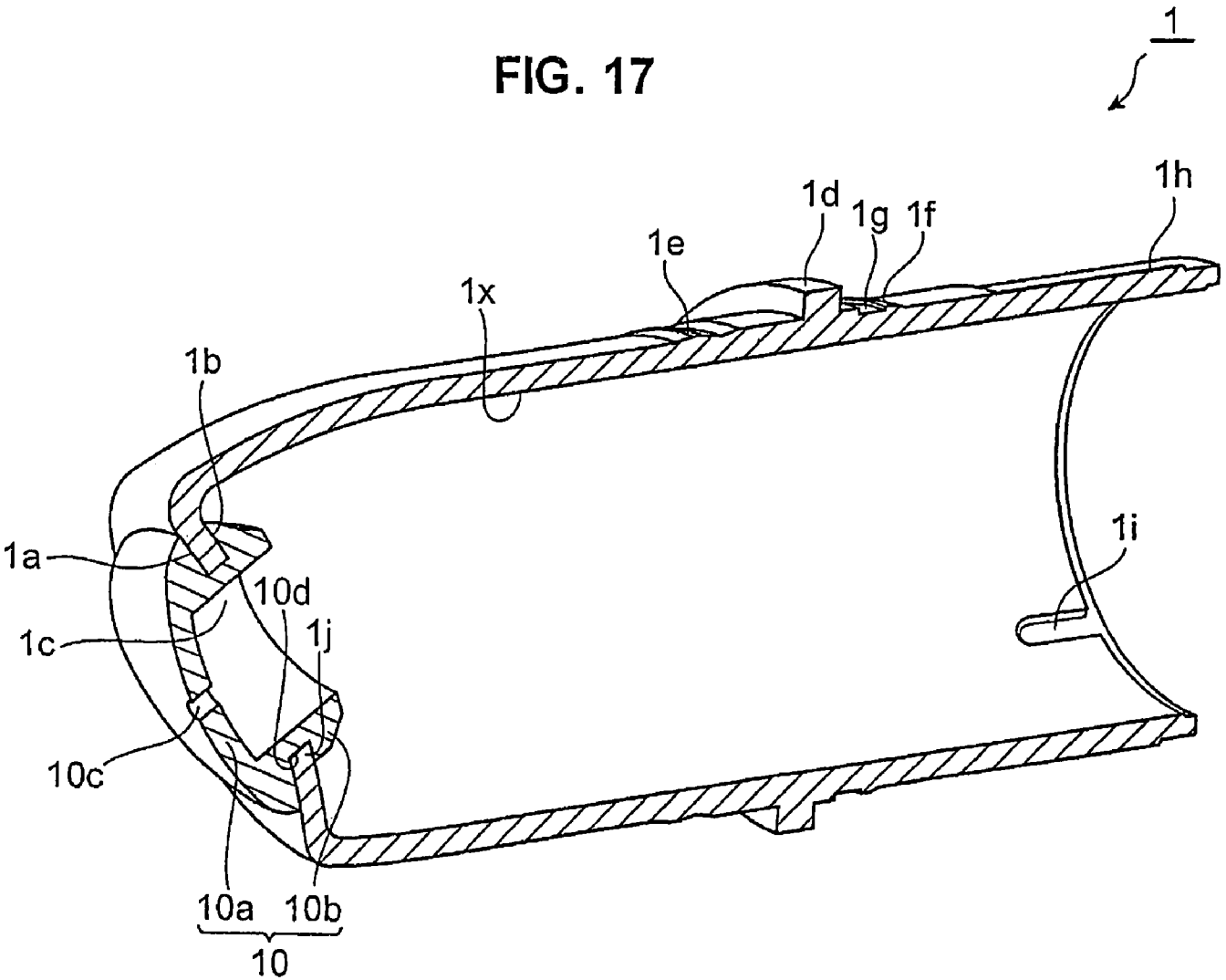
FIG. 17 is a longitudinal sectional perspective view showing a filling member in FIGS. 1 and 2.

The filling member 1 is formed in a cylindrical shape as shown in FIGS. 1, 2 and 17, and an outer surface 1*a* of the leading end portion is formed as an inclined surface inclined in a predetermined direction. Further, an inner surface 1*b* formed as an inclined surface is formed in the leading end portion of the filling member 1 at a distance of a fixed thickness with respect to the outer surface 1*a*, and an opening communicating the inner surface 1*b* with the outer surface 1*a* is provided.

Further, an outer peripheral surface of the filling member 1 is provided with a collar portion 1*d* in which an outer diameter is made large so as to be brought into contact with an open end in a leading end side of the main body tube 2, approximately in a center portion in the axial direction, and an annular protruding portion 1*e* for detachably locking a cap 7 (refer to FIG. 1) covering a front side of the collar portion 1*d* of the filling member 1 in the axial direction is provided at a front position close to the collar portion 1*d*. Further, the annular groove portion 1*g* and the annular protruding portion 1*f* for being engaged with the annular protruding portion 2*b* of the main body tube 2 in the axial direction are provided in parallel in the axial direction, at a rear position close to the collar portion 1*d*, on the outer peripheral surface of the filling member 1, and protrusions 1*h* extending in an axial direction are respectively formed at four equal positions in the peripheral direction, in the position of the rear end portion. The protrusion 1*h* is provided for being engaged with the knurling 2*a* of the main body tube 2 in the rotating direction. Further, as shown in FIG. 17, an air vent groove 1*i* open to a rear side and extending short toward the leading end side is provided in an inner peripheral surface of the rear end portion of the filling member 1.

The filling member 1 is inside inserted to the main body tube 2 from a rear portion side thereof, a rear end surface of the collar portion 1*d* is brought into contact with an open end in a leading end side of the main body tube 2 as shown in FIGS. 1 and 2, the annular groove portion 1*g* and the annular protruding portion 1*f* are engaged with the annular protruding portion 2*b* of the main body tube 2, and the protrusion 1*h* is engaged with the knurling 2*a* of the main body tube 2, whereby the filling member 1 is attached to the main body tube 2 so as to be non-rotatable and immobile in the axial direction, and is integrally formed with the main body tube 2. Further, the cap 7 is attachable to the filling member 1 as shown in FIG. 1.

The filling member 1 is provided with the applying body 10 for applying the applying filler L in the leading end portion, as shown in FIGS. 1, 2 and 17. The applying body 10 is constituted by an elastic body made of a rubber material, an elastomer material or the like, and is provided with a curved disc-shaped applying portion 10*a* curved in such a manner that a portion near a center portion protrudes, and an annular attaching portion 10*b* continuously provided so as to protrude to a back surface in a peripheral edge side of the applying portion 10*a*, as shown in FIG. 17.

The applying portion 10*a* is provided with a discharge port 10*c* communicating an inner surface with an outer surface and formed for discharging the applying filler L, and the attaching portion 10*b* is provided with an annular groove portion 10*d* concaved to an axial side in an outer peripheral surface at a root position close to the applying portion 10*a*, as a structure engaging with the peripheral edge portion 1*j* forming the opening of the filling member 1.

The applying body 10 is inside inserted to the opening of the filling member 1 in such a manner that the attaching portion 10*b* is deflected to an axial side, and is structured, as shown in FIGS. 1 and 2, such that a rear end portion of the attaching portion 10*b* moves forward into the filling member 1 and the annular groove portion 10*d* is engaged with the peripheral edge portion 1*j* forming the opening of the filling member 1, whereby the applying body 10 is attached to the filling member 1 so as not to be disengaged and is positioned in the opening 1*c*. The applying portion 10*a* of the applying body 10 is elastically deformed so as to be concaved to a rear side by being pressed to the applied portion, and is elastically restored to the original position by being moved apart from the applied portion.

In the case of assembling the applying filler extruding container 100 having the structure mentioned above, the main body side assembly 40 shown in FIG. 18 is obtained by mounting the click spring member 12 in the operating tube 3 so as to be received, screwing the thread tube 4 into the leading end portion of the movable body 6, attaching the elastic body 9 to the leading end of the movable body 6, coupling the movable body 6 having the elastic body 9 and the thread tube 4 to the shaft body 3*c* of the operating tube 3, and pressing and attaching the main body tube 2 to the assembly.

On the other hand, in the filling member 1, in a state in which the discharge port 10*c* of the applying body 10 is closed by a stop plug 13 so as to be reversed, a predetermined amount of applying filler L is filled in the filling region 1*x* so as to form no space within the leading end of the filling member 1. Further, the filling member 1 filled with the applying filler L is inserted to and attached to the leading end side of the main body side assembly 40. At this time, since an inner peripheral surface of the filling member 1 is set at an initial position while being in slidable contact with the annular protruding portion 9*g* for securing a water tightness of the elastic body 9, and the air vent groove 1*i* in the inner peripheral surface thereof is positioned so as to come across the annular protruding portion 9*g* in the axial direction, the air in the applying filler side is well vented to the rear side through the air vent groove 1*i*. Further, the stop plug 13 is detached finally. In this case, in place of the stop plug 13, a seal which can be detached after filling and just before the user uses and to which an adhesive agent is applied, may be attached to the discharge port 10*c* of the applying body 10 before the filling of the applying filler L.

In accordance with the applying filler extruding container 100 structured as mentioned above, since the filling member 1 filled with the applying filler L is structured such as to be inserted and attached to the leading end side of the main body side assembly 40, it is easy to assemble after filling the applying filler L in the filling member 1, and the applying filler L is in a state of being sufficiently (fully) filled in the filling region 1*x* between an inner side of the discharge port 10*c* of the applying body 10 constituting the leading end portion of the filling member 1 and the elastic body 9 attached to the leading end of the movable body 6 of the main body side assembly 40.

Next, a description will be given of a use of the applying filler extruding container 100 structured in the manner mentioned above. In the applying filler extruding container 100, if the main body tube 2 or the filling member 1 and the operating tube 3 are relatively rotated by a user, the movable body 6 moves forward and backward by the engaging mechanism and the rotation preventing mechanism mentioned above, and the leading end portion 3*f* of the protrusion 3*e* in the operating tube 3 constituting the click mechanism 11 mentioned above and the click tooth 12*a* of the click spring member 12 energized to the leading end portion 3*f* repeat the click engagement in accordance with the relative rotation at this time. Accordingly, the click feeling is given to the user, and a forward moving degree and a returning degree of the movable body 6 are detected on the basis of the click feeling.

Figure 19A:
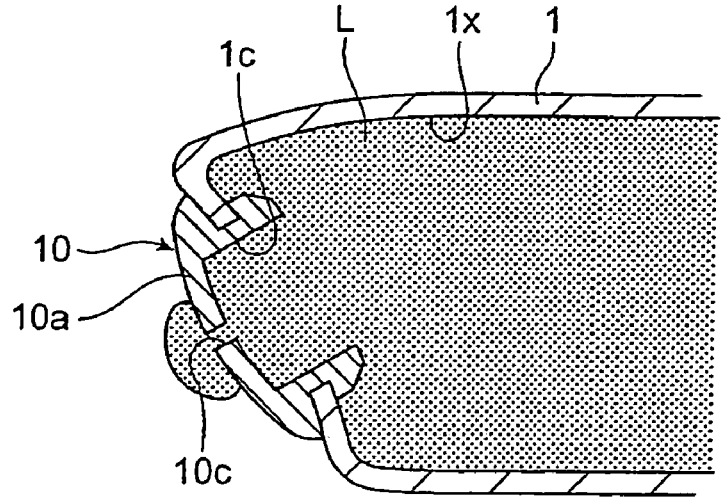
FIGS. 19(*a*), 19(*b*) and 19(*c*) are explanatory views showing a change of state of an applying body and the applying filler on the basis of use of the applying filler extruding container shown in FIGS. 1 and 2.
Figure 19B:
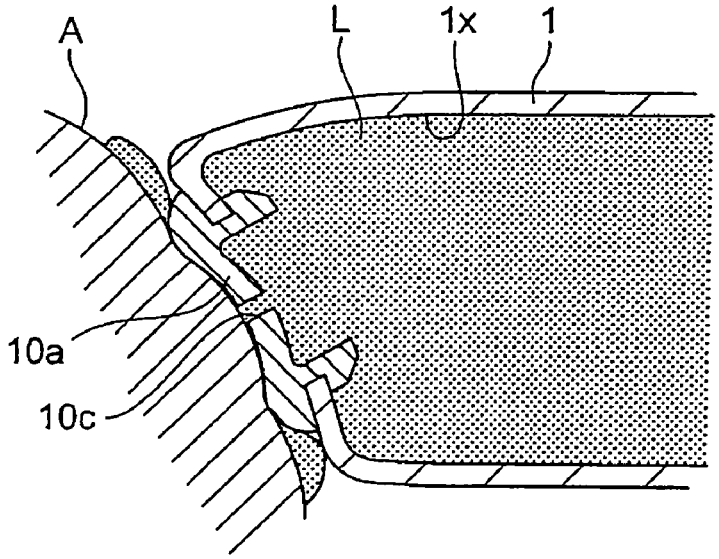
Figure 19C:
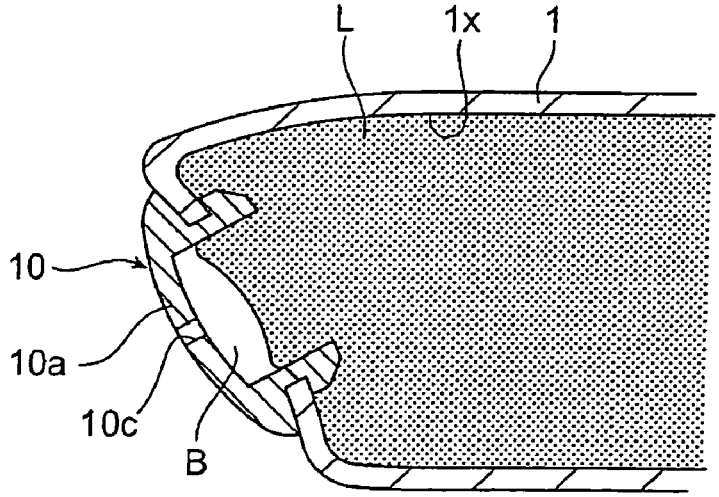
Figure 20:
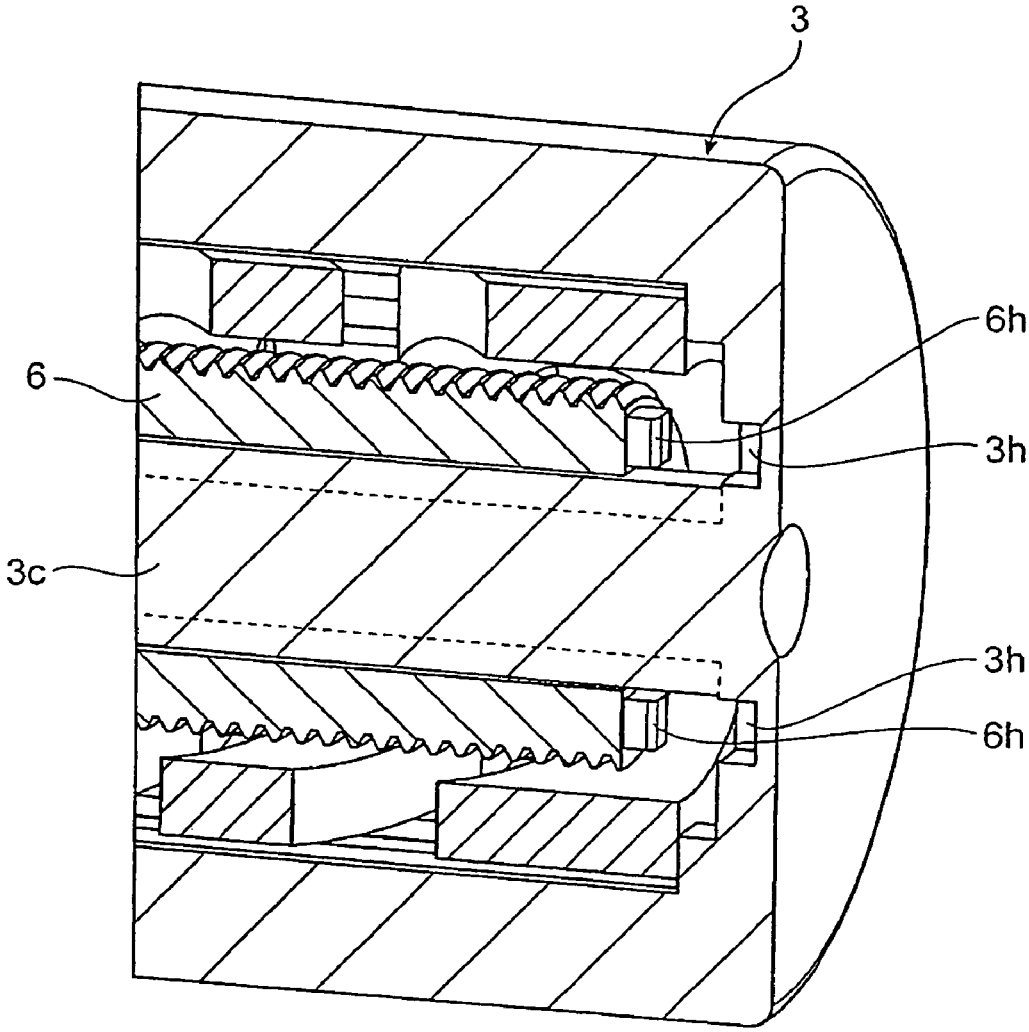
FIG. 20 is a longitudinal sectional perspective view of a rear end portion of the applying filler extruding container, to show another example of a shaft body wrench-off preventing mechanism in FIGS. 1 and 2.

Further, if the user relatively rotates the main body tube 2 or the filling member 1 and the operating tube 3 so as to move the movable body 6 forward while accompanying with the click feeling, at the first applying time after buying the applying filler extruding container 100, the applying filler L is rapidly (immediately) discharged from the discharge port 10*c* of the applying body 10 as shown in FIG. 19(*b*) without repeating the relative rotation more than necessary, because the applying filler L is sufficiently filled in the filling region 1*x* between the inner side of the discharge port 10*c* of the applying body 10 constituting the leading end portion of the filling member 1 and the elastic body 9 of the movable body 6 of the main body side assembly 40, as mentioned above. Accordingly, there is provided the applying filler extruding container 100 in which customer satisfaction is improved.

The user presses the applying portion 10*a* of the applying body 10 to the applied portion A so as to apply the applying filler L to the applied portion A in this state, as shown in FIG. 19(*b*). At this time, the applying portion 10*a* of the applying body 10 is elastically deformed so as to be concaved (collapsed) to the rear side on the basis of the pressing to the applied portion A. Since the applying portion 10*a* of the applying body 10 is elastically deformed as mentioned above, a feeling given to the applied portion A such as a skin or the like is soft and good. Further, since the applying portion 10*a* of the applying body 10 is pressed and collapsed, an internal pressure is increased, the applying filler L is discharged at a proper amount, and a use amount is secured.

Further, if the application is finished, and the applying body 10 is moved apart from the applied body A, the applying portion 10*a* of the applying body 10 is elastically restored to the original position (refer to FIG. 19(*a*)) as shown in FIG. 19(*c*). At this time, a predetermined space B is formed in an inner side including the discharge port 10*c* of the applying portion 10*a* in the applying body 10.

Accordingly, even if the applying filler L filled in the filling region 1*x* of the filling member 1 and the air mixing into the applying filler L is expanded due to variation of temperature or variation of atmospheric pressure at a time of not being used such as a carrying time or the like, the applying filler L is prevented from leaking from the applying body 10 on the basis of the predetermined space B. Accordingly, it is possible to provide the applying filler extruding container 100 having an improved quality.

Further, in accordance with the applying filler extruding container 100 on the basis of the present embodiment, as shown in FIG. 2, if the movable body 6 reaches the front to the maximum on the basis of the relative rotation between the main body tube 2 or the filling member 1 and the operating tube 3 by the user, the elastic body 9 is brought into contact with the rear end portion of the attaching portion 10*b* of the applying portion 10 attached to the leading end portion of the filling member 1, and is elastically deformed on the lines of the rear end portion inclined in the circular ring shape. At this time, the elastic body 9 is elastically deformed more preferably on the basis of the space 9*d* within the elastic body 9. Further, the applying filler L leaving in an approximately hoof-shaped (oblique circular cylindrical) space (a space including an inclined surface within the container leading end), which cannot be pressed out by the conventional movable body, is sufficiently pressed out with almost no remainder so as to be consumed, on the basis of the elastic deformation of the elastic body 9 mentioned above. Accordingly, there is provided an economic applying filler extruding container 100 in which a waste is reduced.

Further, in accordance with the applying filler extruding container 100, since the structure is made such that the annular groove portion 1*g* corresponding to the locking portion of the outer peripheral surface of the filling member 1 and the annular protruding portion 2*b* corresponding to the locking portion between the annular protruding portion if and the inner peripheral surface of the main body tube 2, and the protrusion 1*h* corresponding to the locking portion of the outer peripheral surface of the filling member 1 and the knurling 2*a* corresponding to the locking portion of the inner peripheral surface of the main body tube 2 are directly locked via no other member, it is possible to make the applying filler extruding container 100 thin. Accordingly, there is provided the applying filler extruding container 100 in which an appearance and a use feeling are improved.

Further, in accordance with the applying filler extruding container 100, the forward moving degree and the returning degree are detected by a user on the basis of the click feeling given to the user by the click mechanism 11. Accordingly, there is provided the applying filler extruding container 100 having an improved usability.

In this case, in the present embodiment, the movable body 6 can move backward. Accordingly, if the relative rotating force intending to move the movable body 6 existing at the maximum retreated position further backward by the user, there is a risk that the shaft body 3*c* engaging with the movable body 6 is wrenched off in the bottom surface of the operating tube 3. However, in the present embodiment, since a plurality of protruding portions 3*g* in the bottom surface of the operating tube 3 and a plurality of grooves 6*f* in the rear end surface of the movable body 6 are engaged in the rotating direction at the maximum backward moving time of the movable body 6, the rotating force intending to move the movable body 6 further backward and applied to the shaft body 3*c* is also applied to the protruding portion 3*g* of the operating tube 3 via the groove 6*f* of the movable body 6 so as to be dispersed, thereby preventing the shaft body 3 from being wrenched off. Accordingly, there is provided the applying filler extruding container 100 in which a quality is further improved.

In this case, the structure may be made such that concave portions are provided in place of the grooves 6*f* of the movable body 6 for preventing the shaft body 3*c* from being wrenched off, and the concave portions are engaged with the protruding portions 3*g* of the operating tube 3 in the rotating direction.

Further, as the other example of the shaft body wrench-off preventing mechanism, on the contrary of the shaft body wrench-off preventing mechanism mentioned above, as shown in FIG. 20, the structure may be made such that the convex portions 6*h* protruding to the rear side are provided at a plurality of positions along the peripheral direction in the rear end surface of the movable body 6, and a plurality of concave portions 3*h* which the convex portions 6*h* of the movable body 6 move forward into at the maximum retreated time of the movable body 6 and engage with in the rotating direction are provided in the peripheral edge of the shaft body 3*c* in the bottom surface of the operating tube 3.

Figure 21:
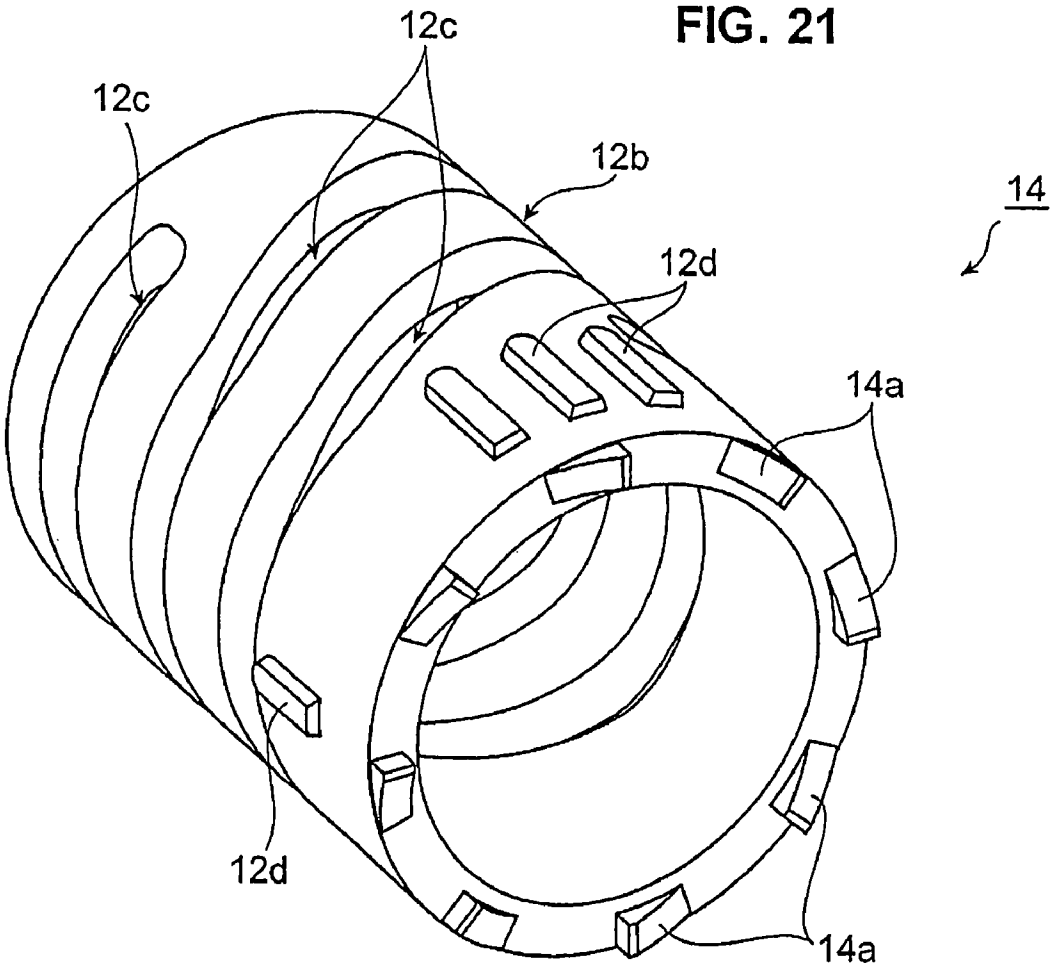
FIG. 21 is a perspective view showing a ratchet spring member used in place of the click spring member shown in FIGS. 15 and 16 from the rear.
Figure 22:
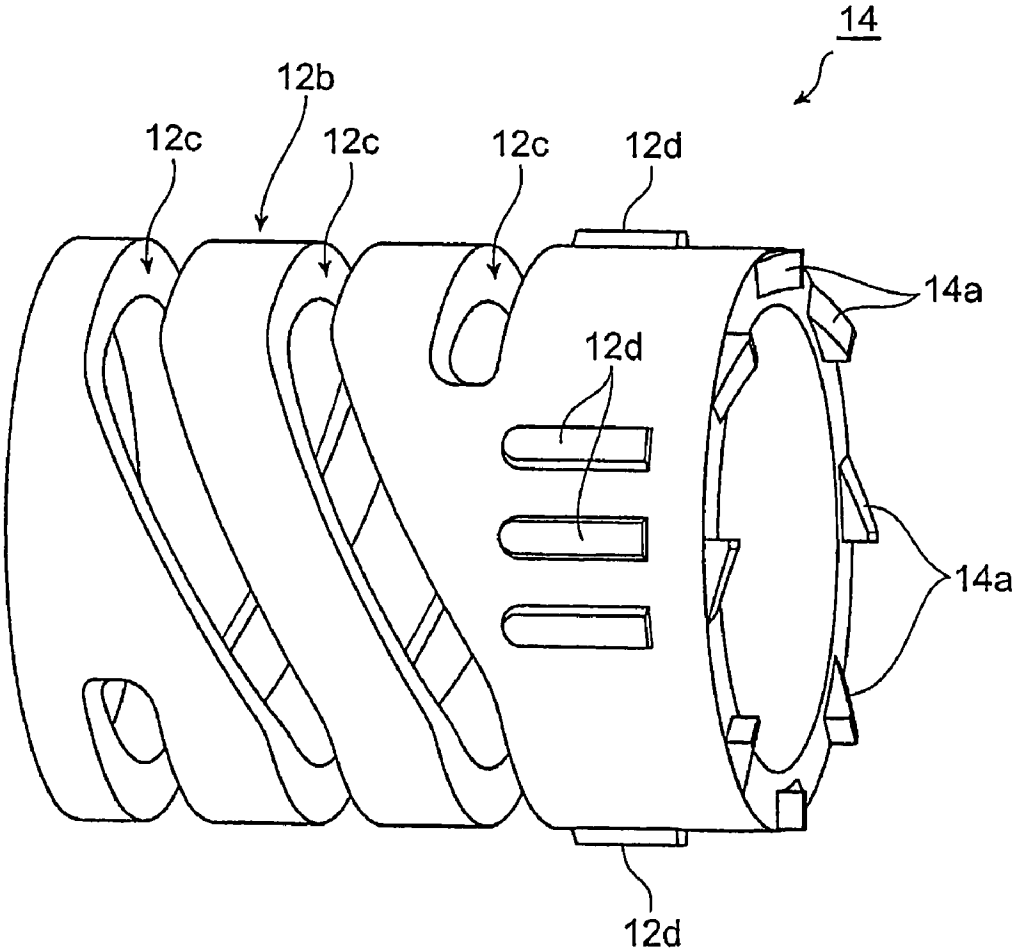
FIG. 22 is a perspective view showing the ratchet spring member shown in FIG. 21 from the side.

Further, a ratchet spring member 14 shown in FIGS. 21 and 22 may be employed in place of the click spring member 12 shown in FIGS. 15 and 16. The ratchet spring member 14 is different from the click spring member 12 in a point that the chevron-shaped click tooth 12*a* is replaced by a so-called ratchet gear 14*a* having a vertical surface and an inclined surface along a peripheral direction and engaging with the leading end portion 3*f* (refer to FIGS. 6 to 8) of the protrusion 3*e* of the operating tube 3 so as to allow the rotation only in one direction (the rotation in which the movable body 6 moves forward). Further, the ratchet mechanism is structured by the leading end portion 3*f* of the protrusion 3*e* of the operating tube 3, and the ratchet gear 14*a* and the compression spring portion 12*b* energizing the ratchet gear 14*a* to the leading end portion 3*f* side.

In accordance with the applying filler extruding container having the ratchet mechanism mentioned above, only the relative rotation in one direction is allowed between the main body tube 2 or the filling member 1 and the operating tube 3, the movable body 6 performs only the forward movement while a resistance feeling at a time when the ratchet gears are engaged on the basis of the relative rotation is given to a user, and the applying filler L is discharged so as to be supplied for application. In this case, the other operations and effects are the same as those of the applying filler extruding container 100 mentioned above. In this connection, since the movable body 6 does not move backward in the case of using the ratchet spring member 14, the concave portion 6*f* of the movable body 6 and the convex portion 3*g* of the operating tube 3, or the convex portion 6*h* of the movable body 6 and the concave portion 3*h* of the operating tube 3 may be omitted.

Figure 23:
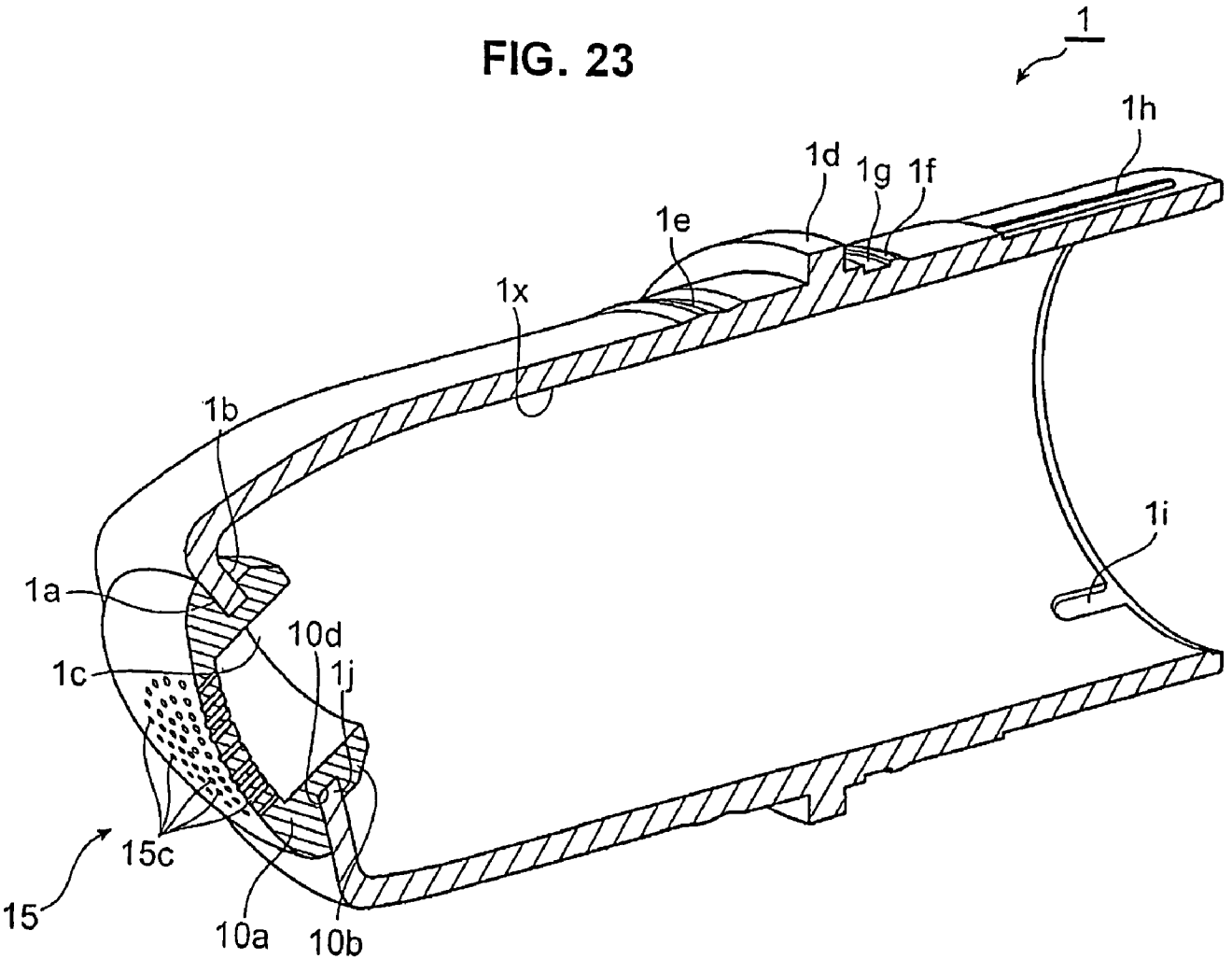
FIG. 23 is a perspective view showing another example of the applying body in FIG. 17.

Further, in place of the applying body 10 shown in FIG. 17, an applying body 15 having a plurality of discharge ports 15*c* for discharging the applying filler L may be used as shown in FIG. 23.

Figure 24A:
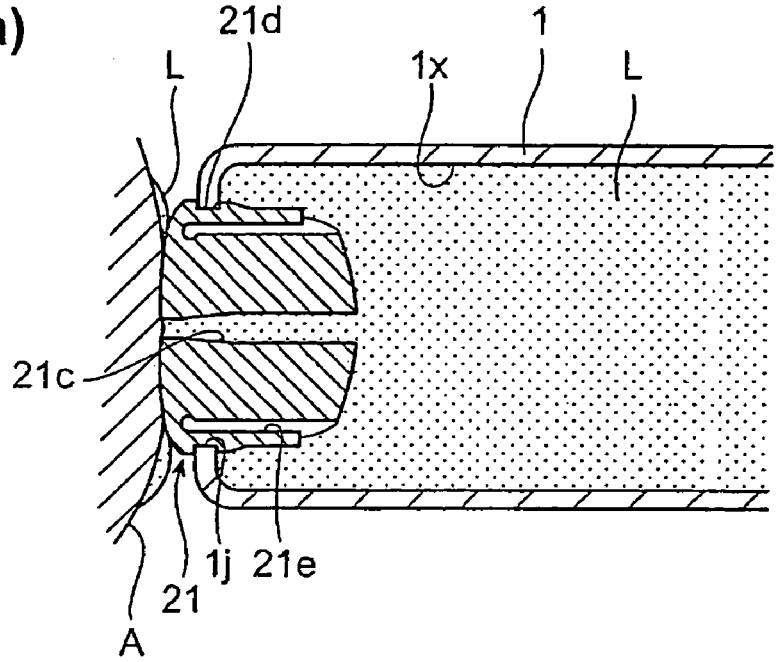
FIGS. 24(*a*) and 24(*b*) are views showing further another example of the applying body in FIG. 17, with an explanation to show a change of state of the applying body and the applying filler on the basis of use.
Figure 24B:
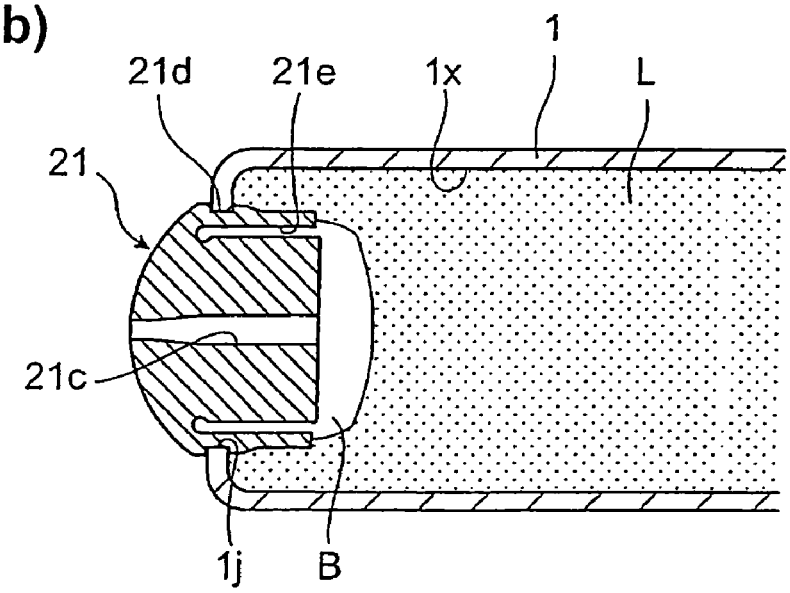

Further, an applying body 21 shown in FIGS. 24(*a*) and 24(*b*) may be used in place of the applying body 10 shown in FIG. 17. The applying body 21 is formed in an approximately columnar shape, as shown in FIG. 24(*b*), and is structured such that a portion near a center portion of the leading end surface is curved so as to protrude. Further, a discharge port 21*c* for discharging the applying filler L is provided in the center thereof so as to pass through in an axial direction. Further, an annular groove portion 21*e* concaved at a predetermined length from a rear end surface to a leading end side is provided in a peripheral edge portion of a rear end surface of the applying body 21. The annular groove portion 21*e* is provided so as to deflect an outer portion from the annular groove portion 21*e* to an axial side so as to easily pressure insert, at a time of pressure inserting the applying body 21 to the opening of the filling member 1. Further, the annular groove portion 21*d* concaved to the axial side is provided as a structure engaging with the peripheral edge portion 1*j* forming the opening of the filling member 1, in an outer peripheral surface of the applying body 21.

Further, the applying body 21 is pressure inserted to the opening of the filling member 1, and the annular groove portion 21*d* thereof is engaged with the peripheral edge portion 1*j* forming the opening of the filling member 1, thereby being attached to the filling member 1 so as not to be disconnected, and being structured such as to be positioned in the opening of the filling member 1.

The applying body 21 is elastically deformed in such a manner as to be concaved to a rear side by being pressed to the applied portion A at a time of application, as shown in FIG. 24(*a*), and is elastically restored to the original position at a time of being apart from the applied portion A. As shown in FIG. 24(*b*), a predetermined space B is formed in an inner side (a rear side) of the applying body 21 after application. Accordingly, it is possible to obtain the same effect as that of the applying filler extruding container 100 as mentioned above. In this case, in the embodiment shown in FIGS. 24(*a*) and 24(*b*), the leading end surface having the opening of the filling member 1 is formed as a surface which is vertical to the axial direction.

Figure 25:
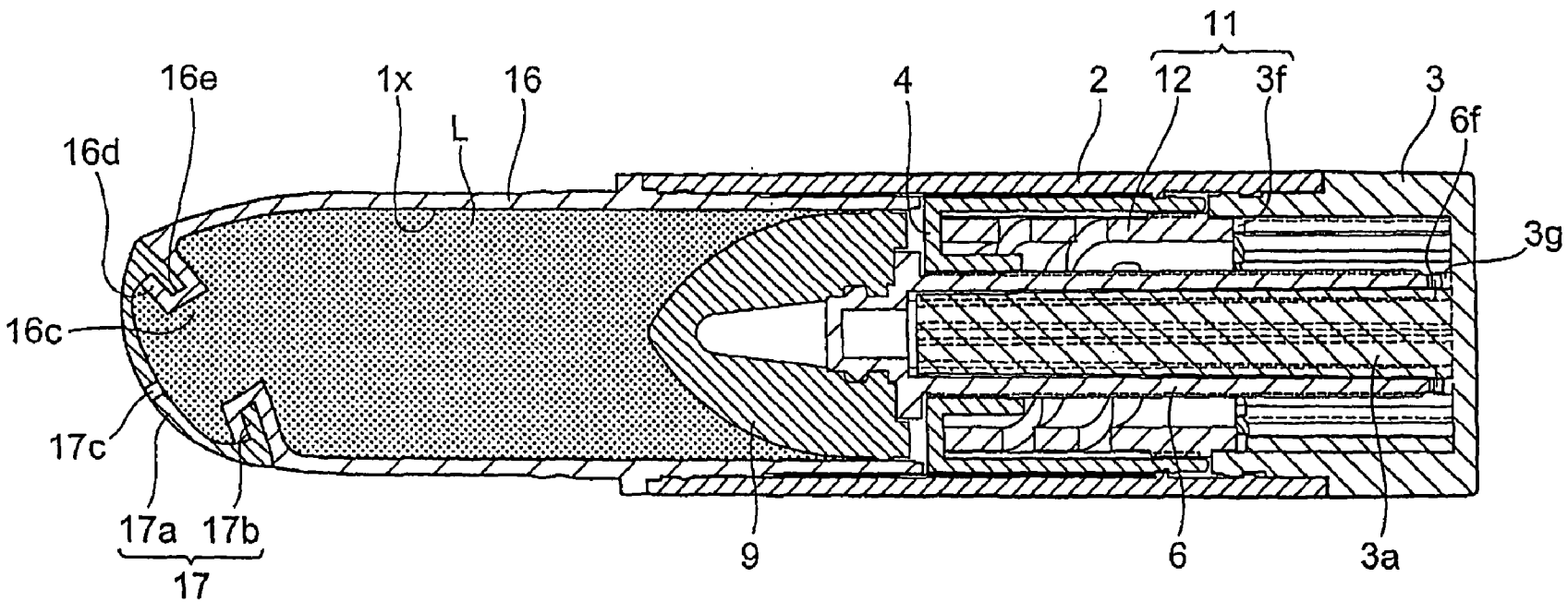
FIG. 25 is a longitudinal sectional view of the applying filler extruding container showing further another example of the filling member and the applying body shown in FIG. 17.

Further, a filling member 16 and an applying body 17 shown in FIG. 25 may be used. The filling member 16 is different from the filling member 1 in a point that the peripheral edge portion forming an opening 16*c* for discharging the applying filler L is structured such as to have an annular fold-back portion 16*d* folded back to an outer side, and a bag-shaped annular groove portion 16*e* for engaging the applying body 17 is formed by the annular fold-back portion 16*d*. Further, the applying body 17 is different from the applying body 10 in a point that an annular attaching portion 17*b* protruding to an axial side and a rear side is provided in a peripheral edge portion of a curved disc-shaped applying portion 17*a* having a discharge port 17*c* and curved to an outer side.

As a method of firmly fixing the filling member and the applying body, it is possible to employ a method of forming different materials by using a two-color injection molding machine and pouring two kinds of materials into a core back type metal mold or a core rotation type metal mold, and an insert injection molding method of forming first a first material, and then injection molding a second material by inserting the first formed material to a metal mold. It is preferable to use a thermoplastic hard raw material by setting the first material as the filling member, and use a thermosetting rubber or a thermoplastic elastomer soft raw material by setting the second material as the applying body.

Further, the applying body 17 is structured such that an attaching portion 17*b* moves forward to the annular groove portion 16*e* of the filling member 16 so as to be engaged, thereby being attached to the filling member 16 so as not to be disconnected, and an applying portion 17*a* covers the opening 16*c* of the filling member 16. Even in the case that the filling member 16 and the applying body 17 are employed, the same operations and effects as those of the applying filler extruding container 100 mentioned above can be achieved.

Figure 26:
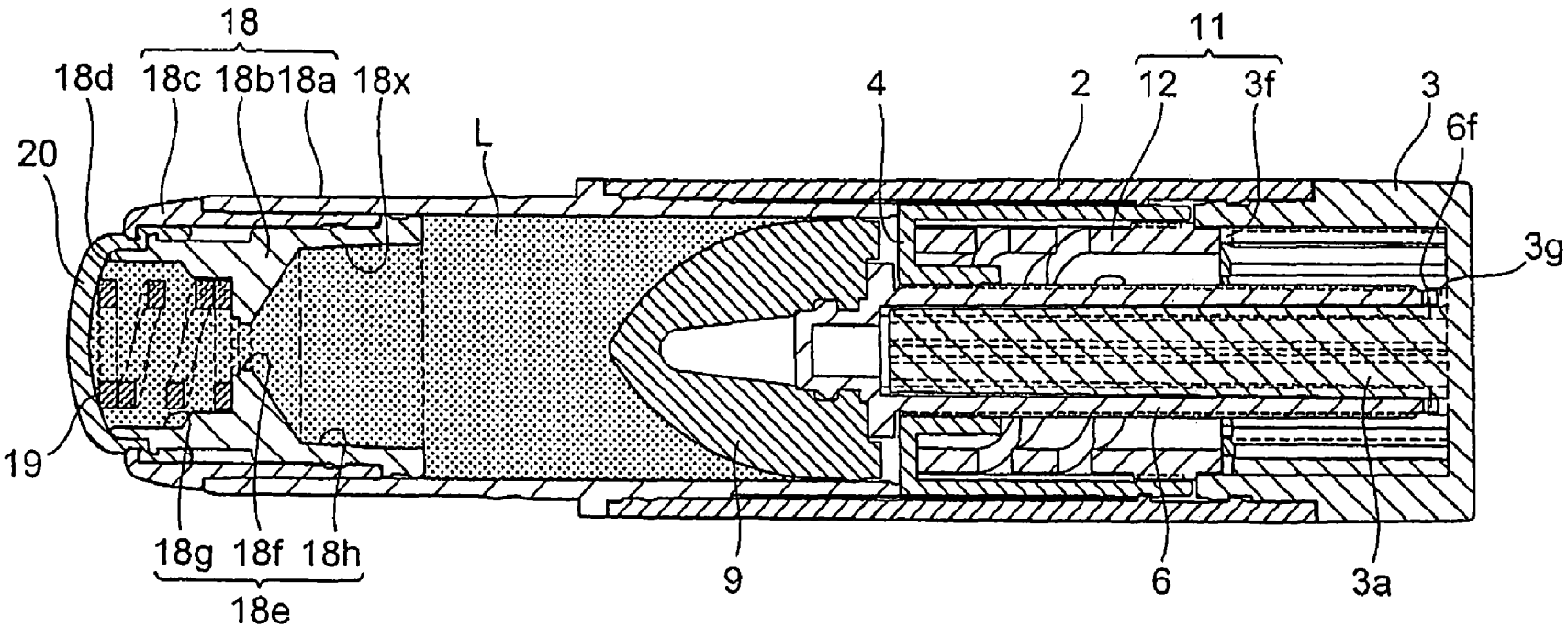
FIG. 26 is a longitudinal sectional view of the applying filler extruding container showing further another example of the filling member and the applying body shown in FIG. 17.
Figure 27:
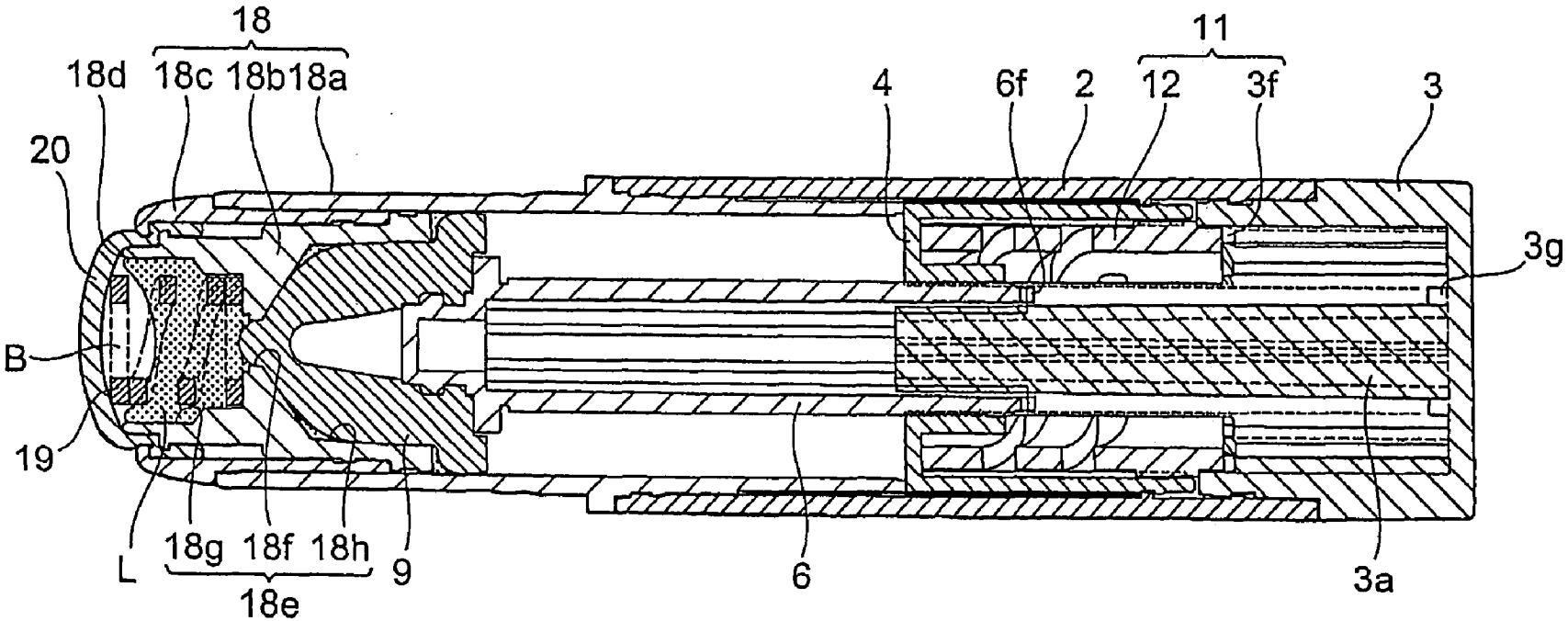
FIG. 27 is a view showing a state that the movable body of the applying filler extruding container shown in FIG. 26 is at a maximum forward moving time.
Figure 28:
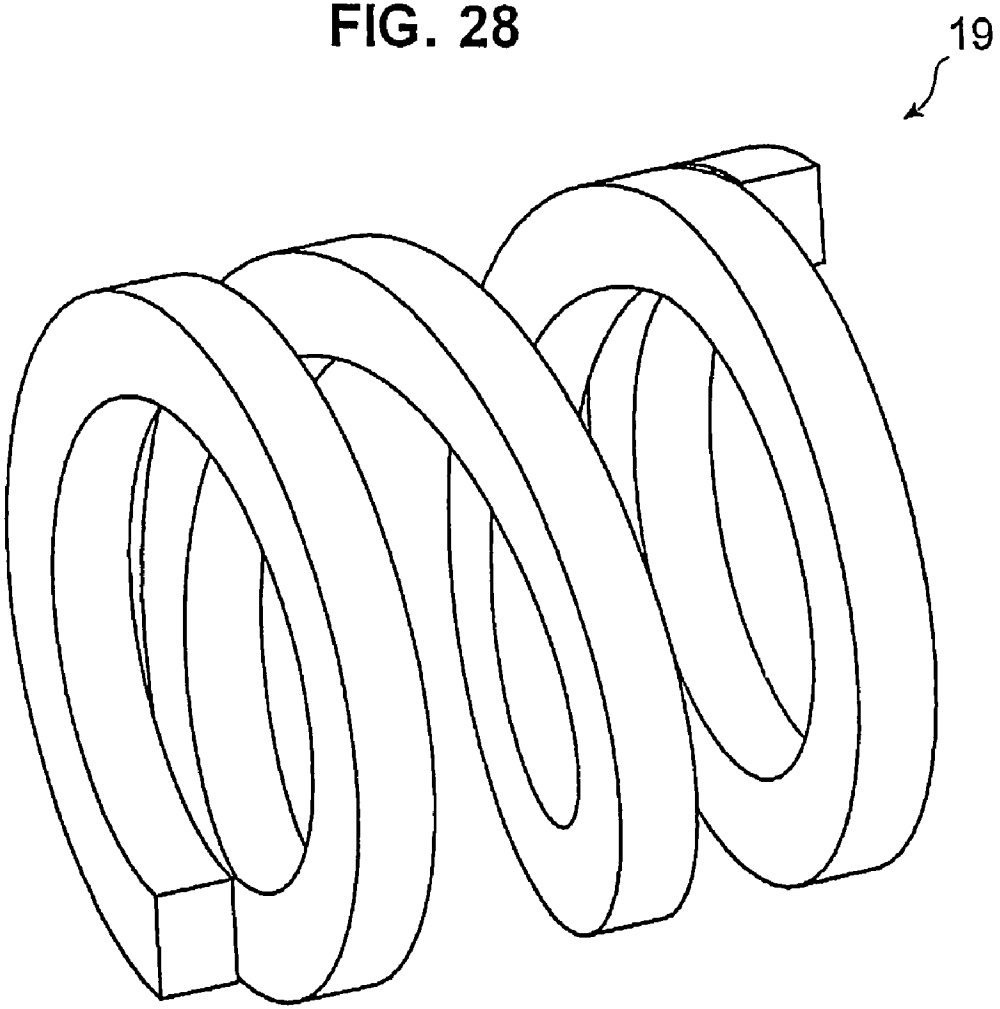
FIG. 28 is a perspective view showing an elastic body within the container in FIGS. 26 and 27.

Further, as shown in FIGS. 26 to 28, the structure may be made such that the applying body 20 is elastically restored by an elastic body 19 within a filling member 18 constituting the container.

The filling member 18 is provided with a filling member main body 18*a* coupled to the main body tube 2 so as to be non-rotatable, and immobile in the axial direction, a filling member leading end portion 18*b* attached to a leading end portion of the filling member main body 18*a*, and an applying body holding portion 18*c* attached to the filling member leading end portion 18*b* and holding the applying body 20, and is entirely formed in an approximately cylindrical shape.

The filling member main body 18*a* receives most of the applying filler L to be filled. The filling member leading end portion 18*b* is structured such that a leading end surface having an opening 18*d* for discharging the applying filler L is formed as a surface vertical to the axial direction, and is provided with a discharge passage 18*e* communicating from the opening 18*d* in the leading end surface to a rear end surface. The discharge passage 18*e* is structured such that an approximately center portion in the axial direction is formed as a small-diameter narrow passage 18*f*, and a front side and a rear side of the narrow passage 18*f* are formed as large-diameter expanded passages 18*g* and 18*h*.

The applying body 20 is constituted by an elastic body made of a porous material, for example, an urethane foam, a fine net-like material or the like, and is formed in a curved disc shape curved to an outer side. A peripheral edge portion bent to a rear side in the applying body 20 is engaged with a leading end portion of the filling member leading end portion 18*b* and engaged with a leading end portion of the applying body holding portion 18*c* so as to be pressed, whereby the applying body 20 is attached to the filling member 18, and covers the opening 18*d* of the filling member 18.

Further, a compression spring 19 serving as the elastic body is arranged in a front side expanded passage 18*g* of the filling member leading end portion 18*b*. The compression spring 19 is arranged so as to be pinched between a back surface of the applying body 20 and a peripheral edge portion of the narrow passage 18*f* of the filling member leading end portion 18*b*, and is structured such as to always energize the applying body 20 to the outer side.

Further, since the applying filler extruding container having the structure mentioned above is structured such that the filling member 18 in which the applying filler L is filled is inserted and attached to the leading end side of the main body side assembly 40, it is easy to assemble after the applying filler L is filled in the filling member 18, and there is provided a state in which the applying filler L is sufficiently filled in a filling region 18*x* between an inner side of the applying body 20 constituting the leading end portion of the filling member 18, and the elastic body 9 attached to the leading end of the movable body 6 of the main body side assembly 40.

Accordingly, in the applying filler extruding container, in the case that the user relatively rotates the main body tube 2 or the filling member 18 and the operating tube 3 while accompanying the click feeling so as to move forward the movable body 6 at the first applying time after buying the applying filler extruding container, the applying filler L is rapidly discharged from the porous portion functioning as a discharge port of the applying body 20 without repeating the relative rotation more than necessary, because the applying filler L is sufficiently filled in the filling region 18*x*.

Further, when pressing the applying body 20 to the applied portion A and applying the applying filler L to the applied portion A in the same manner as described in FIG. 19(*b*) under the state in which the applying filler L is discharged as mentioned above, the applying body 20 is elastically deformed so as to be concaved to the rear side against the energizing force of the compression spring 19 on the basis of the pressing to the applied portion A. When the application is finished and the applying body 20 is moved apart from the applied portion A, the applying body 20 is elastically restored to the original position shown in FIG. 27 on the basis of the energizing force of the compression spring 19. The predetermined space B is formed in the inner side of the applying body 20 at this time. Accordingly, even if the applying filler L filled in the filling member 18 and the air mixing into the applying filler L are inflated due to the variation of temperature and the variation of atmospheric pressure, the applying filler L is prevented from leaking from the applying body 20 on the basis of the predetermined space B.

Further, as shown in FIG. 27, if the movable body 6 moves forward to the maximum on the basis of the relative rotation between the main body tube 2 or the filling member 18 and the operating tube 3 by the user, the elastic body 9 is brought into contact with the inclined surface in the leading end side of the rear side expanded path 18*h* so as to be elastically deformed, and the leading end portion of the elastic body 9 bulges so as to move forward to the front side expanded passage 18*g* through the narrow passage 18*f*. Accordingly, the applying filler L is well pressed out so as to be consumed. In this case, the other operations and effects are the same as those of the applying filler extruding container 100 mentioned above.

Figure 29:
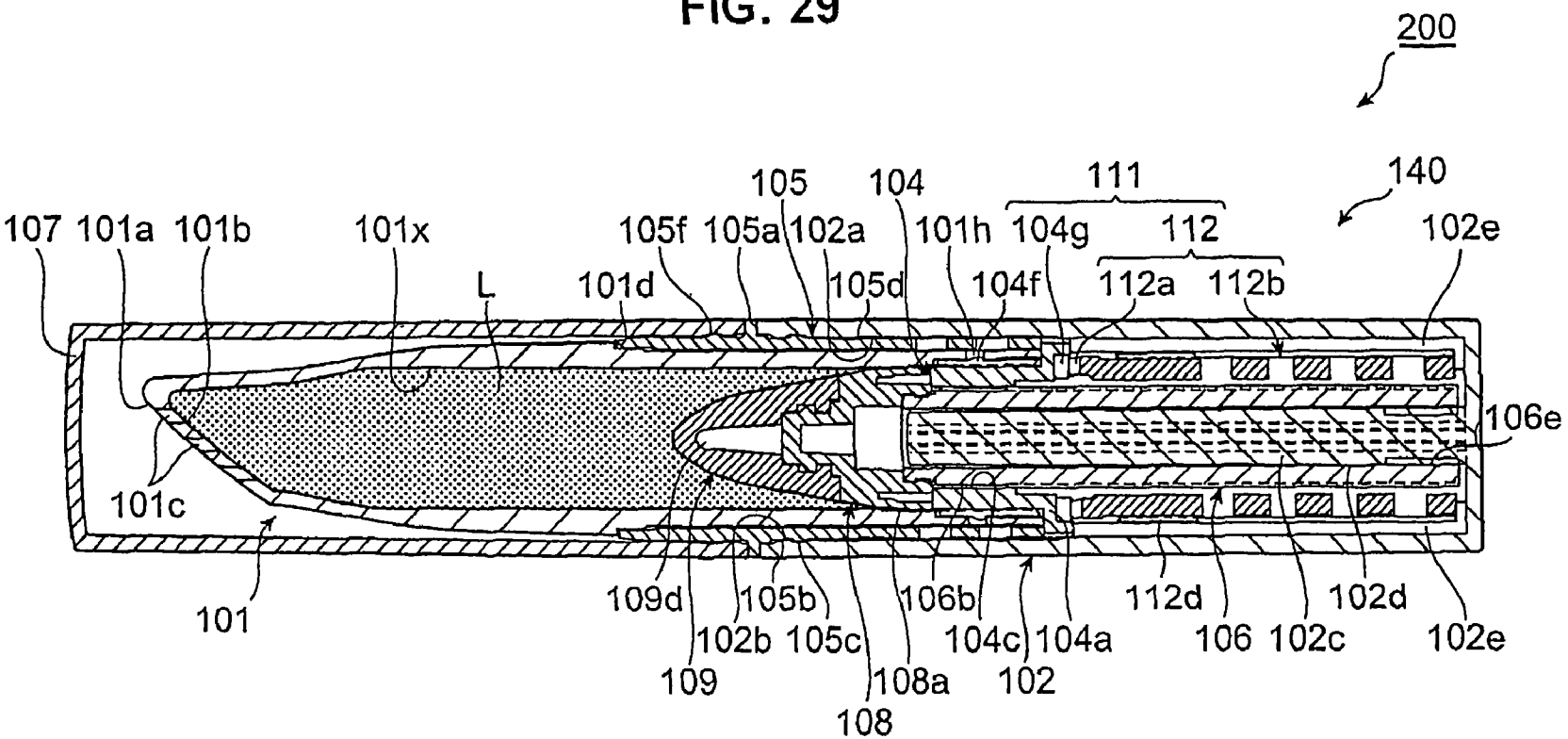
FIG. 29 is a longitudinal sectional view showing an applying filler extruding container in accordance with a second embodiment of the present invention.
Figure 30:
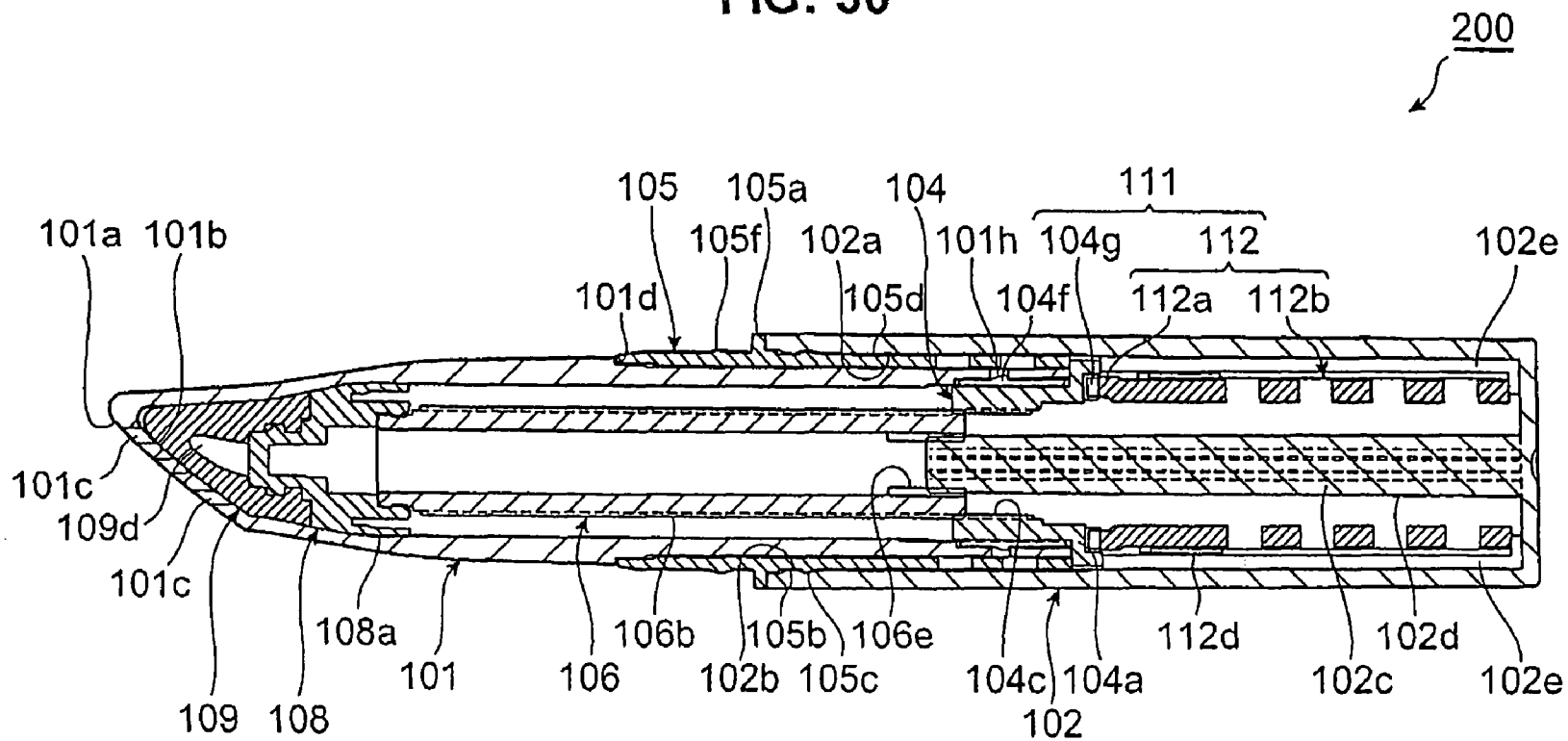
FIG. 30 is a longitudinal sectional view showing a state that a cap of the applying filler extruding container in accordance with the second embodiment of the present invention is taken off, and that a movable body is at a maximum forward moving time.
Figure 31:
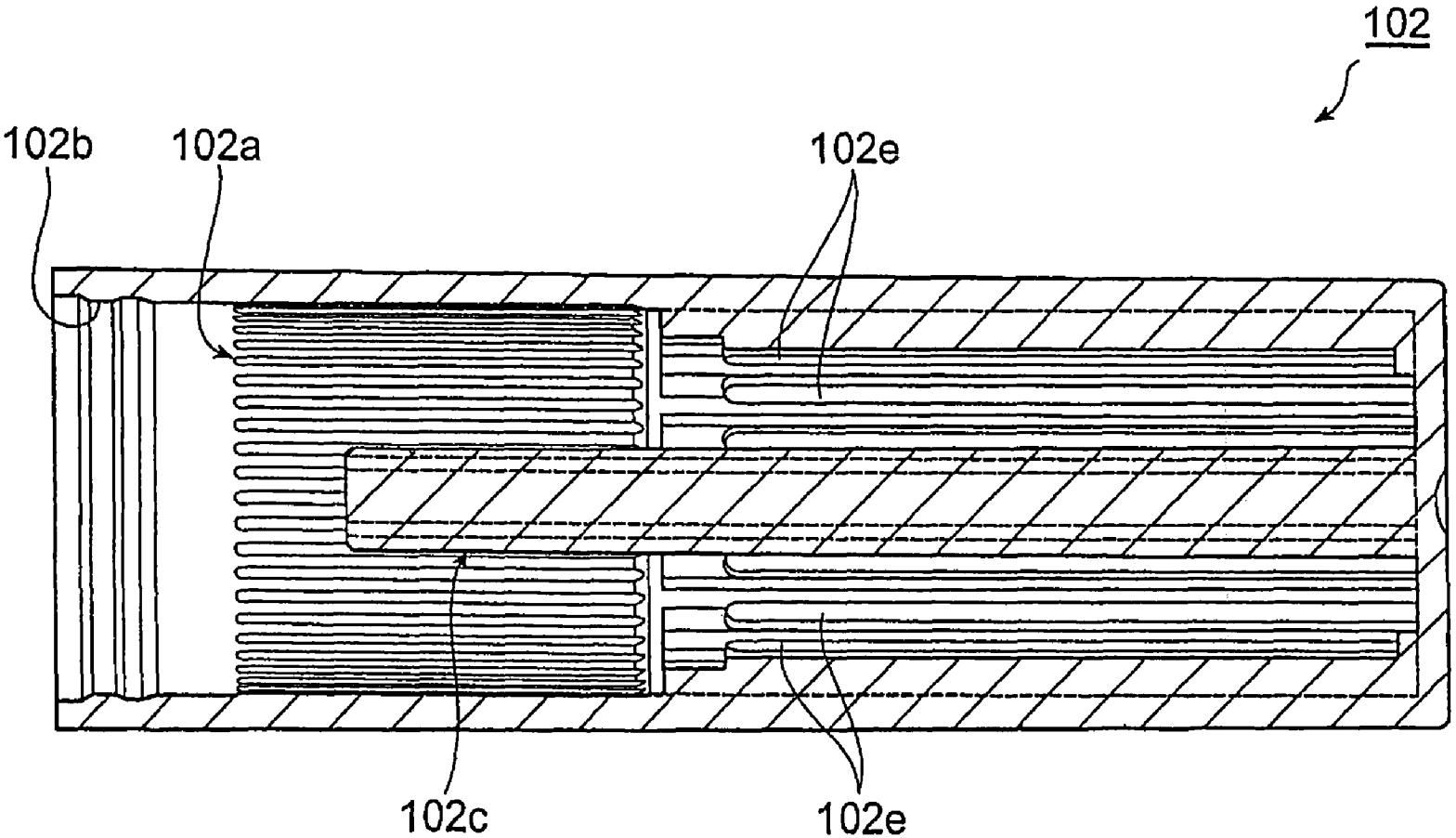
FIG. 31 is a longitudinal sectional view showing a main body tube in FIGS. 29 and 30.
Figure 32:
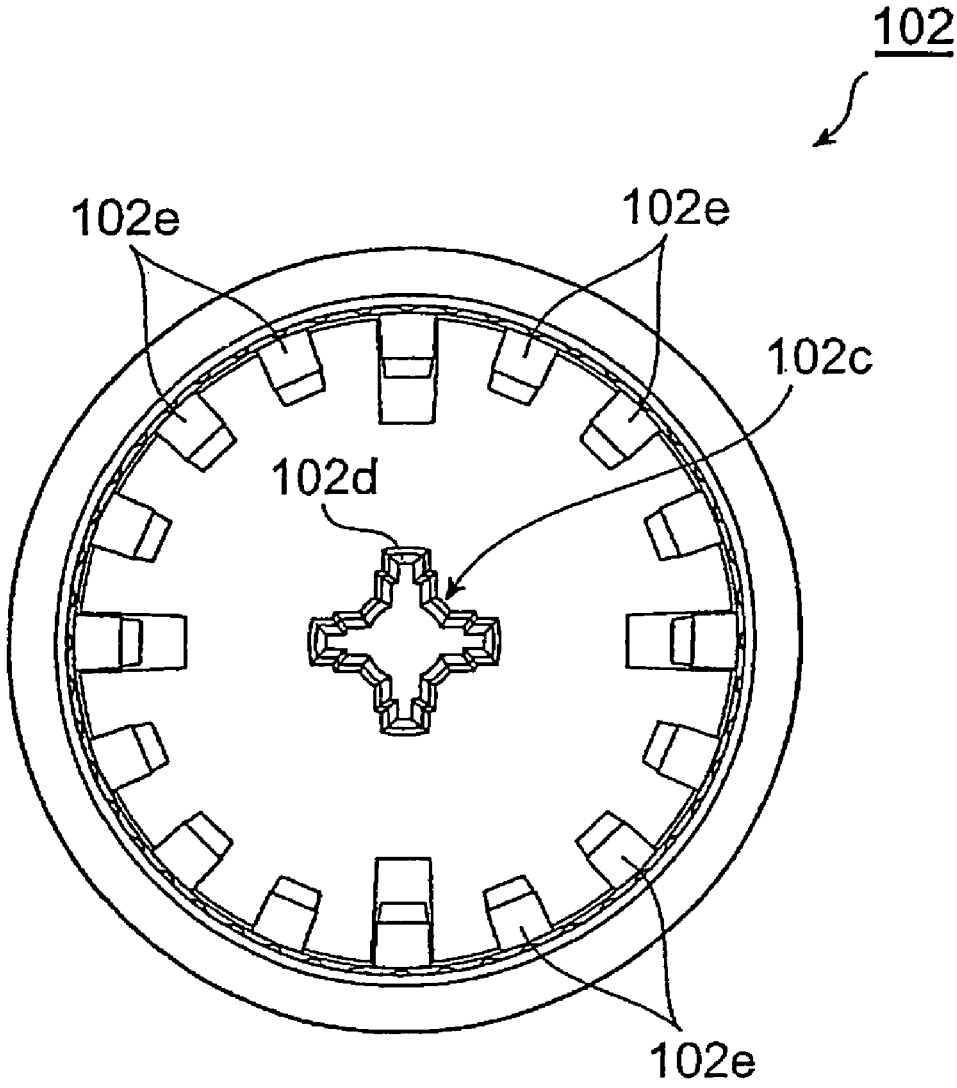
FIG. 32 is a left side view of the main body tube shown in FIG. 31.
Figure 33:
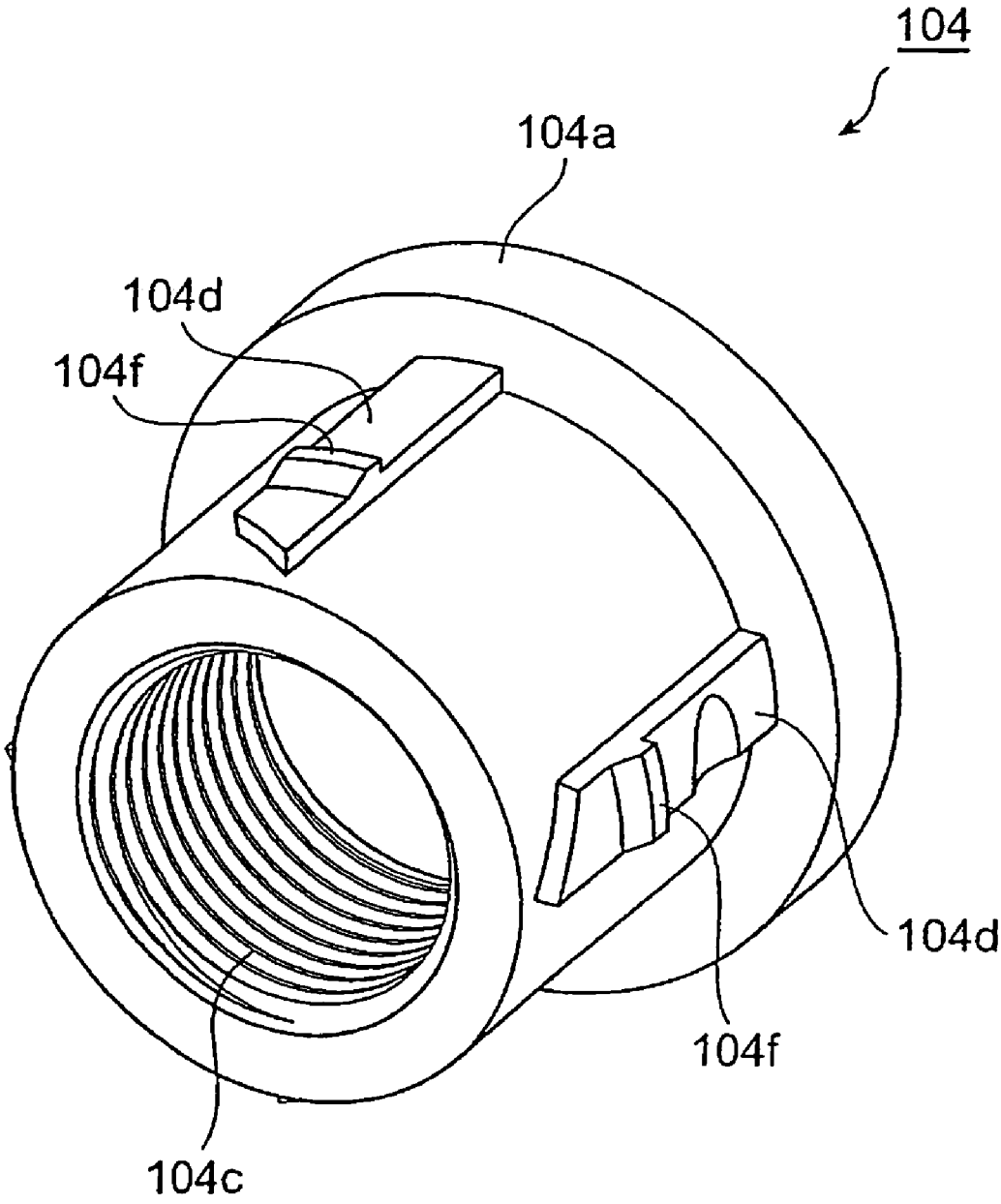
FIG. 33 is a perspective view showing a thread tube in FIGS. 29 and 30 from a front side.
Figure 34:
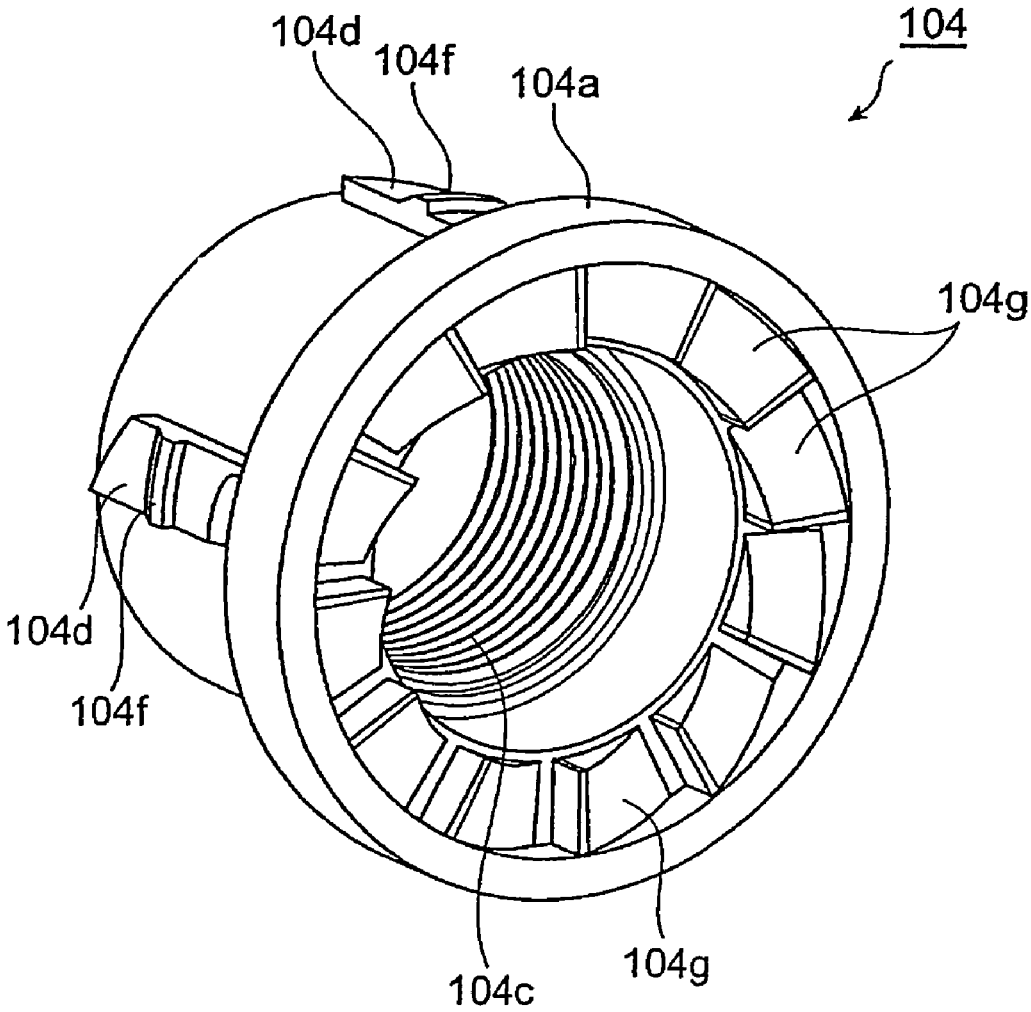
FIG. 34 is a perspective view showing the thread tube shown in FIG. 33 from the rear.
Figure 35:
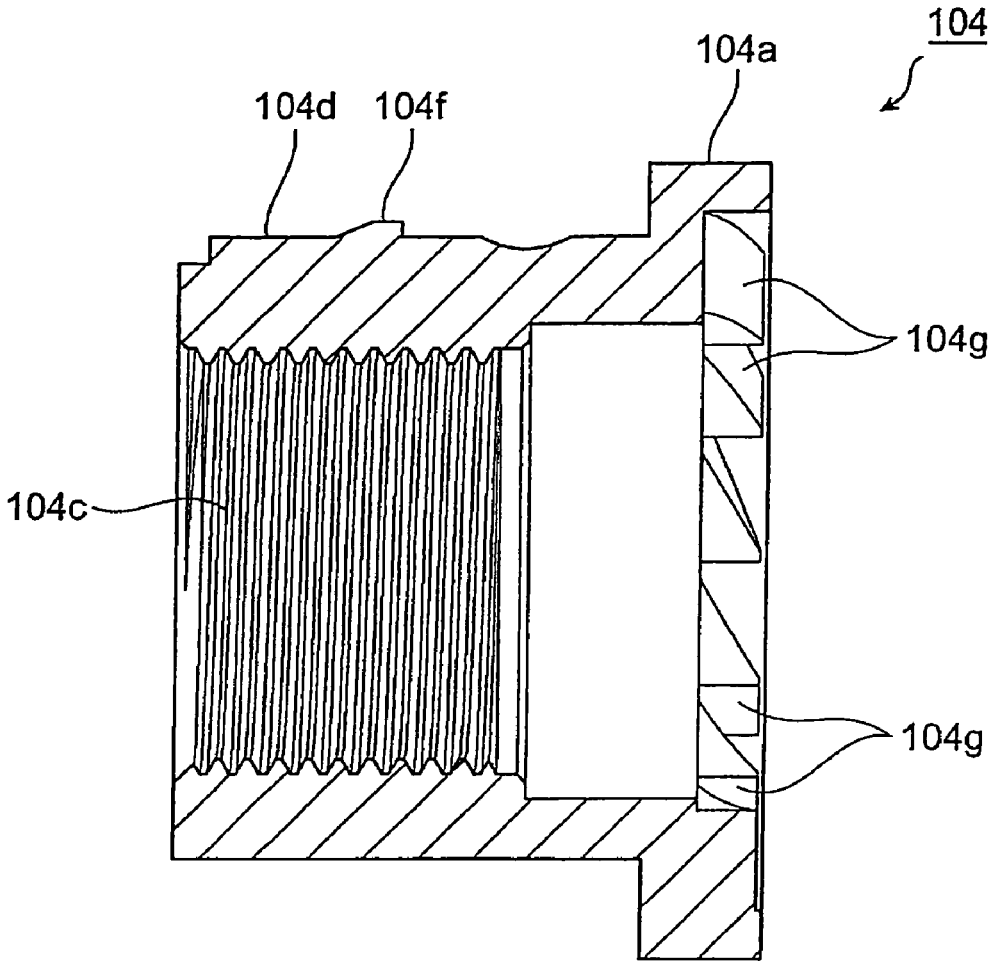
FIG. 35 is a longitudinal sectional view of the thread tube shown in FIGS. 33 and 34.
Figure 36:
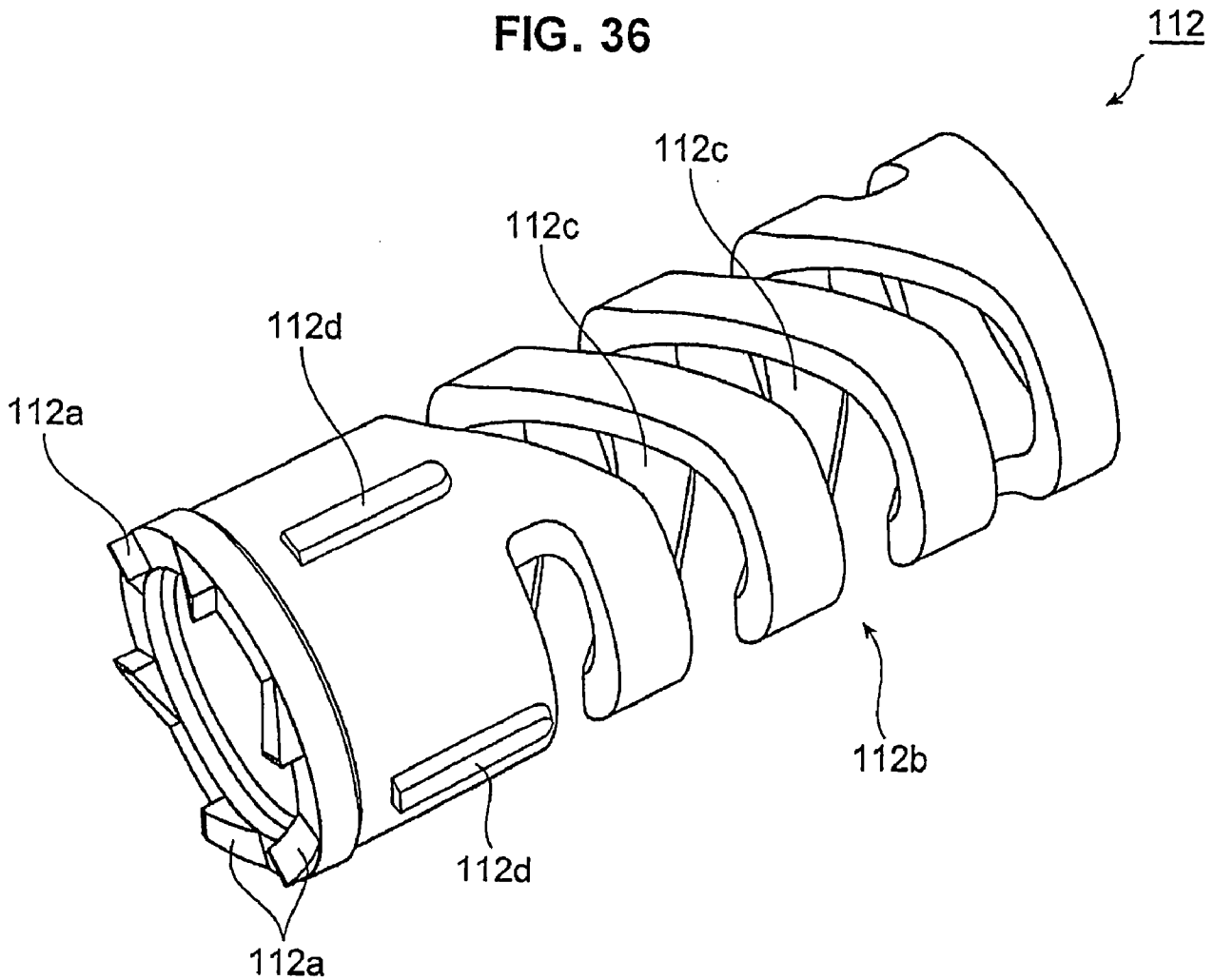
FIG. 36 is a perspective view showing a ratchet spring member shown in FIGS. 29 and 30.
Figure 37:
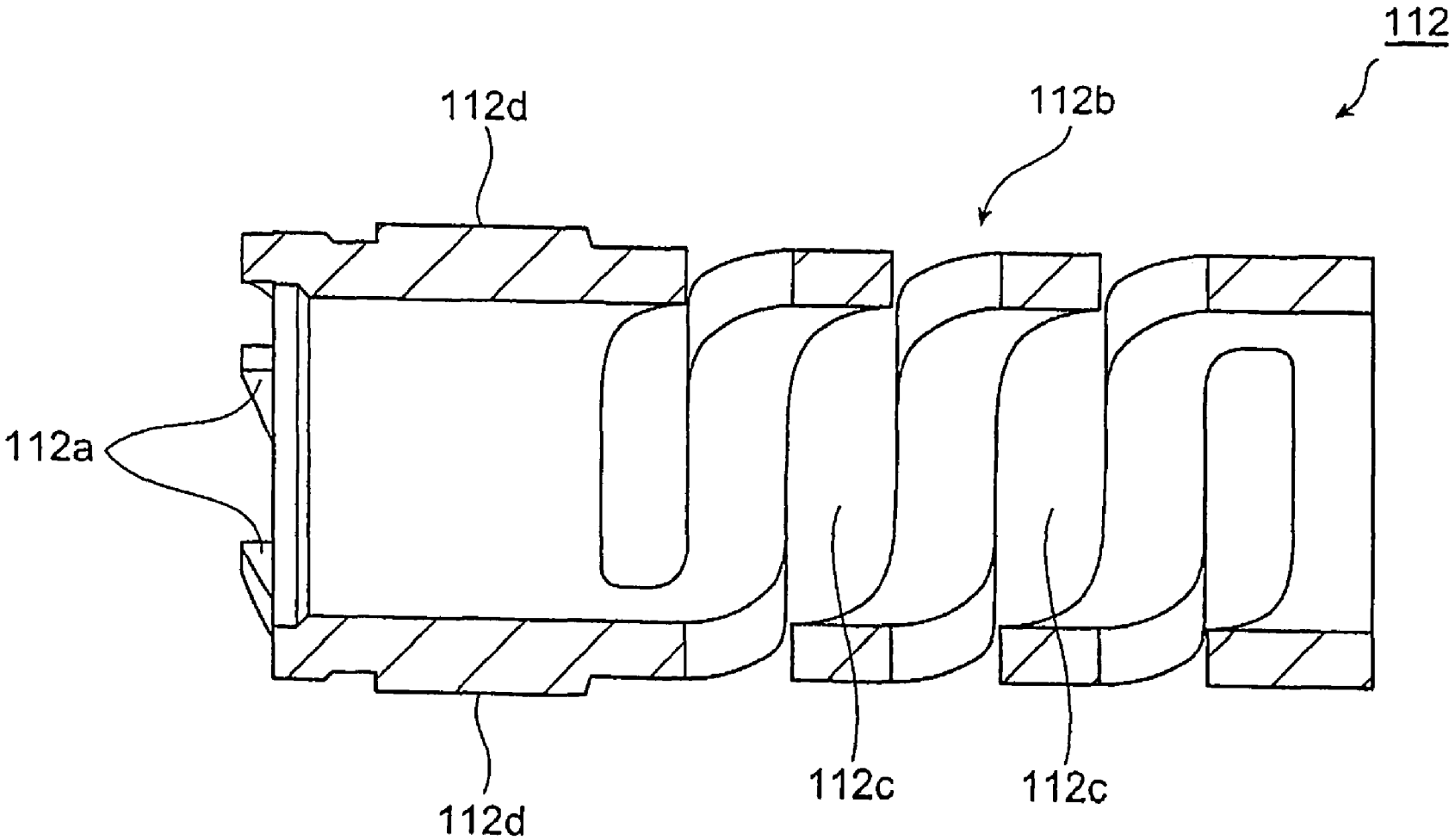
FIG. 37 is a longitudinal sectional view of the ratchet spring member shown in FIG. 36.
Figure 38:
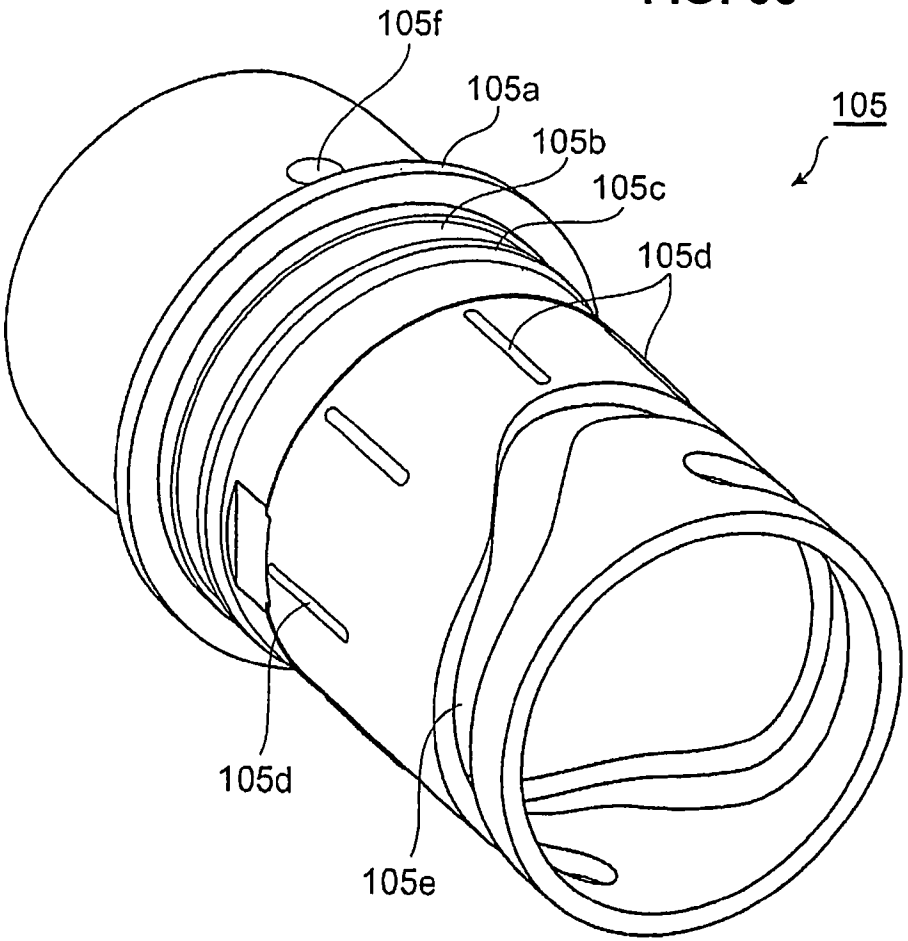
FIG. 38 is a perspective view showing a thread tube presser member in FIGS. 29 and 30.
Figure 39:
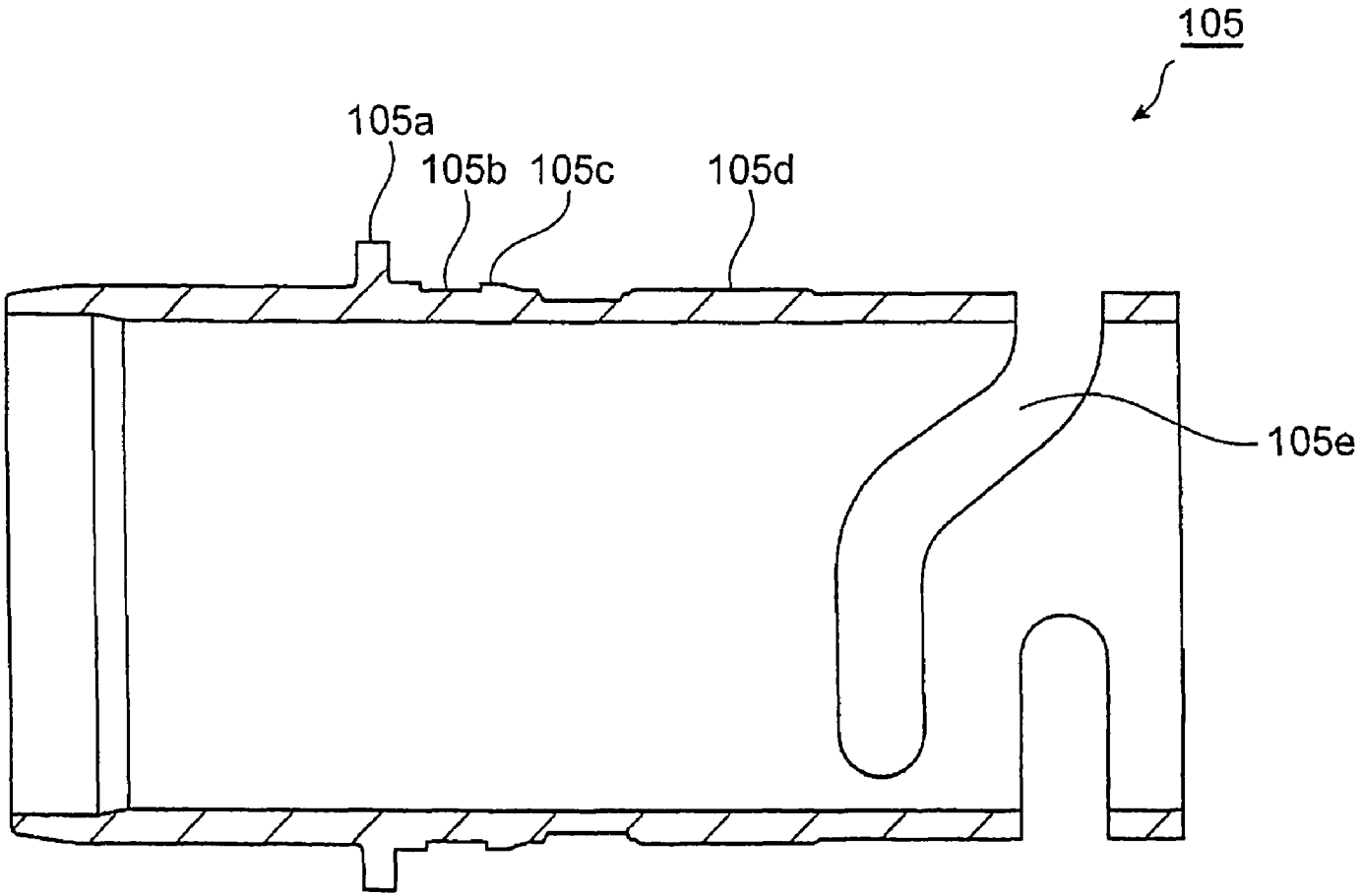
FIG. 39 is a longitudinal sectional view of the thread tube presser member shown in FIG. 38.
Figure 40:
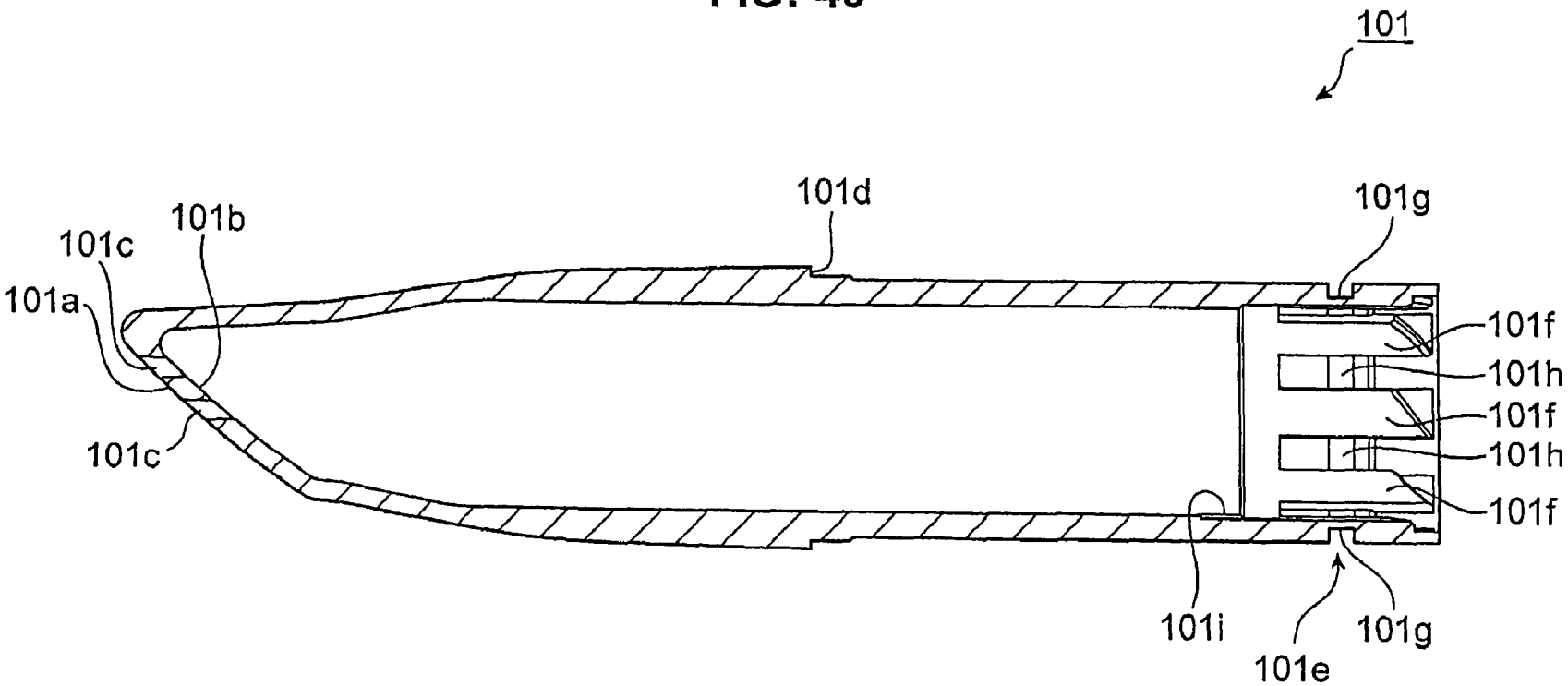
FIG. 40 is a longitudinal sectional view of a filling member in FIGS. 29 and 30.
Figure 41:
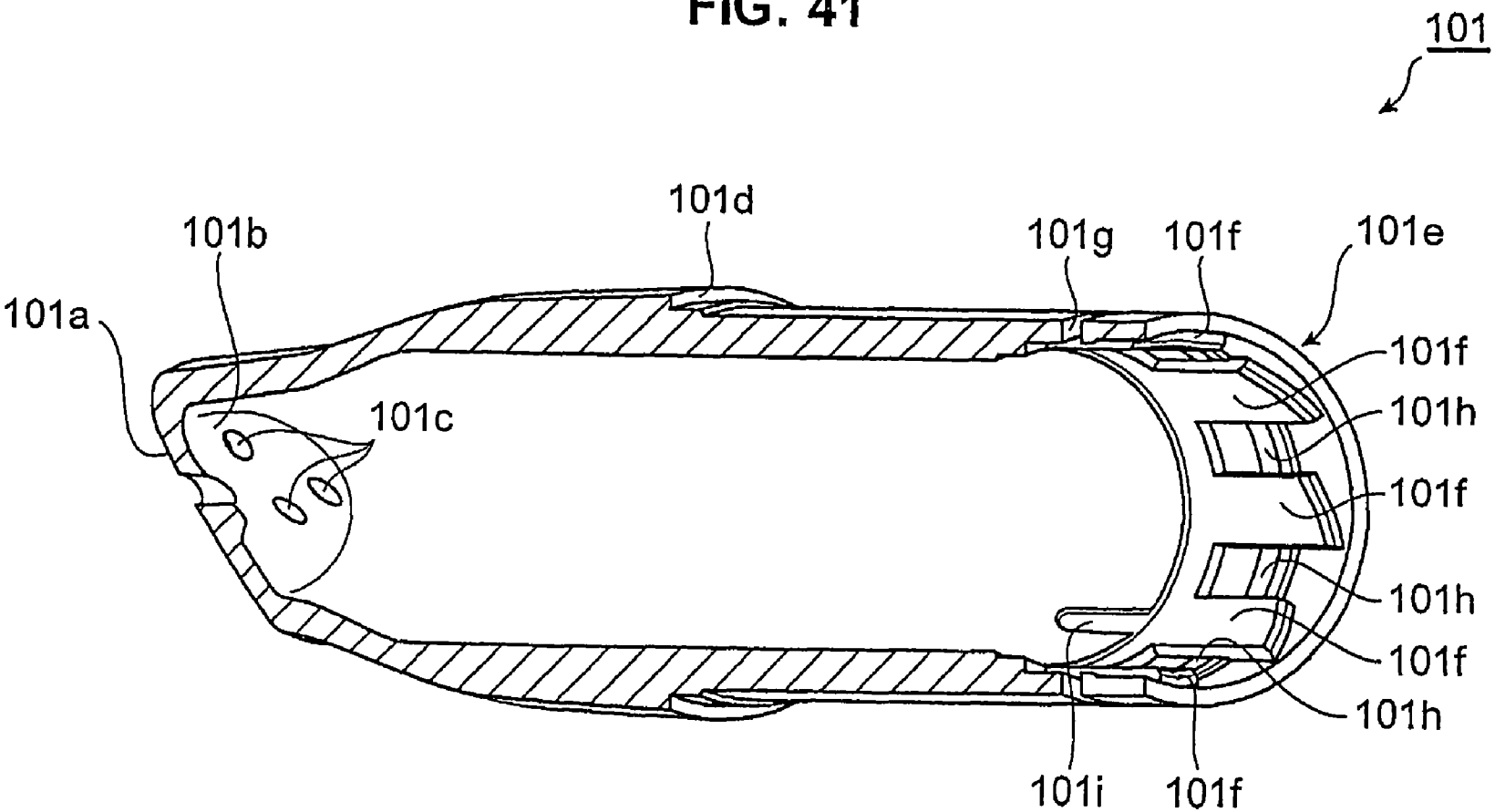
FIG. 41 is a broken perspective view of the filling member in FIGS. 29 and 30.
Figure 42:
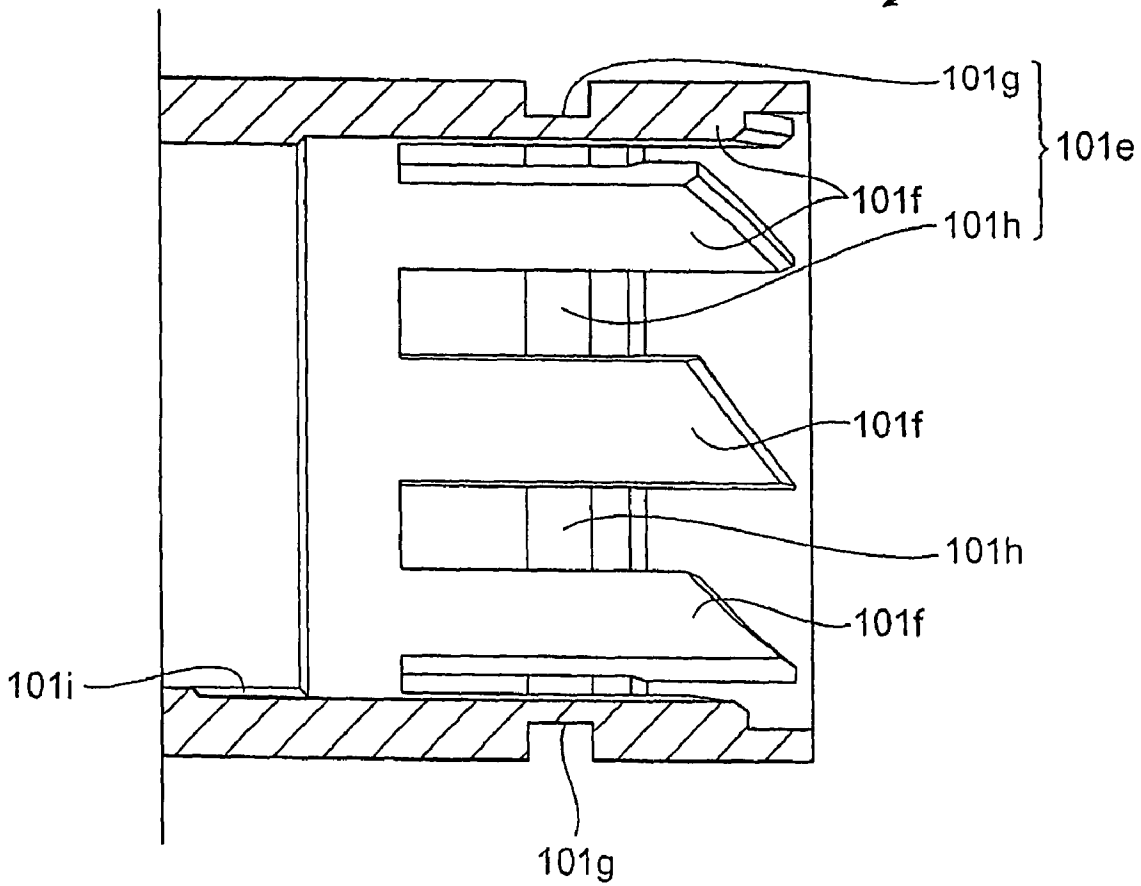
FIG. 42 is an enlarged view of a locking portion with respect to the thread tube of the filling member shown in FIG. 40.
Figure 43:
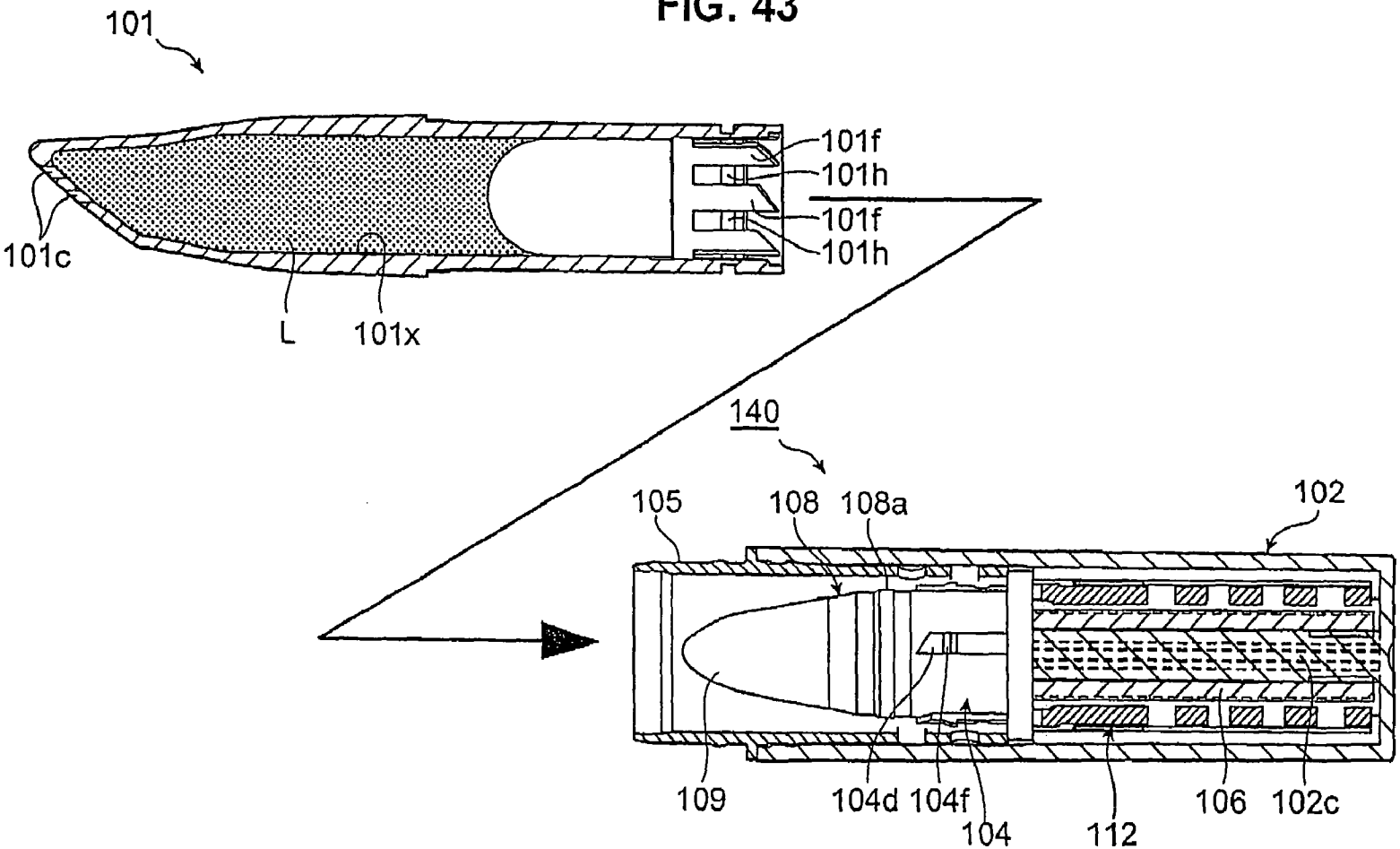
FIG. 43 is an exploded perspective view showing an assembling procedure of the applying filler extruding container shown in FIG. 29.
Figure 44:
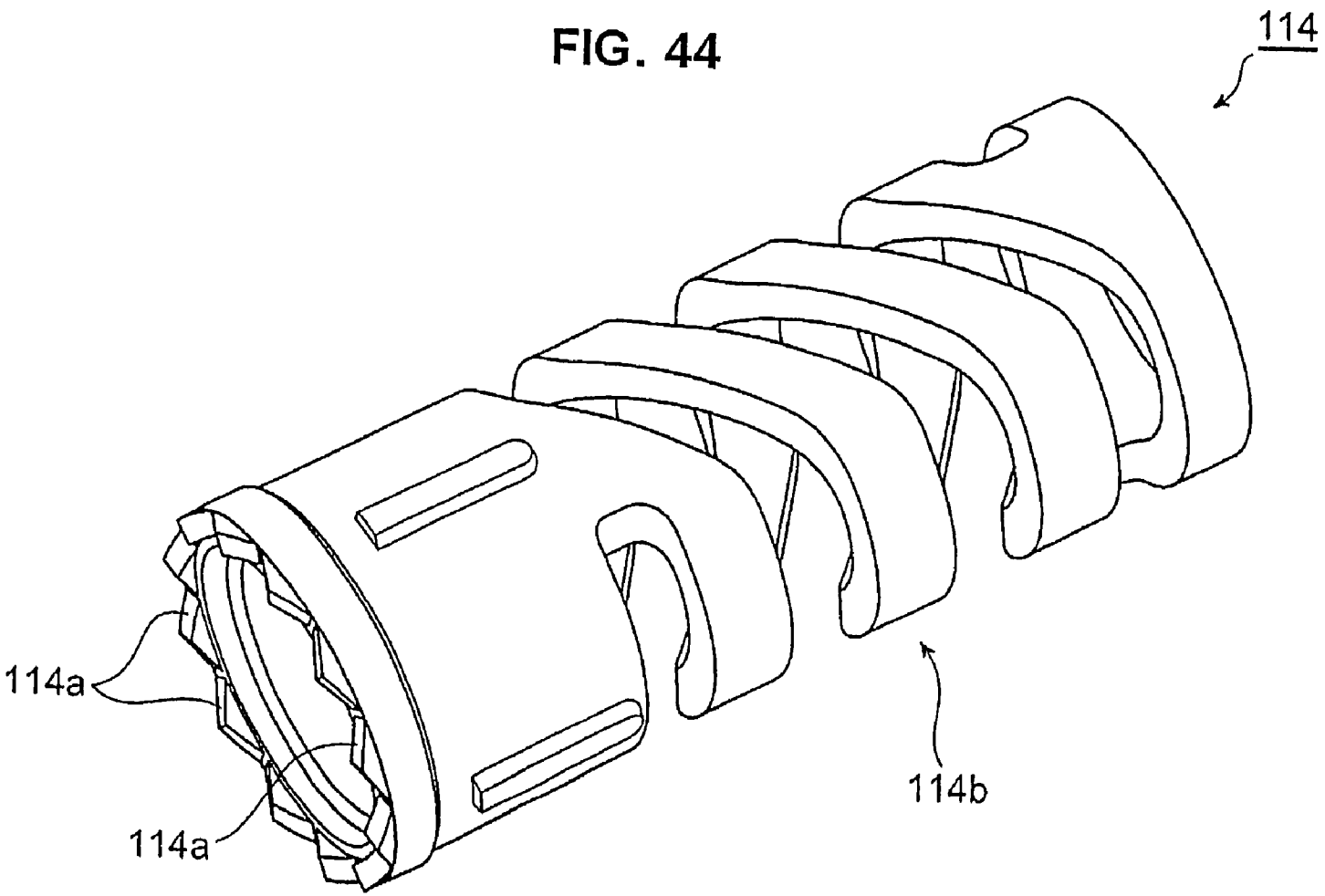
FIG. 44 is a perspective view of the click spring member used in place of the ratchet spring member shown in FIGS. 36 and 37 as seen from the side.

FIG. 29 is a longitudinal sectional view showing an applying filler extruding container in accordance with a second embodiment of the present invention, FIG. 30 is a longitudinal sectional view showing the applying filler extruding container at a time when a movable body moves forward to the maximum, FIGS. 31 and 32 are views showing a main body tube, FIGS. 33 to 35 are views showing a thread tube, FIGS. 36 and 37 are views showing a ratchet spring member, FIGS. 38 and 39 are view showing a thread tube pressing member, FIGS. 40 to 42 are views showing a filling member, FIG. 43 is an exploded perspective view showing an assembling procedure of the applying filler extruding container, and FIG. 44 is a perspective view of a click spring member used in place of the ratchet spring member.

As shown in FIGS. 29 and 30, an applying filler extruding container 200 is provided with a filling member 101 corresponding to a leading tube provided in an inner portion with a filling region 101*x* in which an applying filler L is filled, a main body tube (a main body side tube body) 102 coupling the filling member so as to be relatively rotatable and immobile in an axial direction in a state in which a rear half portion of the filling member 101 is inside inserted to a front half portion thereof, as an outer structure. Further, an inner side of the container is generally provided with a movable body 106 having an elastic body 109 via a piston 108 in a leading end portion and freely moving in the axial direction by a relative rotation between the main body tube 102 and the filling member 101, a thread tube 104 serving as an engagement mechanism (an engagement portion) which can move the movable body on the basis of the relative rotation, a thread tube pressing member 105 inhibiting the thread tube from being disengaged in the axial direction, and a ratchet mechanism 111 allowing a relative rotation in one direction for forward moving the movable body 106 and giving a resistance feeling (a click feeling) in accordance with a fixed amount of relative rotation.

As shown in FIGS. 31 and 32, the main body tube is structured in a closed-end cylindrical shape, and has a knurling 102*a* which is provided with a lot of concavities and convexities in parallel in a peripheral direction and in which the concavities and convexities extend at a predetermined length in an axial direction, in a front side inner peripheral surface from a center portion in an axial direction thereof, and an annular protruding portion 102*b* in an inner peripheral surface in a leading end side from the knurling 102*a*. The knurling 102*a* is provided such as to engage the thread tube pressing member 105 in a rotating direction, and the annular protruding portion 102*b* is provided such as to engage the thread tube pressing member 105 in an axial direction.

Further, a shaft body (a shaft body portion) 102*c* is provided in a rising manner in a center portion of a bottom portion in the main body tube 102 toward a leading end side. The shaft body 102*c* is formed in a non-circular shape in a cross section provided with a protrusion 102*d* extending in an axial direction so as to be formed in a cross shape in a cross section, and the protrusion 102*d* is formed as a rotation prevention constituting one of rotation preventing mechanisms (rotation preventing portion) of the movable body 6.

Further, the main body tube 102 is provided with protrusions 102*e* extending toward the knurling 102*a* from a bottom portion at sixteen equal positions along a peripheral direction in an inner peripheral surface thereof. The protrusions 102*e* are provided for engaging a ratchet spring member 112 mentioned below and constituting a ratchet mechanism 111 in a rotating direction.

The thread tube pressing member 105 is structured in a cylindrical shape having a collar portion 105*a* in a leading end side, as shown in FIGS. 38 and 39, and has an annular groove portion 105*b* and an annular protruding portion 105*c* for engaging with the annular protruding portion 102*b* of the main body tube 102 in the axial direction in an axial direction, at a rear position close to the collar portion 105*a* in an outer peripheral surface thereof. Further, a plurality of protrusions 105*d* for engaging with the knurling 102*a* of the main body tube 102 in a rotating direction are provided along a peripheral direction in the thread tube pressing member 105 so as to extend at a predetermined length in the axial direction, and approximately spiral slits 105*e* are provided at positions in rear end portions thereof.

Further, the thread tube pressing member 105 is provided with protruding portions (so-called dowels) 105*f* for detachably locking a cap 107 (refer to FIG. 29) covering a front side of the collar portion 105*a* of the thread tube pressing member 105 in the axial direction at three equal positions in the peripheral direction, in a front position close to the collar portion 105*a* of the outer peripheral surface.

The thread tube pressing member 105 is inside inserted to the main body tube 102 from a rear end portion thereof, as shown in FIGS. 29 and 30, a rear end surface of the collar portion 105*a* is brought into contact with an open end in a leading end side of the main body tube 102, the annular groove portion 105*b* and the annular protruding portion 105*c* are engaged with the annular protruding portion 102*b* of the main body tube 102, and the protrusion 105*d* is engaged with the knurling 102*a* of the main body tube 102, whereby the thread tube pressing member 105 is attached to the main body tube 102 so as to be non-rotatable and immobile in the axial direction.

The thread tube 104 is structured in a cylindrical shape and has a collar portion 104*a* in a rear end portion, as shown in FIGS. 33 to 35. The thread tube 104 is provided with a female thread 104*c* constituting one of engagement mechanisms (engagement portions) in an inner peripheral surface of a front half portion. Further, a protrusion 104*d* for engaging the filling member 101 in a rotating direction is formed at four positions along a peripheral direction, in the outer peripheral surface of the thread tube 104 so as to extend at a predetermined length in an axial direction, and a protruding portion 104*f* for engaging the filling member 101 in an axial direction is formed in a circular arc shape on the protrusion 104*d*. All of the leading end portions of the protrusions 104*d* are structured as inclined portions inclined in one direction so as to easily move forward between protrusions 101*f* and 101*f* mentioned below of the filling member 101.

Further, the collar portion 104*a* of the thread tube 104 is structured in an annular shape, and a ratchet gear (a predetermined engagement portion) 104*g* constituting a ratchet mechanism 111 is provided in a rear end side surface thereof. The ratchet gear 104*g* is formed by arranging a vertical surface and an inclined surface together along a peripheral direction, and is provided so as to allow the rotation in only one direction in which the movable body 6 moves forward.

The thread tube 104 is structured, as shown in FIGS. 29 and 30, the collar portion 104*a* is arranged between the leading end surface of the protrusion 102*e* of the main body tube 102 and the rear end surface of the thread tube pressing member 105 so as to be rotatably positioned, and the thread tube 104 is energized to the leading end surface of the protrusion 102*e* of the main body tube 102 by utilizing an elastic force of the approximately spiral slit 105*e* of the thread tube pressing member 105, whereby an improved relative rotational resistance is generated. Further, even if the applying filler extruding container 200 falls down in a leading end direction in a state of being covered with the cap 107, an impact applied to the filling member 101 (in detail mentioned below) fixed to the thread tube 104 is reduced by the slit 105*e* of the thread tube pressing member 105, and it is possible to inhibit the member from being broken and the applying filler L from being discharged.

The ratchet spring member 112 constitutes a rotating amount regulating member as well as constituting the ratchet mechanism 111, and is formed as an injection molded product by a resin. The ratchet spring member 112 is structured approximately in a cylindrical shape as shown in FIGS. 36 and 37, is provided with ratchet gears 112*a* constituting a concavo-convex portion engaging with the ratchet gear 104*g* of the thread tube 104 along a peripheral direction, and is integrally formed so as to have a compression spring portion 112*b* serving as an elastic portion connecting a leading end portion having the ratchet gear 112*a*. The ratchet gear 112*a* is structured by arranging a vertical surface and an inclined surface together along the peripheral direction, in the same manner as the ratchet gear 104*g*. The compression spring portion 112*b* is provided with an approximately spiral slit 112*c* in a peripheral wall thereof, and energizes the pressed ratchet gear 112*a* against the pressing force by the slit 112*c*. Further, a plurality of protrusions 112*d* for engaging with the protrusions 102*e* of the main body tube 102 in the rotating direction are provided in an outer peripheral surface of a leading end portion of the ratchet spring member 112 along the peripheral direction so as to extend at a peripheral length in an axial direction.

As shown in FIGS. 29 and 30, the ratchet spring member 112 is received within the main body tube 102 in such a manner as to be positioned between a bottom surface of the main body tube 102 and the collar portion 104*a* of the thread tube 104, presses the ratchet gear 112*a* to the ratchet gear 104*g* of the collar portion 104*a* of the thread tube 104 on the basis of an energizing force of the compression spring 112*b* so as to bring the collar portion 104*a* into contact with the rear end surface of the thread tube pressing member 105, and is attached to the main body tube 102 so as to be non-rotatable, on the basis of the engagement of the protrusion 112*d* between the protrusions 102*e* and 102*e* of the main body tube 102. In this state, the ratchet gear 112*a* is in a state of being engaged with the ratchet gear 104*g* of the thread tube 104.

Since the leading end side including the collar portion 6*a* of the movable body 6 described in the first embodiment is omitted, and the movable body 106 is not moved backward by the ratchet mechanism 111, the movable body 106 is formed in a shape in which the concave portion 6*f* or the convex portion 6*h* is omitted. Accordingly, the bottom surface of the main body tube 102 is not provided with the convex portion 3*g* for engaging with the concave portion 6*f* or the concave portion 3*h* for engaging with the convex portion 6*h*. Further, the other structures of the movable body 106 are approximately the same as the movable body 6 of the first embodiment.

The movable body 106 is outside inserted to the shaft body 102*c* of the main body tube 102 from a rear end portion thereof and is inside inserted to the thread tube 104, and a protrusion 106*e* provided in an inner peripheral surface in a rear end side is engaged between the protrusions 102*d* and 102*d* of the shaft body 102*c*, and is attached to the main body tube 102 so as to be non-rotatable and movable in the axial direction, in a state in which a male thread 106*b* provided in an outer peripheral surface thereof is engaged with a female thread 104*c* of the thread tube 104.

A piston 108 is attached to a leading end portion of the movable body 106 so as to have approximately the same structure and function as those of the leading end side portion including the collar portion 6*a* of the movable body 6. Further, an outer peripheral surface in a rear end portion of the piston 108 is provided with an annular protruding portion 108*a* for securing water tightness, which is provided in the elastic body 9 in the first embodiment.

An elastic body 109 is attached to a leading end portion of the piston 108 so as to have approximately the same structure and function as those of the elastic body 9 described in the first embodiment. In this case, since the elastic body 109 is attached to the leading end portion of the piston 108, a space 109*d* for promoting an elastic deformation is provided within the elastic body 109, in the same manner as the first embodiment.

Further, the engagement mechanism is structured by the male thread 106*b* of the movable body 106 and the female thread 104*c* of the thread tube 104, the rotation preventing mechanism is structured by the protrusion 106*e* of the movable body 106 and the protrusion 102*d* of the shaft body 102*c*, the ratchet mechanism 111 is structured by the ratchet gear 112*a* and the compression spring portion 112*b* of the ratchet spring member 112 and the ratchet gear 104*g* of the thread tube 104, and the extruding mechanism of the applying filler L structured by them, the movable body 106 and the elastic body 109 are installed in the main body tube 102 serving as the main body side tube body, whereby the main body side assembly 140 is structured (refer to FIG. 43).

The filling member 101 receives the applying filler L, and discharges the applying filler L from the leading end portion in accordance with an operation by a user, and the leading end portion is contacted to the applied portion to use for application. Accordingly, it is preferable that the material of the filling member 101 is constituted by an injection molded plastic such as a polyethylene terephthalate (PET), a polypropylene (PP) or the like, and it is preferable that the material is constituted by a transparent material for checking out a color tone of the applying filler L and a filling condition.

The filling member 101 is structured in a stepped cylindrical shape in which a leading end portion is tapered and a portion from an approximately center portion in an axial direction to a rear end surface is made small in diameter via an outer peripheral step surface 101*d*, as shown in FIGS. 40 and 41. In the filling member 101, an outer surface 101*a* forming an applying surface in the leading end portion is formed as an inclined surface which is preferable for applying to the applied portion, for example, a skin or the like. Further, an inner surface 101*b* formed as an inclined surface at a fixed thickness distance from the outer surface 101*a* is formed in the leading end portion of the filling member 101, and a plurality of discharge ports 101*c* communicating the inner surface 101*b* with the outer surface 101*a* and provided for discharging the applying filler L are provided therein.

Further, an annular slit 101*e* communicating between inner and outer sides is provided in a rear portion of the filling member 101, as shown in FIGS. 40 to 42, and an inner peripheral surface of the rear portion is provided with a plurality of protrusions 101*f* extending at a predetermined length in an axial direction from a rear end of the filling member 101 and coming across the slit 101, at a uniform distance along a peripheral direction. Accordingly, in the slit 101*e*, a portion which the protrusion 101*f* comes across is formed as a groove 101*g*, and a portion between the protrusions 101*f* and 101*f* is formed as an opening 101*h*. The opening 101*h* is provided for engaging the protruding portion 104*f* of the thread tube 104 in the axial direction, and the protrusion 101*f* is provided for engaging the protrusion 104*d* of the thread tube 104 in a rotating direction. Rear end portions of the protrusions 101*f* are all structured as an inclined portion inclined in one direction in such a manner that the protrusion 104*d* of the thread tube 104 easily moves forward between the protrusions 101*f* and 101*f*. Further, as shown in FIG. 39, an air vent groove 101*i* open to a rear side and extending short toward the leading end side is provided in an inner peripheral surface of the filling member 101 and a little in a leading end side from the protrusion 101*f*.

The filling member 101 is inside inserted to the thread tube pressing member 105 from a rear portion side thereof and is outside inserted to the thread tube 104. The outer peripheral step surface 101*d* is positioned in an open end in a leading end side of the thread tube pressing member 105, as shown in FIGS. 29 and 30, the protrusion 104*d* of the thread tube 104 moves forward between the protrusions 101*f* and 101*f* so as to be engaged, and the protruding portion 104*f* of the thread tube 104 moves forward to the opening 101*h* so as to be engaged, whereby the filling member 101 is attached to the thread tube 104 so as to be non-rotatable and immobile in the axial direction, thereby being integrally formed with the thread tube 104, and being attached to the main body tube 102 so as to be rotatable and immobile in the axial direction. Further, as shown in FIG. 29, the cap 107 detachably mounted to the thread tube pressing member 105 in such a manner as to cover the filling member 101 is rotatable with respect to the filling member 101.

In the case of assembling the applying filler extruding container 200 having the structure mentioned above, the main body side assembly 140 shown in FIG. 43 is obtained by receiving the ratchet spring member 112 in the main body tube 102, screwing the thread tube 104 to the leading end portion of the movable body 106, attaching the elastic body 109 to the leading end of the movable body 106 via the piston 108, coupling the movable body 106 having the elastic body 109 and the thread tube 104 to the shaft body 102*c* of the main body tube 102 so as to mount the thread tube 104 onto the ratchet spring member 112, and attaching the thread tube pressing member 105 to the main body tube 102.

On the other hand, in the filling member 101, in a state in which the discharge port 101*c* is closed by a stop plug (not shown) so as to be reversed, there is obtained a state in which no space exists within the leading end of the filling member 101 by filling the filling region 101*x* with a predetermined amount of applying filler L. Further, the filling member 101 filled with the applying filler L is inserted and attached to the leading end side of the main body side assembly 140. At this time, since an inner peripheral surface of the filling member 101 is set to an initial position while being brought into slidable contact with the annular protruding portion 108*a* for securing water tightness of the piston 108, and the air vent groove 101*i* of the inner peripheral surface is positioned so as to come across the annular protruding portion 108*a* in the axial direction, the air in the applying filler side is well vented to the rear side through the air vent groove 101*i*. Further, the stop plug is finally detached. In this case, a seal having an adhesive agent which can be detached after the filling and just before a user uses, may be adhered to the discharge port 101*c* before filling with the applying filler L, in place of the stop plug.

In accordance with the applying filler extruding container 200 shown in FIG. 29 and structured as mentioned above, since the structure is made such that the filling member 101 filled with the applying filler L is inserted and attached to the leading end side of the main body side assembly 140, it is easy to assemble after filling the applying filler L in the filling member 101, and there is obtained a state in which the applying filler L is sufficiently (fully) filled in the filling region 101*x* between the inner side of the discharge port 101*c* of the filling member 101, and the elastic body 109 attached to the leading end of the movable body 106 of the main body side assembly 140.

Next, a description will be given of use of the applying filler extruding container 200 structured as mentioned above. In the applying filler extruding container 200, if the filling member 101 and the main body tube 102 are relatively rotated by a user, the movable body 106 moves forward by the engaging mechanism, the rotation preventing mechanism and the ratchet mechanism 111 mentioned above, and the ratchet gears 104*g* and 112*a* constituting the ratchet mechanism 111 mentioned above repeat engagement and disengagement in accordance with the relative rotation at this time. Accordingly, a resistance feeling (the click feeling) is given to the user, and a forward moving degree of the movable body 106 is detected on the basis of the resistance feeling.

Further, if the user relatively rotates the filling member 101 and the main body tube 102 so as to move the movable body 6 forward while accompanying with the resistance feeling, at the first applying time after buying the applying filler extruding container 200, the applying filler L is rapidly (immediately) discharged from the discharge port 101*c* without repeating the relative rotation more than necessary, because the applying filler L is sufficiently filled in the filling region 101*x* between the inner side of the discharge port 101*c* of the filling member 101 and the elastic body 109 of the movable body 106 of the main body side assembly 140, as mentioned above. Accordingly, there is provided the applying filler extruding container 200 in which customer satisfaction is improved.

Further, in accordance with the applying filler extruding container 200 on the basis of the present embodiment, as shown in FIG. 30, if the movable body 106 moves forward to the maximum on the basis of the relative rotation between the filling member 101 and the main body tube 102 by a user, the elastic body 109 is brought into contact with the inclined inner surface 101*b* in the leading end portion of the filling member 101, and is elastically deformed on the lines of the inner surface 101*b*. At this time, the elastic body 109 is elastically deformed more preferably on the basis of the space 109*d* within the elastic body 109. Further, the applying filler L leaving in an approximately hoof-shaped (oblique circular cylindrical) space (a space including an inclined surface within the container leading end), which cannot be pressed out by the conventional movable body, is sufficiently pressed out with almost no remainder so as to be consumed, on the basis of the elastic deformation of the elastic body 9 mentioned above. Accordingly, there is provided an economic applying filler extruding container 200 in which a waste of the applying filler L is reduced.

Further, in accordance with the applying filler extruding container 200, since the thread tube 104 is received in the main body tube 102 so as to be rotatable and immobile in the axial direction, and the opening 101*h* corresponding to the locking portion provided in the inner peripheral surface in the rear end side of the filling member 101 and the protruding portion 104*f* corresponding to the locking portion provided in the outer peripheral surface of the thread tube 104, and the protrusion 101*f* corresponding to the locking portion provided in the inner peripheral surface in the rear end side of the filling member 101 and the protrusion 104*d* corresponding to the locking portion provided in the outer peripheral surface of the thread tube 104 are respectively locked, the filling member 101 is coupled to the thread tube 104 so as to be non-rotatable and immobile in the axial direction, and the structure is made such that the movable body 106 moves on the basis of the relative rotation between the filling member 101 and the main body tube 102. Further, since the cap 107 is not directly locked to the filling member 101 but is rotatable, the movable body 106 is not fed out, even if the cap 107 and the main body tube 102 are relatively rotated at a non-use time when the cap 107 is put on the filling member 101, and thus the applying filler L does not leak out from the discharge port 101*c* of the filling member 101. Accordingly, there is provided the applying filler extruding container 200 in which a quality is improved.

Further, in accordance with the applying filler extruding container 200, the forward moving degree of the movable body 106 is detected by a user on the basis of the resistance feeling given to the user by the ratchet mechanism 111. Accordingly, there is provided the applying filler extruding container 200 having an improved usability.

In this case, a click spring member 114 shown in FIG. 44 may be used in place of the ratchet spring member 112 shown in FIGS. 36 and 37. This click spring member 114 is different from the ratchet spring member 112 in a point that the ratchet gear 112*a* is replaced by a click tooth 114*a* engaging by click with the ratchet gear (the predetermined engagement portion) 104*g* of the thread tube 104 in such a manner as to form a chevron shape along a peripheral direction and allow the rotation in the forward and reverse directions (the rotation by which the movable body 106 moves forward and backward). Further, the click mechanism is structured by the predetermined engagement portion 104*g* of the thread tube 104, the click tooth 114*a* and a compression spring portion 114*b* energizing the click tooth 114*a* to the predetermined engagement portion 104*g* side.

In accordance with the applying filler extruding container having the click mechanism mentioned above, the relative rotation in the forward and reverse directions between the main body tube 102 and the filling member 101 is allowed, and the movable body 106 performs the forward and backward movement while the click feeling is given to a user at a time of being engaged by click on the basis of the relative rotation, and the forward moving degree and the returning degree of the movable body 106 are detected. In this case, the other operations and effects are the same as those of the applying filler extruding container 200 mentioned above. In this connection, the shapes of the click tooth 114*a* of the click spring member 114 and the predetermined engagement portion 104*g* of the thread tube 104 engaged by click therewith are not limited to those mentioned above, and the point is that the shape is made such that the click engagement is executed by the relative rotation in the forward and reverse directions.

Further, since the movable body 106 can move backward as mentioned above, a user returns the movable body 106 a little while detecting the returning degree of the movable body 106 on the basis of the click feeling after the application, whereby it is possible to form a predetermined space B which is the same as that described in the first embodiment, in the inner side of the discharge port 101*c* of the filling member 101. Accordingly, even if the applying filer L filled in the filling region 101*x* and the air mixed into the applying filler L are inflated due to variation of temperature and variation of atmospheric pressure, the applying filler L is prevented from leaking out from the discharge port 101*c* on the basis of the predetermined space B provided in the inner side of the discharge port 101*c*.

Further, since the movable body 106 can move forward and backward as mentioned above, it is, of course, preferable in the same manner as the first embodiment that the concave portion or the convex portion is provided in the rear end surface of the movable body 106, and the convex portion moving forward to the concave portion and engaging in the rotating direction or the concave portion to which the convex portion moves forward and engaging in the rotating direction is provided in the bottom surface of the main body tube 102, thereby preventing the shaft body 102*c* from being wrenched off.

The description is particularly given above of the present invention on the basis of the embodiments, however, the present invention is not limited to the embodiments mentioned above, but a cilia or the like may be planted on the outer surfaces of the applied bodies 10, 15, 17, 20 and 21 and the outer surface 101*a* forming the applying surface of the filling member 101, or a brush formed by bundling tapered polyester fibers may be attached.

In this case, the male threads 6*b* and 106*b* include intermittently arranged projection groups or spirally and intermittently arranged projection groups which have the same function as the thread ridge. Further, the female threads 4*c* and 104*c* include intermittently arranged projection groups, or spirally and intermittently arranged projection groups which have the same function as the thread ridge.

What is claimed is:

1. An applying filler extruding container discharging an applying filler filled in a filling region within a container through a discharge port provided in a leading end of the container on the basis of forward movement of a movable body arranged within said container, comprising:

a leading tube formed in a tubular shape and having said discharge port at a leading end; and a main body side assembly made by installing said movable body, an engagement portion having a male thread and a female thread for moving said movable body, and a rotation preventing portion of said engaging portion and said movable body in a main body side tube portion formed in a tubular shape, wherein an inner portion of said leading tube is formed as said filling region so as to be formed as a filling member in which said applying filler is filled, wherein the filling member in which the applying filler is filled is inserted to the leading end side of said main body side assembly so as to be attached to said main body side assembly, wherein said main body side assembly includes said movable body provided on an outer surface with the male thread, and a thread tube received in said main body tube so as to be rotatable and immobile in an axial direction and having said female thread formed in an inner surface engaging with said male thread of said movable body, wherein a shaft body portion extends from a bottom portion of said main body tube, and the movable body rotates with the shaft body portion and moves in the axial direction independently upon said shaft body portion by engaging the rotation preventing portion provided on the outer surface of the shaft body portion with the rotation preventing portion provided on the inner surface of the movable body, wherein a locking portion provided in an inner surface in a rear end side of said filling member is coupled to a locking portion provided in an outer surface of said thread tube so as to be non-rotatable and immobile in the axial direction, and said movable body is moved on the basis of a relative rotation of said main body tube and said filling member.

2. An applying filler extruding container as claimed in claim 1, wherein a plurality of concave portions depressed to the leading end side or a plurality of convex portions protruding to the rear side are provided in a rear end surface of said movable body along a peripheral direction, and a plurality of convex portions moving forward to said concave portions of said movable body at the maximum retreated time of said movable body so as to be engaged in the rotating direction, or a plurality of concave portions to which said convex portions of said movable body move forward so as to be engaged in the rotating direction are provided in the bottom surface of the main body tube and a peripheral edge of said shaft body portion.

3. An applying filler extruding container as claimed in claim 2, wherein said main body side assembly has a built-in engagement portion on a leading end of the main body tube, and a built-in rotating amount regulating member having a concavo-convex portion arranged so as to face to the engagement portion in an axial direction and energized toward said engagement portion by an elastic portion, and wherein said concavo-concave portion of said rotating amount regulating member and said engagement portion are engaged by click in accordance with a fixed amount relative rotation in forward and reverse directions with respect to the concavo-convex portion of the rotating amount regulating member

4. An applying filler extruding container as claimed in claim 2, wherein said concavo-convex portion and said engagement portion constitute a ratchet mechanism allowing one-way rotation.

* * * * *